US007938432B2

(12) United States Patent
Schlegel et al.

(10) Patent No.: US 7,938,432 B2
(45) Date of Patent: May 10, 2011

(54) DEVICE USED AS A CLIMBING AID

(75) Inventors: Andreas Schlegel, Langnau am Albis (CH); Urs Weilenmann, Zürich (CH); Andreas Fritschi, Willmis (CH)

(73) Assignee: Fritschi AG—Swiss Bindings, Reichenbach IM Kandertal (CH)

( * ) Notice: Subject to any disclaimer, the term of this patent is extended or adjusted under 35 U.S.C. 154(b) by 0 days.

(21) Appl. No.: 12/500,344

(22) Filed: Jul. 9, 2009

(65) Prior Publication Data

US 2010/0001491 A1 Jan. 7, 2010

Related U.S. Application Data

(63) Continuation of application No. PCT/CH2008/000014, filed on Jan. 11, 2008.

(30) Foreign Application Priority Data

Jan. 11, 2007 (WO) ..... PCT/CH2007/000011

(51) Int. Cl.
*A63C 5/00* (2006.01)
*A63C 9/00* (2006.01)

(52) U.S. Cl. ..... 280/601; 280/614; 280/615; 280/633

(58) Field of Classification Search ..... 280/611, 280/618, 601, 614, 626, 623, 633, 615, 11.3, 280/14.21, 14.22, 14.24, 11.32, 11.33, 604
See application file for complete search history.

(56) References Cited

U.S. PATENT DOCUMENTS

| | | | | |
|---|---|---|---|---|
| 3,900,205 | A * | 8/1975 | Sittmann | 280/618 |
| 4,002,354 | A * | 1/1977 | Ramer | 280/614 |
| 4,322,090 | A * | 3/1982 | Loughney | 280/614 |
| 4,887,833 | A * | 12/1989 | Bailey | 280/615 |
| 5,318,320 | A | 6/1994 | Ramer | |
| 5,560,633 | A * | 10/1996 | McGowan | 280/614 |
| 6,024,375 | A * | 2/2000 | Johnson | 280/601 |
| 6,431,578 | B2 * | 8/2002 | Pedersen et al. | 280/626 |
| 7,201,392 | B2 * | 4/2007 | King | 280/618 |
| 7,264,263 | B2 * | 9/2007 | Riedel et al. | 280/614 |
| 7,384,057 | B2 * | 6/2008 | Steffen et al. | 280/611 |
| 2005/0178017 | A1 | 8/2005 | Huang et al. | |
| 2006/0017262 | A1 | 1/2006 | King | |

FOREIGN PATENT DOCUMENTS

AT 359 897 B 12/1980

(Continued)

*Primary Examiner* — Hau V Phan

(74) *Attorney, Agent, or Firm* — Birch, Stewart, Kolasch & Birch, LLP

(57) ABSTRACT

A device comprising a supporting device as climbing aid for a ski. The supporting device has at least two supporting positions, in which it prevents a boot held in a ski binding from being lowered below a climbing angle between the boot and the ski associated with the respective supporting position. The device comprises an adjusting device, which is actively connected to the supporting device and can be directly or indirectly actuated by a user and which can move the supporting device from a first into a second supporting position. The adjusting device includes an operating element for actuation of the adjusting device and an intermediate store for storing the actuation, wherein, in an adjusting process, the adjusting device moves the supporting device from said first into said second supporting position after a time delay, the adjusting process being initiated with the time delay in relation to the actuation.

30 Claims, 18 Drawing Sheets

FOREIGN PATENT DOCUMENTS

| | | | |
|---|---|---|---|
| AT | 371 735 | B | 7/1983 |
| AT | 373 162 | | 12/1983 |
| AT | 403 890 | B | 6/1998 |
| AT | 503 099 | A1 | 7/2007 |
| DE | 2064754 | A1 | 7/1972 |
| DE | 26 21 111 | A1 | 11/1977 |
| DE | 37 02 149 | A1 | 8/1988 |
| DE | 200 06 446 | | 1/2001 |
| DE | 102 08 946 | A1 | 9/2003 |
| EP | 0 724 899 | B1 | 8/1996 |
| EP | 0 955 073 | A2 | 11/1999 |
| WO | WO-2007/079604 | A1 | 7/2007 |

* cited by examiner

DEVICE USED AS A CLIMBING AID

This application is a Continuation of copending PCT International Application No. PCT/CH2008/000014 filed in Switzerland on Jan. 11, 2008 which designated the United States, and on which priority is claimed under 35 U.S.C. §120. This application also claims priority under 35 U.S.C. §119(a) on National Phase Application No. PCT/CH2007/000011 filed in Switzerland on Jan. 11, 2007. The entire contents of each of the above documents is hereby incorporated by reference into the present specification.

TECHNICAL FIELD

The invention concerns a device comprising a supporting device as a climbing aid for a ski, the supporting device having at least two supporting positions, in which the supporting device prevents a boot that is held in a ski binding from being lowered below a climbing angle between the boot and the ski that is associated with the respective supporting position, and comprising an adjusting device, which is actively connected to the supporting device and can be directly or indirectly actuated by a user.

PRIOR ART

With respect to their function, ski bindings can be divided into downhill bindings, which are only used for skiing downhill and on ski lifts, and cross-country bindings, which are also additionally used for walking on skis, in particular for climbing with the aid of climbing skins fastened to the skis. While the first bindings simply ensure reliable fixing of the ski boot on the ski in the so-called downhill position, the latter bindings must not only have a downhill position but also be capable of being brought into a climbing position for climbing, in which position a pivoting movement between the ski boot and the ski is made possible for walking. The ski boot is usually in this case pivotable about a transverse pin on the ski, so that, for walking, it can be lifted off the ski in the heel region.

For this purpose, cross-country bindings have, for example, a carrier which is pivotable with respect to a base part fixed to the ski and, together with front and heel jaws fastened to it, forms a ski boot carrier. To perform the dual function of a cross-country binding (climbing, downhill skiing), a locking mechanism allows the ski boot carrier either to be rigidly connected to the ski or unlocked in such a way that the ski boot carrier can be lifted off the ski in the heel region.

Apart from the locking lever serving for the locking and unlocking of the boot mount in the heel region, the locking mechanism often also has a supporting lever, which in its active position forms a support for the unlocked ski boot carrier, at a distance above the ski. The support consequently offers a climbing aid during climbing, to compensate at least partially for a slope of the terrain. Otherwise necessary bending of the ankle joint, which is restricted in its freedom of movement in the ski boot, is thereby obviated and makes climbing more comfortable for the skier.

There are also known cross-country ski bindings which do not have a ski boot carrier (for example bindings according to EP 0199 098 B1; Barthel). In the case of such bindings, the climbing aid directly supports the ski boot in the heel region. Such climbing aids may also be used in the case of Telemark bindings, there also typically being no ski boot carrier in this case and the boot being supported directly by the climbing aid in the heel region.

One disadvantage of known climbing aids is that it is generally necessary to stop to adjust the supporting lever, which inhibits the fluidity of movement during climbing. Another disadvantage, however, is that it is not always easy, particularly for beginners, to carry out an adjustment of the supporting lever on steep terrain—but this is precisely where it is usually necessary—or under adverse weather conditions without an increased risk of falling.

A climbing aid that is easier to operate is described in EP 0 724 899 B1 (Fritschi) and has a locking lever which is pivotable with respect to the ski and has in addition to a locking element two or more supports for a catch element of the ski boot carrier at different distances from its mounting axis. The locking lever can in this case be engaged in the individual pivoting positions for the locking and unlocking and also the supporting of the catch element by means of a spring catch. The locking lever is merely pivoted into the different pivoting positions, predetermined by the spring catch, and consequently brought into different functional positions, which either concern the locking and unlocking of the binding carrier or increased support thereof in the function as a climbing aid. While the operation of the climbing aid according to EP 0 724 899 B1 has been greatly simplified in comparison with earlier customary climbing aids, the skier must still bring the supporting lever into the correct pivoting position directly, either by hand or with a ski stick. Such manipulations, however, require simultaneous lowering of the heel region of the boot or the ski boot carrier or generally of that part that is supported by the climbing aid. In this case, the heel region must be brought to a height above the surface of the ski that is greater than the distance of the corresponding supporting position of the climbing aid, which can produce an unpleasant and possibly dangerous imbalance of weight in the skier, particularly in the case of great climbing angles.

DE 37 02 149 A1 (vauDE Sport) describes a climbing aid which can be operated by means of an actuating device, the actuating device substantially comprising two actuable pushbuttons and, when correspondingly actuated, pushing a supporting element of a predetermined height into the path of movement of a ski boot or a ski boot carrier and withdrawing it again as and when required. Whereas this makes it easier to operate a climbing aid (by pressing a button with the ski stick), the skier can only activate or deactivate one supporting position and to do so must still raise the heel region of the boot.

An entirely new approach is taken in WO 2007/079604 (Fritschi). This describes a climbing aid which prevents lowering of the boot into a position parallel to the ski, the climbing aid being able to set itself in a self-regulating manner in such a way as to compensate automatically for a change in the slope of the terrain. In this case, a position of the boot or of the ski boot carrier is continuously determined and, when lowering onto a supporting element occurs, lowering below a horizontal position is avoided. In a further embodiment, an inclination of the ski is continuously measured and, on the basis of the measurement, a supporting element is blocked in such a way that lowering of the boot below a horizontal position is avoided. All the solutions have the disadvantage that measurement of the position of the ski and/or of the boot has to take place during comparatively strong accelerations of the boot or of the ski boot carrier and/or of the ski when lowering the boot and pushing forward the ski during climbing. Since the accelerations thereby occurring may have values that are comparable or much greater than gravitational acceleration, these position or inclination measurements are of course only possible with low accuracy. It is consequently difficult to implement sufficiently accurate setting of the height of the climbing aid.

SUMMARY OF THE INVENTION

The problem addressed by the invention is therefore that of providing a ski in the technical field mentioned at the beginning with a climbing aid that is easy to operate.

According to the invention, a device for a ski comprises a supporting device as a climbing aid which has at least two different supporting positions, in which the supporting device prevents a boot that is held in a ski binding or a ski boot carrier from being lowered below a climbing angle between the boot and the ski that is associated with the respective supporting position, and comprising an adjusting device, which is actively connected to the supporting device and can be directly or indirectly actuated by a user. The climbing aid according to the invention is distinguished by the fact that the adjusting device is formed in such a way that, in an adjusting process, it can move the supporting device from a current supporting position into a new supporting position, the adjusting process being initiated with a time delay in relation to an actuation of the adjusting device.

The climbing angle refers here to an angle between a boot or a boot sole or a ski boot carrier and a ski, which is predetermined by the climbing aid and below which a boot or ski boot carrier cannot be lowered. A climbing angle is predetermined here by the supporting device being brought into a corresponding supporting position, in which the supporting device supports the boot or the ski boot carrier at a distance from the ski in such a way that the boot or the ski boot carrier forms the climbing angle with the ski.

According to the invention, as a result of indirect or direct actuation by the skier, the actuable adjusting device allows adjustment of the supporting device from any desired current supporting position into another, new supporting position. Direct or indirect actuation refers here to an actuation which may, for example, take place manually or else by means of a ski stick, an operating element, such as for example a cable, or else by a foot or other body parts of the skier. In particular, the device as a climbing aid may have almost any desired actuating element that allows actuation of the adjusting device.

This achieves the effect that a supporting position of the supporting device can be adjusted by actuation of the adjusting device alone, without the supporting device having to be directly manipulated. The actuable adjusting device according to the invention consequently creates the possibility of making an actuating process that is required for the adjustment of the climbing aid independent of an actual configuration of the supporting element or of an actuating process required for adjustment of the supporting position of the supporting device. In particular, the actuating process can, in conformity with requirements, be made more convenient for the skier. In this case the supporting device may, for example, be adjusted into each desired supporting position by simple actuation of the adjusting device. It is in this case conceivable, for example, that multiple actuation of the adjusting device is required to bring the climbing aid into a state in which the supporting position of the supporting device corresponds to a desired climbing angle. For example, a desired climbing angle may be set incrementally or decrementally, by the supporting device being brought closer to the desired climbing angle successively or step by step with each actuation of the adjusting device.

A desired climbing angle refers here to a climbing angle which, in keeping with requirements for the climbing aid, ensures best-possible comfort during climbing. According to the invention, the desired climbing angle preferably corresponds to the angle bisector of a current longitudinal inclination of the ski with respect to a horizontal. This means in practice that, at an angle of inclination $\alpha$ of the ski with respect to a horizontal, the preferred climbing angle between the ski and the boot or the ski boot carrier lies in the range of $\alpha/2$. It has emerged in tests conducted by the applicant that such a setting of a climbing angle is found by the skier to be particularly convenient, in particular also much more convenient than setting of the climbing aid by a boot being supported in a horizontal position. Depending on the requirement, the preferred climbing angle for a given slope of terrain may, however, also take values that are greater than or less than $\alpha/2$. In particular, it may be possible, for example, that the desired climbing angle can be predetermined by the skier by means of a setting device, i.e. the skier can for example choose whether he wishes $\alpha/2$ as the preferred climbing angle, or a smaller or greater angle, such as for example $2\alpha/3$.

It goes without saying here that the actual climbing angle, associated with a current supporting position, may deviate from the desired climbing angle, without the supporting device being set right away into a new supporting position. A so-called hysteresis of the adjusting device is provided for this, so that adjustment of the supporting position only takes place or is instigated when a predetermined deviation from the desired climbing angle is exceeded. Such a hysteresis is of advantage in the case of the climbing aid adjustment to the extent that the adjusting device does not adjust the supporting device into a new supporting position in an adjusting process when there are only very small deviations from a desired climbing angle.

The device according to the invention may comprise a ski binding, but it is also possible for example for it to be provided as a separate part or a separate arrangement which can interact with an existing ski binding. The device according to the invention may, in particular, also only comprise the adjusting device, which in this case is formed for example as a separate unit. In this case an already existing climbing aid or supporting device can for example be retrofitted with the adjusting device. It is preferred, however, for the adjusting device to be integrated together with the supporting device in one unit as a compact component. In particular, configurations of the climbing aid in which the adjusting device is integrated in a base part fastened to the ski are conceivable in this case, the supporting device then being provided for example on the adjusting device. Other exemplary embodiments comprise integration of the adjusting device in the supporting device, the supporting device in this case being attached for example to a base part or the climbing aid comprising an adjusting device and a supporting device, both of which are attached to one or more base parts. Depending on requirements for the climbing aid according to the invention, the individual components may be differently formed and arranged in relation to one another.

According to the invention, the adjusting device may have for actuation an operating element formed in almost any way desired. The adjusting device then converts an actuation of the operating element performed by the skier by means of the adjusting device and, if appropriate, adjusts a supporting position of the supporting element. In particular, this achieves the effect that setting of the climbing aid can be performed by a manipulation of the adjusting device that can be largely independent of the actual configuration of the supporting device and the current supporting position. For example, it is conceivable to provide the supporting device with buttons which can be operated by a ski stick and simply have to be pressed. On account of the actuation by means of the adjusting device, the adjusting device then acts for example on a heel lever pivotably articulated to the ski and adjusts a pivoting position of the same.

It is conceivable, for example, to form the adjusting device for sequential upward and downward switching of the supporting device between a large number of climbing stages that are discrete, i.e. separated by angular intervals, with different climbing angles. For this purpose, the adjusting device may for example be provided with two operating elements, which can for example be operated with a ski stick. One of the operating units may serve for upward switching, i.e. for adjusting the supporting device to supporting positions with greater climbing angles, and the other for downward switching. By simply operating the respective operating element, the supporting position of the climbing aid is thereby conveniently set appropriately in the desired direction, i.e. to greater or smaller climbing angles.

To meet the safety requirements for a modern cross-country binding, the climbing aid or the adjusting device should be formed in such a way that the supporting device itself can be operated or adjusted by the skier without actuating the adjusting device. This is required in particular whenever the climbing aid must continue to be operable even in the event of possible failure or malfunction of the adjusting device. For this purpose, the adjusting device may for example be blocked or decoupled from the supporting device in such a way that the supporting device can be operated in a way equivalent to known climbing aids.

For this purpose, the adjusting device may for example be brought into a state in which, when actuated, an adjusting process on no account takes place, or only "neutral steps" without adjustment of the supporting device take place. In particular, a climbing aid with a supporting device formed as a heel lever is conceivable, as described for example in EP 0 724 899 B1 (FritSki), the invention providing that the heel lever can on the one hand be operated or adjusted by means of the adjusting device and/or on the other hand the heel lever can, as and when required, be adjusted in a known way manually or with a ski stick, it being possible for the adjusting device to be deactivated as and when required.

According to the invention, the supporting device may preferably also have more than two supporting positions, in particular any number, preferably 3 to 5 different supporting positions, in order to achieve a sufficiently fine graduation in the possible climbing angles available.

In the configurations of the climbing aid described thus far, the skier must, however, still raise the boot or the ski boot carrier in the supported region, i.e. typically in the heel region, at the same time as the actuation of the adjusting device, in order that the adjusting process can be carried out. The invention remedies this. According to the invention, the adjusting device of the climbing aid is formed in such a way that the adjusting process only takes place after actuation of the adjusting device, i.e. with a time delay from when the adjusting device is actuated. Actuation refers here to initial manipulation. By analogy with a binary button, which in the pressed state is in an "on" state and goes over into an "off" state when it is released, "actuation" refers here and hereafter to the transition from the "off" state to the "on" state. In this sense, the adjusting process takes place according to the invention with a time delay from when the adjusting device is actuated, i.e. initial manipulation of the adjusting device does not immediately result in an adjusting process, and the adjusting process follows some time after the actuation. If the adjusting device is in a state corresponding to the "on" state, this is referred to hereafter as an "actuated state". The transition of the adjusting device corresponding to a transition from the "on" state to the "off" state of the binary button is referred to here and hereafter as "initiation of the actuated state".

In particular, the device according to the invention as a climbing aid with an actuable adjusting device also makes it possible to carry out a method for adjusting a climbing aid in which an adjusting process is initiated at a time other than when the climbing aid is directly or indirectly actuated. This achieves the effect that actuation of the adjusting device may be at a time other than the adjusting process. In particular, the actuation may take place at a point in time at which the supporting device is possibly not adjustable at all. When carrying out a climbing movement, this applies for example to the time period during which the boot or the ski boot carrier is lowered onto the supporting device and is loaded with the weight of the skier. In this time period, the supporting device is typically blocked in such a way that adjustment from a current position into a new position is not usually possible.

The invention is consequently based on the recognition that an improvement in the operating convenience of a climbing aid can be achieved by enabling the skier to actuate the climbing aid at a point in time that appears suitable to him. In particular also at a point in time at which the boot or ski boot carrier has been lowered onto the supporting device and in which the supporting device possibly cannot be adjusted. In order to make this possible, it is particularly advantageous if the actuating time can be chosen largely independently of the actual adjusting process of the climbing aid. This is so because in this case the adjusting process can take place at a later point in time, preferably without further intervention by the skier, when adjustment of the supporting device is possible without any problem. A particularly suitable point in time for initiating an adjusting process is when, after actuation of the adjusting device, the skier lifts the boot off the supporting device in a following step during climbing. Since the step takes place in the course of carrying out the climbing movement, the skier is engaged in a controlled sequence of movements and not in an uncomfortable and possibly precarious balancing act, such as that which has to be performed when carrying out the adjustment when stationary in the case of conventional climbing aids. Since the supporting device of the climbing aid is always released when the boot is lifted off, the supporting device can be adjusted from the current supporting position into a new supporting position.

For this, the adjusting device of the climbing aid according to the invention has an intermediate store, which can store the actuation of the adjusting device by the skier and retrieve it, preferably automatically, as and when required at any suitable point in time. For example, the adjusting device may be formed in such a way that, after actuation of the climbing aid by the skier, it waits, largely automatically, until a suitable point in time at which the adjusting process can be initiated and the climbing aid adjusted. The store may be formed here as an electronic or hydraulic store, but preferably comprises a mechanical store, for example in the form of a helical, spiral or leaf spring or a spring assembly of metal and/or else made up of elastic components of other elastically deformable materials.

Consequently, operation of the climbing aid according to the invention generally comprises two stages, which may be controlled for example by lowering and re-raising of the boot or the ski boot carrier. In a first stage, the adjusting device of the climbing aid is actuated, involving for example actuating energy being stored and, given appropriate configuration of the device, a measuring process initiated. In a second stage, an adjusting process may be initiated, adjusting the supporting device into a new supporting position, involving for example evaluation of the data determined in the measuring process and retrieval of stored actuating energy. An adjustment of the climbing aid according to the invention can consequently take place in a two-stage operation. In particular, the two-stage operation is made possible by the climbing aid device according to the invention.

The adjusting device is preferably formed in such a way that, following actuation, it can be kept in an actuated state during a time interval that can be determined by the user. By analogy with the aforementioned binary button, the actuated state of the adjusting device corresponds to the "on" state. In this case it is conceivable for the adjusting device to be configured in a way analogous to the binary button described above, which has to be kept pressed to establish the "on" state. In this case, to maintain the actuated state, the adjusting device must be operated during the entire contact-making interval, i.e. kept actuated, which by analogy with the pushbutton corresponds for example to a "pressed-down state". In particular, this can take place for example by the loading applied by the weight of the skier when the boot is lowered. If the binary pushbutton is let go or the corresponding operation of the adjusting device is ended, the actuated state is discontinued, i.e. for example the "pressed-down state" is "let go". This may be the case in particular when the boot is lifted off in the course of the walking movement. Alternatively, it is also conceivable, however, that the adjusting device can be actuated by means of a more generalized pushbutton, such as for example a switch. In this case, a first switching process would switch the adjusting device into an actuated state. The actuated state would have to be discontinued again thereafter by a further switching process, in order to reset the adjusting device to the initial state.

The adjusting process of the adjusting device is preferably only initiated at the time of or after initiation of the actuated state. In particular, the climbing aid is preferably formed in such a way that the actuated state of the adjusting device is initiated when the supporting device is relieved of loading. The adjusting process may take place here in particular during the process of lifting the boot or the ski boot carrier off the supporting device, i.e. when the actuating state is initiated, or else at almost any other desired point in time, the adjusting process preferably taking place before the adjusting device is actuated again.

The adjusting device is in this case advantageously formed and interacts with the supporting device in such a way that the climbing angle associated with the new supporting position may be greater than or smaller than the climbing angle of the current supporting position. In principle, there are conceivable configurations of the climbing aid according to the invention in which, when the adjusting device is actuated, the current supporting position of the supporting device can only be adjusted in one direction, for example to greater climbing angles. Such a configuration allows convenient operability for example when climbing into terrain that is steeper, and consequently also usually more dangerous, while the climbing aid can be operated in a conventional manner when transferring to terrain that is easier and less steep. While such a configuration may well be preferred over a simplified configuration of the adjusting device, climbing aids according to the invention with an adjusting device which makes it possible upon actuation to adjust if need be to greater and smaller climbing angles are generally to be preferred. Such configurations of the climbing aid allow the skier to be able to benefit from the advantages of the solution according to the invention in terrain of any slope.

The adjusting device according to the invention may in this case be formed in such a way that a supporting position of the supporting device that is associated with a desired climbing angle is set directly by a single actuation. However, the climbing aid is advantageously formed in such a way that a supporting position of the supporting device that is associated with a desired climbing angle can be set by a single actuation, but also by multiple actuation of the adjusting device step by step, and in particular incrementally (increasing step by step) or decrementally (decreasing step by step). Bringing the adjusting device closer to the desired position step by step allows the possibility of forming it in such a way that an adjusting increment in a single adjusting process is constant, i.e. in each adjusting process the new climbing angle differs for example by a predetermined amount from the current climbing angle. This is not necessary however. Depending on the requirement, it is also possible to prefer a configuration in which the change in the climbing angles from one supporting position to the next varies. In the case of a small change in the slope of the terrain during climbing, a single adjusting process is sufficient for example to achieve the desired climbing angle. In the case of a comparatively great change in the slope of the terrain, the desired climbing angle may then be set step by step by multiple actuation.

In particular, the adjusting device is in this case formed in such a way that, if appropriate, if for example the desired climbing angle is already set, the current supporting position is maintained in spite of actuation, possibly even repeated actuation, of the climbing aid. The adjusting device is consequently also formed for carrying out a neutral step. As a variant, there are also conceivable configurations of the climbing aid or of the adjusting device which directly set a desired climbing angle exclusively in the case of single actuation. Such embodiments may be preferred, depending on requirements, but generally require a comparatively complicated construction, since not only an adjusting direction of the climbing aid must be determined but also a size or increment of an adjusting step or climbing angle step.

A particularly convenient, and consequently also preferred, embodiment of the climbing aid according to the invention comprises a supporting device which is coupled with the adjusting device in such a way that the adjusting device can be actuated by the supporting device. In particular, a coupling which functionally couples the adjusting device to the supporting device is provided. The supporting device consequently forms an operating element or an actuating element of the adjusting device. For this, the adjusting device may be formed in particular as a resilient mounting for the supporting device. For this purpose, the adjusting device comprises, for example, a resilient rocker, to one arm of which the supporting device is for example pivotably attached. The spring effect of a rocker preferably acts in this case counter to loading of the supporting device by the skier upon actuation, so that, when it is relieved of the loading applied by the skier or when the actuated state is initiated, the resilient rocker is reset to the initial position before actuation. In a further variant, the adjusting device comprises, for example, a sprung pin, on which a supporting device, for example formed as a heel lever, is pivotably mounted. The pin is in this case preferably sprung in such a way that the heel lever can be lowered against the ski when loading is applied and is lifted off away from the ski when it is relieved of the loading.

Consequently, given that the adjusting device is suitably formed, a skier can actuate the adjusting device when loading is applied to the supporting device, in particular for example when the boot is lowered onto the supporting device. The adjusting device may be formed here in such a way that it can be kept in an actuated state for the time period during which the boot is lowered onto the supporting device, i.e. the supporting device is loaded by the boot. When the boot is lifted off the supporting device, the actuated state can, for example, be discontinued again. When a walking step is being performed, however, operation does not have to take place by means of the supporting device. A further variant provides, for example, an additional operating element, which is arranged for example under the boot, possibly also in a front region of the boot or the ski boot carrier, and is operated, and consequently actuates the adjusting device, with every step. However, the operating element does not have to be arranged under the boot, but may for example also be arranged to the side, in front of or behind the boot. For example, an operating element, for example a pushbutton, which is actuated each time the adjusting device is lowered may also be provided on a front base part of the ski binding, or the swivel joint of the cross-country binding is for example coupled with the adjusting device via a joint arm. This enumeration should not be regarded as exhaustive; it is instead intended by the large number of possibilities created to illustrate how full automation of the adjustment of the climbing aid during climbing could look on the basis of the solution according to the invention.

The possibilities created by such a climbing aid not only allow a climbing aid to be conveniently operated but also free the skier entirely of explicit adjustment of the climbing aid. In particular, this achieves the effect that the adjustment or adaptation of a supporting position of the supporting device of the climbing aid can take place automatically with every step taken by the skier. Automatic means in this connection that the skier does not have to perform any actions other than those of a conventional sequence of movements during climbing in order to initiate an adjusting process in the adjusting device. The skier therefore no longer needs to interrupt climbing and stop in order to perform a setting of the climbing aid. Rather, the skier performs the conventional walking movement, as is customary during climbing, and with every step, i.e. with every lowering of the boot onto the supporting device, actuates the adjusting device of the climbing aid by means of the supporting device itself. Given that the adjusting device is appropriately formed, in the adjusting process that follows the actuation, possibly with a time delay, the supporting position of the supporting device is adjusted to greater or smaller climbing angles. In particular, the adjusting process is initiated for example during or directly after the boot or a ski boot carrier of the ski binding is lifted off again from the adjusting device, whereby free adjustability of the supporting device is ensured on account of the lifted-off boot or ski boot carrier.

If a desired climbing angle of the climbing aid has already been achieved, the adjusting device is preferably formed in such a way that no further adjusting process is initiated and the supporting device remains in the current supporting position. The same applies in the case of supporting positions with an extreme climbing angle, i.e. those supporting positions which correspond to a greatest and a smallest climbing angle. If the supporting device is in an extreme supporting position, the adjusting device is then preferably formed in such a way that it is not adjusted beyond the extreme supporting position even when there is a sufficiently great change in the slope of the terrain. In actual implementation of the adjusting device, it may, however, be advantageous for reasons of continuity of the adjusting process to initiate a neutral adjusting process in this case, i.e. a kind of "neutral step", which is equivalent or similar to the adjusting process with an adjustment of the supporting position but in which no adjustment of the supporting position of the supporting device takes place.

The supporting device is in this case advantageously formed in such a way that the individual supporting positions can be sequentially accessed. In particular, the supporting positions of the supporting device are preferably disposed according to the amount of the associated climbing angles. Consequently, for each supporting position with a climbing angle there are two adjacent supporting positions, one with a greater climbing angle and one with a smaller climbing angle.

The supporting positions with extreme climbing angles, i.e. the supporting positions with a greatest and a smallest climbing angle, have in this case only one adjacent supporting position with a smaller climbing angle or a greater climbing angle, respectively. In a further preferred embodiment, the supporting device has supporting positions of which the assigned climbing angles are discrete. There are also conceivable configurations of the supporting device of which the supporting positions provide continuous climbing angles, by contrast with discrete climbing angles. As examples of a supporting device with continuous supporting positions and climbing angles, mention may be made here of a spindle that can be electrically adjusted in height perpendicularly to the ski, or a hydraulic cylinder, with which the boot can be supported in continuous climbing angles. Further continuous supporting devices may comprise, for example, an eccentrically mounted roller, which allows support at different heights above the ski depending on the rotational position.

For an actual configuration of the climbing aid in which the supporting positions of the supporting device are adjusted in an adjusting process, in particular in a kind of switching step, discrete supporting positions with discrete associated climbing angles are generally, but not always, to be preferred.

The climbing aid according to the invention also comprises configurations which do decide on the basis of predetermined criteria whether to switch to greater or smaller climbing angles, but not the extent to which adjustment must be made in an adjusting process to set a desired climbing angle. Such configurations achieve a desired climbing angle only after multiple actuation of the climbing aid, by bringing the device closer to the desired climbing angle sequentially, i.e. step by step incrementally or decrementally. In this case, a configuration of the supporting device with discrete climbing angles is particularly advantageous for making it possible to bring the device closer to the desired climbing angle step by step. A supporting device with continuous supporting positions may, however, also likewise be adjusted by the supporting device in such a way that discrete supporting positions with discrete climbing angles are obtained (discrete angles of rotation in the case of the aforementioned example of the eccentric roller).

The components of the climbing aid, in particular the adjusting device and the supporting device, are preferably formed and interact in such a way that the new supporting position that is set in the adjusting process is adjacent the current supporting position. Two supporting positions are referred to here as adjacent if in the adjusting process no further intermediate supporting position is skipped over during the transition from one supporting position to the other. A configuration in which the new supporting position is not adjacent the current supporting position may indeed likewise be advantageous, depending on the requirement. For example, there is a conceivable configuration of the adjusting device in which the intention is to compensate for a great change in the slope of the terrain in a single adjusting process and not in a step-by-step approach. In this case it is sometimes necessary during the adjusting process to skip over one or more supporting positions in such a way that the new supporting position is not adjacent the current supporting position. Generally, however, a configuration of the climbing aid with the device being brought closer to a desired climbing angle step by step is to be preferred. The adjusting device is in this case preferably formed for adjusting the supporting device by one supporting position at a time.

By setting or bringing the device closer to the desired climbing angle step by step, for example sequentially either in an incremental manner, i.e. with an increasing climbing angle, or in a decremental manner, i.e. with a decreasing climbing angle, in adjusting processes following one another, a (logical) "step increment" of the adjusting process (namely "a supporting position") can be kept constant. This allows, for example, the adjusting device of the climbing aid to be of a much simpler design than if it were necessary during the adjusting process to decide for example not only on an adjusting direction (to greater or smaller climbing angles) but also on a "step increment" to be performed in the adjusting process.

As already mentioned at the beginning, the adjusting device of the climbing aid according to the invention comprises an intermediate store, which can store the actuation of the adjusting device by the skier and retrieve it, preferably automatically, as and when required at a suitable point in time. For this, the adjusting device comprises in particular an energy store, which intermediately stores energy expended for the actuation of the adjusting device. The adjusting device is preferably formed in such a way that the intermediately stored energy can be retrieved by the adjusting device as and when required, in particular can be retrieved by the adjusting device for carrying out the adjusting process. No further energy has to be expended, for example by the skier, to carry out the adjusting process. The energy store is formed for example as a mechanical energy store, a spring being particularly advantageous here. In an electrical variant of the climbing aid, the energy store may be formed for example as a storage battery, which can be charged upon actuation and discharged later as and when required. Generally, however, mechanical configurations of the climbing aid are preferred, the mechanical energy expended for the actuation of the adjusting device being stored for example in a spring. The spring may in this case be a helical spring that can be loaded by compression or tension, or else a spiral spring or a simple leaf spring. In principle, any elastically deformable material may be used as the mechanical energy store, for example metals such as spring steel, but also plastics such as for example rubber. Other stores for mechanical energy are also conceivable in principle (for example a flywheel), but constructions that are simpler in terms of production technology are generally to be preferred.

It is in this case conceivable that the energy store is formed in such a way that not only the adjusting device but possibly also further components of the climbing aid can draw the stored energy from the store as and when required. The energy store offers the advantage that the actuable adjusting device can be "charged" with energy in a time period, for example during the performance of the climbing movement, during which the energy expenditure is of no consequence to the skier, or the skier can expend the actuating energy easily and without additional effort. In particular, energy of the climbing step may be expended thereby for the actuation. For this, the energy store is preferably formed such that it can be charged by the walking movement. This energy can be recovered at a later point in time, for example by the adjusting device, in order for example to carry out the adjusting process. In particular, the energy can be recovered in a time period in which the boot is lifted off from the supporting device or while the boot is being lifted off the supporting device. It is conceivable here that the energy remains in the store as long as the adjusting device is in the actuated state. If the actuated state is discontinued, the stored energy can in this case be released and the adjusting process initiated or the stored energy achieved by the initiated adjusting process.

In a particularly convenient, and consequently preferred, configuration of the climbing aid, in order to automatically establish an adjusting direction of the climbing aid that is required for setting the desired climbing angle, i.e. adjustment to greater or smaller climbing angles, the adjusting device comprises a measuring device, which is formed in such a way that a longitudinal inclination of the ski can be determined in a measuring process. Also provided in particular in this case is a control device, with which the measuring process of the measuring device can be restricted to a desired window of time. When the climbing aid is adjusted, a measuring process in which the longitudinal inclination of the ski is determined is preferably carried out. The measuring process advantageously takes place at least during the actuated state of the adjusting device, preferably following actuation of the adjusting device.

On the basis of the inclinational or positional data concerning the position of the ski determined in the measuring process, the adjusting device can either initiate an adjusting process and adjust the supporting device into the new supporting position or initiate no adjusting process or carry out a "neutral step" and maintain the current supporting position. The "neutral step" refers here to a process performed by the adjusting device that is similar to the adjusting process but does not result in any adjustment of the supporting position of the supporting device.

The following sequence is preferably obtained: actuation of the adjusting device—keeping an actuated state (with a measuring process being carried out)—discontinuation of the actuated state—initiation of the adjusting process. The transitions between the individual sequences involved here may also be smooth and the sequences may overlap.

In the measuring process, the determined longitudinal inclination of the ski is advantageously compared in the adjusting device with a current neutral position of the ski associated with the current supporting position. In order to establish whether the current climbing angle is to be adjusted, two pieces of information are preferably obtained: on the one hand a currently set climbing angle is analyzed, and on the other hand an actual longitudinal inclination of the ski. The current climbing angle is included, for example, via the current neutral position of the ski associated with the current supporting position. For this, the adjusting device, or in particular the measuring device, comprises a reference element, which represents the current neutral position of the ski, and a measuring element, which reproduces the actual inclination of the ski.

In the case of a mechanical solution, the reference element is represented for example by a displaceable adjusting element, which is respectively located in a current position associated with the current supporting position, i.e. in the neutral position. The neutral position may in this case be defined such that, in the case where the climbing angle of the current supporting position corresponds to the desired climbing angle, the adjusting element is aligned largely horizontally or largely vertically. The current neutral position of the ski corresponds in this case to a position of the ski in which adjustment of the supporting position is not required.

The measuring element may be formed for example as an inclination sensor, such as for example in the mechanical case as a gravity pendulum. The actual position of the ski is then included via the position of the gravity pendulum. By corresponding interaction of the gravity pendulum with the reference element, the actual longitudinal inclination of the ski can be compared with the current neutral position of the ski. On the basis of a predetermined criterion, it can consequently be decided whether, and if so in which direction, a current climbing angle is to be adapted. In a variant, a position of the boot can also be measured, which however is disadvantageous in terms of the structural design, since the measuring device would have to be formed on the boot or on a ski boot carrier, and is thereby exposed to great accelerations.

The adjusting device, and in particular the measuring device, is preferably formed in such a way that the adjusting process is only initiated when a predetermined deviation between the longitudinal inclination determined in the measuring process and the current neutral position of the ski is exceeded (hysteresis). The predetermined deviation forms a criterion here for the initiation of the adjusting process. In the case of a method according to the invention for adjusting a climbing aid, the adjusting process is therefore preferably only initiated if a current longitudinal inclination determined in the measuring process exceeds a predetermined deviation from a neutral position of the ski associated with the current supporting position of the supporting device. If the supporting device is in a supporting position with the desired climbing angle, a current neutral position corresponds for example to the horizontal position. If an inclination deviates from this neutral position, then, depending on the deviation, the adjusting process is initiated. Such a predetermined deviation may be reached here for example in the case of a mechanical implementation of the climbing aid by a series of grooves or notches spaced apart from one another, arranged in the manner of a washboard, in which a slide element, for example a pendulous mass, of the measuring device can engage, depending on the current alignment. Each notch has in this case a certain "catchment area", in which the slide element can engage in the notch even if the engagement does not take place exactly. An engagement of the slide element in a current notch may in this case correspond to a current supporting position of the supporting device. The relative position of the slide element with respect to the current notch in this case reproduces the deviation of the current inclination of the ski with respect to the neutral position. If the deviation is great enough, the slide element engages in an adjacent engagement, which can be evaluated by the adjusting device and, if appropriate, may result in the initiation of an adjusting process. In this case there may be provided, in particular, detent notches and adjusting notches (or else detent cams or adjusting cams), which in the case of an engagement of the slide element or the pendulous mass result in a neutral step (detent notches, detent cams) or an adjusting process (adjusting notches, adjusting cams). In other words, a spacing of the notches corresponds to the aforementioned predetermined deviation. In the case of an electrical solution, the deviation may be represented by a simple threshold value that has to be exceeded for example by the value of a difference between the inclination of the neutral position and the current inclination of the ski.

Altogether, the supporting device of the device according to the invention as a climbing aid is preferably formed and interacts with the adjusting device in such a way that, in the case where the longitudinal inclination determined in the measuring process is greater than the current neutral position, the new supporting position has an associated new climbing angle, which is greater than the current climbing angle associated with the current supporting position, and in the case where the longitudinal inclination determined is less than the current neutral position, the new climbing angle is smaller than the current climbing angle.

In principle, a current position of the boot can also be measured and compared with the current supporting position of the climbing aid in order to establish whether an adjusting process is to be carried out. For example, there are known climbing aids in the case of which it is measured when a horizontal position of the boot is reached, in order at this moment to prevent a supporting device from blocking and being lowered further. Such a measurement of the position of the boot must, however, take place during the movement of the boot in order to be able to block the supporting device at the desired point in time. Since the boot is in motion, however, such a measurement can only be carried out with comparatively low accuracy. On account of the movement, the corresponding measuring device is exposed to a large number of different accelerations, which falsify or mask the gravitational acceleration.

According to the invention, however, the adjusting device is formed in such a way that a measuring process of the measuring device only takes place when the ski is stationary. In particular, a time period during which the ski or the ski boot carrier has been lowered onto the supporting device is used for the measuring process. This is so because tests have shown that during this time period the ski is substantially at rest. In the measuring time period, a pendulous mass of the measuring device that is fixed the rest of the time may be released, for example. This achieves the effect that the pendulous mass does not feel the accelerations of the walking movements during a step, and a measuring process is consequently not disturbed by these accelerations. The fact that the pendulous mass is only released when the ski is already stationary means that the pendulous mass quickly settles into a position which corresponds to the actual direction of gravitational force. For this, the control device may for example be formed in such a way that it reacts to a lowering or stepping of the boot or the ski boot carrier, so that in the time period with the boot lowered, during which practical experience shows that the ski is always at rest, the measuring process is allowed or the measuring process takes place. If, moreover, the pendulous mass is fixed before the ski is brought into movement again, the current position of the pendulous mass can also be stored or "frozen".

The configuration according to the invention of the actuable adjusting device allows a measuring process for determining a position of the ski to be restricted to a time period during which the ski is at rest in a natural way by the walking movement during climbing. A control device of the adjusting device with which the measuring process of the measuring device can be restricted to a window of time is provided in particular. The fact that the climbing aid actuates the supporting device when the boot is being lowered, can keep it in an actuated state when the boot is lowered and can discontinue the actuated state when the boot is lifted off means that the control device can restrict the measuring process to a window of time between lowering the boot and lifting it off.

In particular, the measuring device is in this case advantageously formed in such a way that the measuring process in the measuring device is initiated by actuation of the adjusting device, i.e. the measuring device can be triggered by the actuation of the adjusting device. In a further preferred embodiment, the measuring device interacts with the adjusting device in such a way that the measuring process in the measuring device is ended when the adjusting process is initiated. Consequently, in this case there is a functional coupling of the measuring device with an actuating element of the adjusting device. In the case of such a form of the measuring device, the measuring process for adjusting the climbing aid is preferably carried out after actuation of the climbing aid and before initiation of the adjusting process.

In order to ensure a secure position of the supporting device in the various supporting positions, the climbing aid preferably has a catch device for engaging the supporting device in the supporting positions, which catch device disengages the supporting device from the current supporting position when the adjusting device is actuated and engages the supporting device in the new supporting position at the end of the adjusting process. This achieves the effect that, for example during the actuated state of the adjusting device, the supporting device is disengaged and can, if appropriate, be adjusted by the adjusting device in the adjusting process. A catch device which only disengages the adjusting device when the adjusting process is initiated is also conceivable. Such a catch device is described for example, as a spring catch in EP 0 724 899 B1 (Fritschi). The spring catch may in this case be formed largely independently of the adjusting device (passively) and brings about the engagement by an adjusting force having to overcome a threshold value to adjust the supporting position.

When the new supporting position is reached, the spring catch automatically engages. A further preferred configuration of the catch device is functionally coupled with the adjusting device in such a way that the engagement of the current supporting position is (actively) initiated when the adjusting device is actuated and the new position is engaged after an adjusting process is carried out, or, if the actuated state is discontinued, the current supporting position is re-engaged. When actuation occurs for example by the lowered ski boot carrier or ski boot, the supporting device is in this case fixed by the ski boot carrier, for which reason an additional engagement by the catch device is not required in the actuated state.

In a further preferred embodiment, the supporting device has a lever that can be pivoted with respect to the ski into various pivoting positions, is preferably formed in one piece and the pivoting positions of the lever correspond to the various supporting positions of the supporting device. In particular, the lever may in this case be formed as a supporting lever, similar to conventional supporting levers with a climbing aid function, as described for example in EP 0 724 899 B1 (Fritschi). Detailed descriptions of an actual configuration of the heel lever with a number of supports can be taken from this document. Particularly advantageous here is a configuration with more than two support surfaces on a supporting lever that can be pivoted with respect to the ski. The various support elements can be pivoted into the path of movement of the boot or of the ski boot carrier. Depending on requirements, in particular depending on the desired discontinuation of a climbing angle, any desired number of support elements greater than 2 may be provided on the supporting lever, and in particular for example 4 to 6. In this case, the supporting lever is formed in such a way that it can be brought into a locking position, in which it locks the boot or the ski boot carrier in a downhill skiing position. In particular, the cited document discloses instructions as to how the supporting lever can be formed at the same time as a locking lever, with which for example the ski boot carrier or the boot can be locked in a downhill skiing position.

In a preferred embodiment of the invention, the measuring device comprises an element that is sensitive to gravitational force, which comprises in particular a pendulous mass pivotably mounted transversely to the longitudinal axis of the ski. The mounting achieves the effect that the pendulous mass is only sensitive to an inclination of the ski in the longitudinal direction. The pendulous mass is in this case preferably provided on the measuring device in such a way that, in a released state, it can assume various positions with respect to other components of the adjusting device, depending on the inclination of the ski. A released state means here a state in which the pendulous mass can pivot largely freely about the mounting axis. If a control device is provided, the pendulous mass may for example be fixed by it, so that no measuring process can take place. The control device may, however, also displace mounting of the pendulous mass in such a way that engagement by the pendulous mass is no longer possible in any adjusting notches or adjusting cams there may be. This may be desired, for example, in the course of carrying out the climbing movement, in order that the measuring process can only take place in a certain window of time. The control device may, however, also be formed in such a way that fixing can be performed by the skier. The pendulous mass may, however, also be simply pivoted out in such a way that the position of the pendulum can no longer be read. By fixing or pivoting out the pendulous mass in a fixed position, it is possible for example to achieve the effect that the adjusting device no longer adjusts the corresponding climbing angle even when the predetermined deviation from the neutral position of the ski is exceeded. With the pendulous mass fixed, the measuring device can no longer determine the actual longitudinal inclination of the ski, and the adjusting device does not adjust the supporting device on account of the fixed position of the pendulous mass in interaction with the neutral position. Fixing or pivoting out consequently offers a simple possible way in which the skier can override the adjusting device, so that a current supporting position with an associated current climbing angle cannot be changed by the adjusting device. In particular, the adjusting device is preferably generally designed in such a way that disabling or fixing of the adjusting device by the skier is possible at any time. With the adjusting device disabled, the climbing aid then preferably behaves like a conventional climbing aid, as known for example from EP 0 742 899 B1 (Fritschi). In this case, with the adjusting device blocked, the climbing aid must or can be directly operated by a skier in a known way, manually or with a ski stick. Blocking of the adjusting device is in this case conceivable in many other ways, such as for example by an additional locking mechanism that can be operated by the skier, with which for example the supporting device can be directly blocked. The locking mechanism may, however, also block other parts of the adjusting device, such as for example the pendulous mass (see further above) and/or else an adjusting element or a joint arm.

In order to make actuation of the adjusting device as easy as possible, the adjusting device preferably has a rocker with two arms arranged largely diametrically with respect to a rocking joint, the adjusting device being actuable by means of a first arm and the pendulous mass of the measuring device being pivotably mounted on the second arm. In particular, the supporting device is provided on the first arm in such a way that, when loading is applied by the boot or by the ski boot carrier, the rocker performs a rotation about the rocking joint. In order to ensure resetting of the rocker when it is relieved of the loading, a spring mechanism is preferably provided, subjecting the rocker to a spring force in such a way that the rocker counteracts loading by the boot or the skier. It is also possible, however, to provide a simple pivot arm, which is for example resiliently mounted on a base part of the ski and is deflected against the spring force when loading is applied to the supporting lever. Such spring mounting of the supporting lever thereby performs an additional ergonomic function. This is so because the resilient mounting of the supporting lever has the bonus effect of creating a damping device, which on the one hand dampens the impact when the boot is lowered onto the supporting lever or the supporting device and on the other hand reduces any noise produced when the boot or the ski boot carrier is placed onto the supporting lever.

When the adjusting device with a rocker is actuated, the pendulous mass mounted on the second arm is for example set into a position in the actuated state from a rest position. This can achieve the effect in particular of releasing the pendulous mass, by for example the pendulous mass being lowered on an underlying surface, and consequently fixed, when it is in the rest position and the pendulous mass being lifted off the underlying surface, and consequently released, when it is actuated, on account of the rocking movement. The rocker consequently also forms part of the aforementioned control device of the measuring device, in that fixing or release of the pendulous mass can be achieved. The aforementioned locking mechanism for locking the adjusting device or for disabling the adjusting device may be formed here in such a way that the rocker can be blocked or fixed by the locking mechanism, so that actuation of the adjusting device is prevented by means of the rocker, for example by means of the supporting device attached to it. For this purpose it is possible, for example, to provide a button that can be actuated more easily by the skier, blocks the rocker when it is actuated and releases the rocker again when it is actuated again. The locking mechanism may, however, also be mounted on a base part as a simple lock, which for blocking can be moved into a clearance, for example on the rocker or on the supporting device, and moved out again manually by the skier.

In a preferred embodiment, the underlying surface on which the pendulous mass can be lowered in the rest position may be formed on an adjusting element of the adjusting device. For this purpose, the adjusting device of the climbing aid preferably comprises an adjusting element that is guided displaceably in an arcuate guide, is coupled to the supporting device via a joint arm and the current position of which corresponds to the current neutral position of the ski. The adjusting element consequently also corresponds to the reference element of the adjusting device.

In particular, the arcuate guide is in this case formed in such a way that a plane of the arcuate guide in the longitudinal direction of the ski stands perpendicularly to the latter. This allows the adjusting element to be formed like a small boat and to be displaced forward and rearward with respect to the ski in the arcuate guide. The arcuate guide is in this case preferably formed in such a way that the adjusting element is guided in the arcuate guide in such a way that, when there is a rearward or forward displacement, there is a change in alignment of the adjusting element with respect to a longitudinal direction of the ski. In particular, when there is a forward displacement, the position of the adjusting element approaches a position parallel to the ski, whereas a rearward displacement produces a greater deviation from a position parallel to the ski. The adjusting device is in this case formed in such a way that, in the case where no adjusting process is initiated upon actuation of the adjusting device, a current position of the adjusting element is largely perpendicular to a current position of the gravitational force. A possibly provided and released pendulous mass of the measuring device in this case settles largely perpendicularly to the alignment of the adjusting element.

On account of the coupling with the supporting device via the joint arm, the current position of the adjusting element is coupled with the supporting device. This is preferably a forced coupling, so that an adjustment of the supporting device, for example by manipulation by the skier, results in a displacement of the adjusting element, and vice versa. The adjusting element may, for example, be lockable to block the adjusting device.

In particular, the adjusting device is preferably formed in such a way that, after initiation of an adjusting process, the adjusting element is displaced in the arcuate guide from a current position into a new position and thereby changes a current supporting position of the supporting device into a new supporting position by means of the joint arm. In a particularly preferred embodiment, this takes place by means of an engagement of the pendulous mass in corresponding notches on the adjusting element. Depending on the relative position of the pendulous mass with respect to the adjusting element, an engagement takes place in a corresponding notch of the adjusting element, for example when the pendulous mass is lowered onto the adjusting element by the rocker possibly provided. If a position of the pendulous mass deviates from a perpendicular to the adjusting element beyond a certain predetermined value, the pendulous mass comes into engagement with a notch, which results in a displacement of the adjusting element when the pendulous mass is lowered onto the adjusting element.

The invention preferably comprises a device in which the active connection of the adjusting device to the supporting device takes place by means of an adjusting element which can be coupled to the supporting device. The adjusting device also has a bearing for the mounting of a gravity element and, in the actuated state, the adjusting device is in a measuring position, in which a gravity element mounted on the bearing is released in such a way that it can assume different adjusting positions in the longitudinal direction, respectively assigned to one of the least two supporting positions, in dependence on a current direction of gravitational force. The adjusting device also has a switching position, in which the gravity element is blocked in one of the adjusting positions by the adjusting element.

The "measuring position" and "switching position" refer in this case to two mechanically distinguishable states of the adjusting device. In other words, in the two positions the adjusting device has a different configuration or arrangement of associated elements. In particular, the measuring position concerns a state of the adjusting device in which the gravity element is released in its bearing and a measurement of the current direction of gravitational force can take place. In particular, in the actuated state the adjusting device is in the measuring position.

The switching position corresponds to a state of the adjusting device which is assumed for example after an adjusting process is carried out. The adjusting device is also in the switching position when no actuation takes place and no external forces are acting on the adjusting device or on other elements of the climbing aid. In particular, the switching position consequently also corresponds to a "state of rest" of the climbing aid, in which the ski boot carrier or the ski boot is lifted off from the climbing aid, so that there is no loading of the supporting device.

According to the present embodiment of the invention, the gravity element released in the measuring position can assume one of the adjusting positions. In the switching device, the gravity element is blocked in the current adjusting position. Consequently, the gravity element has a defined position in every state of the adjusting device. In particular, the gravity element does not change its position when the adjusting device goes over from the measuring position into the switching position and, for example, an adjusting process thereby takes place. In the case of the solutions described above with a gravity pendulum, in the release position (measuring position) the gravity pendulum assumes an adjusting position and changes its position when an adjusting process is carried out. While this variant may be preferred for the corresponding embodiments, the present embodiment offers the advantage that the gravity element will maintain the adjusting position assumed in the measuring position at each point in time during the transition from the measuring position into the switching position.

The gravity element is preferably blocked in the switching position by the adjusting element. This ensures in a simple way that the gravity element can interact with the adjusting element to carry out an adjusting process and is therefore blocked without any change in the adjusting position taking place. An interaction of the gravity element with the adjusting element and the blocking of the gravity element can consequently be achieved in a simple way on the basis of the well-defined adjusting positions.

The bearing of the gravity element is advantageously formed on a carrier element, the base part being provided with a displacing guide, on which the carrier element is mounted displaceably on the base part in a direction that is largely perpendicular to the ski.

The displacing guide is preferably formed in such a way that the carrier element is displaced in parallel in a defined position. On account of the displacing guide, it can be ensured that, during the displacement in a direction perpendicular to the ski, in particular also the measuring position and the switching position, the carrier element can maintain a constant inclination with respect to the base part fixed to the ski, and consequently with respect to the ski. A carrier element consequently forms a constant reference for the position of the ski in every displaced position. The measurement of a current direction of gravitational force achieved by the element assuming various adjusting positions in the longitudinal guide is consequently reliable and consistent, independently of the current displaced position of the carrier element in the displacing guide.

Particularly preferred is a configuration of the device according to the invention in which, in the measuring position of the adjusting device, the carrier element is lowered together with the gravity element toward the ski, in comparison with the switching position, in the displacing guide.

In order to ensure convenient manipulation of a climbing aid according to the invention, it is advantageous if actuation of the adjusting device can take place largely from above, whether for example with a ski stick or with a ski boot. Since the skier is typically above the ski, he can in this case use his weight, for example to press a button with the ski stick or to actuate an actuating element directly with the ski boot. Any other actuating direction would require that the skier must assume a position that does not correspond to the natural posture during skiing or climbing, and consequently requires as an additional effort on the part of the skier (for example kneeling down, bending forward, leaning back, etc.). The actuating direction from above consequently represents a convenient "natural" actuating direction.

The present embodiment allows the natural "actuating direction" to be used directly for releasing the gravity element, that is by the fact that, in the measuring position, the carrier element is lowered toward the ski in comparison with the switching position. Consequently, the construction of the adjusting device can be further simplified, since no transmissions, for example rocking joints or lever arms, are required to convert the actuating direction from above into an upward lifting-off movement of the gravity element away from the ski. The carrier element on which the gravity element for measuring the longitudinal inclination of the ski is mounted can consequently be coupled directly to an actuating element of the adjusting device in a simple way, without deflection or transmission. If the actuating element is actuated from above in the "natural" actuating direction, the gravity element is at the same time released and can align itself to the current direction of gravitational force.

The adjusting element is preferably arranged in such a way that, in the measuring position, the carrier element can also be lowered toward the ski with respect to the adjusting element. In particular, the carrier element is in this case arranged under the adjusting element, i.e. between the surface of the ski and the adjusting element. This is a simple way of achieving the effect that, in the measuring position, the carrier element (and consequently also the gravity element) is lowered downward from the adjusting element and, when the carrier element is reset in the displacing guide, i.e. when there is a transition from the measuring position into the switching position, the gravity element mounted on the carrier element is brought up to the adjusting element. With such an arrangement it is ensured in a simple and direct way that the gravity element can interact, for example to carry out an adjusting process, or be blocked in the switching position by the adjusting element.

In particular, the carrier element may be advantageously arranged under an actuating element of the adjusting device, i.e. for example between the actuating element and the surface of the ski. The actuating element must in any case have a certain actuating path in the actuating direction. When it is coupled directly with the actuating element, the carrier element uses the same path, whereby an overall height in the region of the actuating element is increased merely by the overall height of the carrier element with the gravity element mounted on it. It is for example conceivable to form the carrier element directly on the actuating element or to form the carrier element as an actuating element, in order to further simplify the structural design of the adjusting device.

In the case where the climbing aid can be actuated for example by means of a supporting lever of the supporting device, one effect of arranging the carrier element under the supporting lever is a small overall length of the climbing aid as a whole. Another effect is that the overall height is increased little, if at all, since conventional climbing aids with a supporting lever and without an adjusting device under the supporting lever are made in such a way that free spaces in any case remain, and these can consequently be efficiently used.

The fact that the carrier element acts from down to up during the transition from the measuring position into the switching position, for example when an adjusting process is carried out, means that the gravity element is advantageously formed in such a way that the upward resetting force can be directly used. It is in this case particularly advantageous if the gravity element is a rolling body. The rolling body may in this case be formed as a roller, or advantageously as a ball. In principle, the gravity element may, however, also be a counterbalanced pendulum (mass and pendulum arm on opposite sides of the pendulum mounting) or else a slidingly displaceable body of mass. Also conceivable are carriages on rollers or slides, which are able to roll or be slidingly displaced in the longitudinal direction of the ski. A gravity pendulum (mass and pendulum arm on the same side of the pendulum mounting) is generally not suitable for using a force acting from down to up.

Preferred in this case is an embodiment in which the bearing in the carrier element is configured as a longitudinal guide in the longitudinal direction of the ski, in which the gravity element is mounted such that, in the measuring position, it is guided freely movably in the longitudinal direction of the ski.

The adjusting positions correspond in this case to different longitudinal positions in the longitudinal guide.

The longitudinal guide arranged in the longitudinal direction of the ski consequently allows a freedom of movement of the gravity element in the longitudinal direction of the ski within the confines of the guide. In the direction perpendicular thereto, the gravity element is supported on the guide, whereby a force can be exerted in this direction.

In a further preferred embodiment, an elastic element may therefore be provided, subjecting the carrier element to a resetting force away from the ski in the displacing guide.

The fact that the carrier element is lowered counter to a resetting force when it is actuated means that the resetting force can be used to initiate the adjusting process. As a result of the lowering movement of the carrier element, the resetting force acts in an upward direction, away from the ski. Consequently, when the actuating element, such as for example the supporting lever, is relieved of loading, the carrier element is raised together with the gravity element from down to up on account of the resetting force. In particular, the carrier element can be raised together with the gravity element toward the adjusting element, whereby the gravity element can interact with the adjusting element in its current adjusting position on account of the resetting force. If the adjusting device is in the switching position, the gravity element is preferably blocked in the current adjusting position by the adjusting element, the resetting force being able to press the gravity element against the adjusting element, which is consequently blocked. The elastic element may in this case be produced for example from rubber or comprise a spring, in particular a helical spring.

In a variant, a force which has to be applied for example when the ski boot is lifted off the climbing aid may be used by the user for resetting the adjusting device from the measuring position into the switching position. In this case it is conceivable that there is a coupling device, which detachably couples the ski boot carrier to the supporting device during lowering, so that a lifting-off force acts upward on the supporting device during the lifting-off of the ski boot carrier. The coupling could be detached again for example when a force threshold value is exceeded. The lifting-off force on the supporting device can in this case be used as a resetting force. However, additional expenditure of force by the skier should generally be avoided, in order not to make the in any case arduous climbing any more difficult.

The adjusting element is in this case advantageously mounted on the base part rotatably about a transverse pin with respect to the longitudinal direction of the ski. For this purpose, the adjusting element preferably has switching surfaces which are assigned to the adjusting positions of the gravity element and with which the gravity element can interact during raising in the respective adjusting position. On account of the resetting force which subjects the gravity element to an upward force away from the ski via the carrier element, the gravity element can consequently initiate a rotation of the adjusting element via the switching surfaces.

The rear adjusting position of the gravity element is preferably arranged behind an axis of rotation of the adjusting element in the longitudinal direction of the ski and the front adjusting position is preferably arranged in front of the axis of rotation, in order to make a rotation of the adjusting element back and forth between at least two positions possible in a simple way.

The fact that the resetting force acts from down to up on the carrier element and the gravity element mounted on it means that, in the rear adjusting position, the adjusting element is subjected to a moment which can be exerted via the gravity element and brings about a forward rotation of an upper side of the adjusting element. If the gravity element is in the front adjusting position, the gravity element can exert a rearward turning moment on the adjusting element.

In the case of a configuration with a supporting lever pivotably mounted on the base part, the various supporting positions correspond to different pivoting positions of the supporting lever. In particular, pivoting positions with a greater pivoting angle, i.e. a supporting lever pivoted further forward, usually correspond to supporting positions with greater climbing angles. When adjusting to greater climbing angles, the supporting lever should therefore be pivoted forward and, when adjusting to smaller climbing angles, it should be pivoted rearward.

The tilting moments on the upper side of the adjusting element that result according to the present embodiment with a rotatable adjusting element consequently correspond directly to the desired adjusting directions of the supporting lever, and can therefore be used directly and without transmission or deflection.

Advantageously provided for easy actuation of the adjusting device is a displacing guide, in which the supporting device is mounted displaceably on the base part in a direction that is largely perpendicular to the ski, the supporting device being forcibly coupled with the carrier element with respect to the displacement perpendicular to the ski.

When loading is applied, for example by the weight of the skier, the supporting device is lowered together with the carrier element forcibly coupled to it, and consequently allows easy actuation of the climbing aid. The fact that the carrier element is coupled to the supporting device in the sense of a forced coupling means that the lowering of the supporting device together with the carrier element achieves the release of the gravity element described above in a direct and simple way, i.e. the adjusting device is brought into the measuring position. The supporting device is in this case preferably formed as a supporting lever pivotably mounted on the base part. In particular, automation of the setting of the climbing aid in the least two supporting positions can consequently be achieved. With each climbing step, the supporting device is in any case loaded with the weight of the skier. The actuation of the climbing aid accompanying this in each case brings the adjusting device into the measuring position, in which the gravity element can align itself according to a current direction of gravitational force and assume an adjusting position (measuring process). During the following lifting-off of the ski boot or the ski boot carrier, the supporting device is relieved of loading and the adjusting device goes over from the measuring position into the switching position, for example on account of the resetting force, and, if appropriate, thereby initiates an adjusting process. It is consequently ensured with every climbing step that the adjusting device is actuated and brought into the measuring position and, if appropriate, an adjusting process which adjusts the supporting device into the assigned supporting position according to the current adjusting position of the gravity element is initiated.

In a variant of the embodiments described above, a displacing guide may also be provided for the adjusting element, on which guide the adjusting element is mounted displaceably on the base part in a direction that is largely perpendicular to the ski. In this case, the bearing of the gravity element is preferably formed on the base part as a longitudinal guide in which the gravity element is mounted such that is guided in the longitudinal direction of the ski. In this case, the longitudinal element of the gravity element cannot be lowered toward the ski. In a reversal of the kinematics of the embodiment described above, in the measuring position the adjusting element is in this case lowered toward the ski, with respect to the gravity element, in the displacing guide. In the switching position, the adjusting element is raised toward the gravity element (for example on account of a resetting force on the adjusting element) and blocks the gravity element in one of the adjusting positions in the longitudinal guide. An elastic element is preferably provided, subjecting the adjusting element in this case to a resetting force away from the ski.

In this case too, the natural actuating direction of the adjusting device can be used for releasing the gravity element, by the adjusting element, which preferably blocks the gravity element in the switching position, being lowered from the gravity element and the adjusting device consequently being brought into the measuring position. The adjusting element is then for example rotatable about a transverse pin, in addition to the displaceability in the displacing guide. This produces a rotation of the adjusting element via switching surfaces of the adjusting element on account of the resetting force, which presses the adjusting element against the gravity element. However, the tilting moments on an upper side of the adjusting element are in this case opposed to the desired tilting moments: if the gravity element is in the rear adjusting position, a rearward tilting moment is obtained on the upper side of the adjusting element, and vice versa. In this case, a deflection is therefore required, in order for example to be able to tilt a supporting lever in the desired direction.

In order to establish an active connection of the adjusting device to the supporting device, a coupling device is preferably provided, by means of which the adjusting device can be functionally coupled to the supporting device to establish the active connection.

The coupling device may in this case be undetachably formed, so that the adjusting device is coupled to the supporting device, for example by the adjusting element, in every supporting position of the supporting device.

Preferably, however, the supporting device has at least one further supporting position, in which the adjusting device is functionally decoupled from the supporting device. In this case, the coupling device is detachably formed and allows purely manually operable supporting positions to be combined with the at least two supporting positions which can be adjusted by the adjusting device.

This is based on the recognition that, when climbing, it is generally unlikely that very steep terrain will alternate in quick succession with moderately sloping or slightly sloping sections. It is more likely that the usual situation will comprise a succession of sections of terrain with different moderately sloping terrain. To make climbing more comfortable, it is therefore often adequate to provide an easily operable adjusting device only for supporting positions with climbing angles that are used in areas of moderately sloping terrain.

A highest supporting position, which is provided for very steep terrain, and a lowest supporting position for very flat terrain can be set by the skier purely manually or with a ski stick, without making any major sacrifices in the operating convenience such as that in the case of known climbing aids, for example according to the initially mentioned EP 0 724 899 B1 (Fritschi). The situation is similar with a release position and a locking position, in which the ski boot carrier or the ski boot is released and locked, respectively. These must in any case be set by the skier during preparation for climbing or downhill skiing, and so no special operating convenience is required.

Good operating convenience of the climbing aid is consequently already achieved if supporting positions with a lowest and a highest climbing stage can only be manually operated, i.e. the adjusting device is functionally decoupled from the supporting device in the supporting position. In at least two further supporting positions, lying in between with respect to the assigned climbing angles, the adjusting device is functionally coupled with the supporting position, and so the at least two supporting positions can be adjusted by the adjusting device in a convenient way. This is accompanied by the advantage that the adjusting device can be formed in a comparatively simple manner, since it only needs to adjust the supporting device between the at least two supporting positions.

If the climbing aid can be actuated by means of the supporting device, for example a supporting lever, in the way described above, an automatic setting of the climbing aid can consequently take place when climbing steps are performed in areas of moderately sloping terrain. In order to set a minimum or maximum climbing angle, the supporting device must be manually brought into the respective supporting position, the coupling device being uncoupled and no functional coupling existing any longer between the adjusting device and the supporting device.

It goes without saying that this aspect of the invention may be provided in the case of all the embodiments of the invention to simplify the structural design of the adjusting device.

Further advantageous embodiments and combinations of features of the invention emerge from the following detailed description and the patent claims as a whole.

BRIEF DESCRIPTION OF THE DRAWINGS

The drawings used to explain the exemplary embodiment schematically show.

In principle, the same parts are provided with the same designations in the figures.

WAYS OF IMPLEMENTING THE INVENTION

Figure 1A:
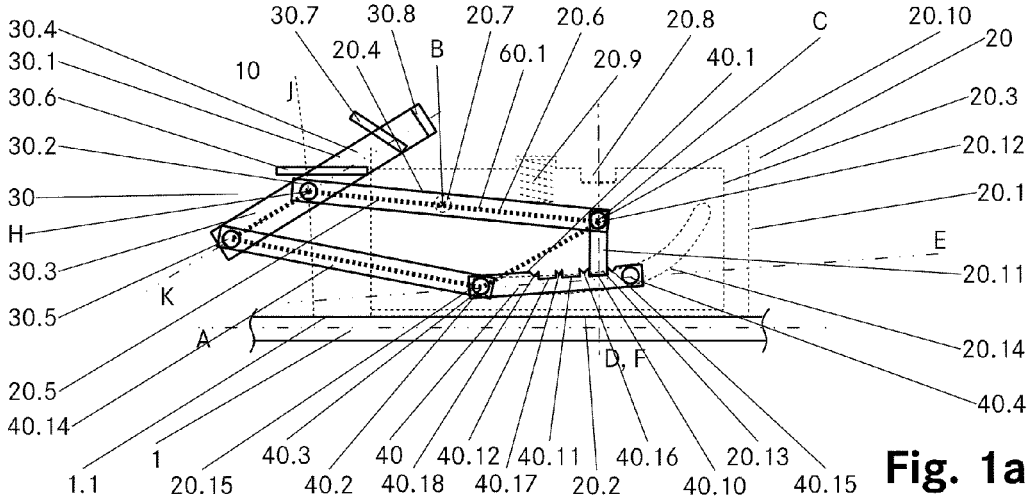
FIGS. 1*a-h* the functional principle of a device according to the invention for use as a climbing aid with a mechanical adjusting device in 8 different states.

FIGS. 1*a-h* show a mechanical climbing aid 10 according to the invention comprising an adjusting device 20 and a supporting device 30 coupled to it in schematic cross-sectional views of various states of the climbing aid 10. FIG. 1*a* shows the climbing aid 10, the supporting device 30 being engaged in a first supporting position. To provide a better overview, a catch device for engaging the individual supporting positions is not represented in FIGS. 1*a-h*.

The climbing aid 10 is, for example, in this case mounted on a ski 1. In the representation of FIGS. 1*a-h*, the adjusting device 20 has a base part 20.1, which is rectangular in side view and is mounted on the ski 1. A long edge 20.2 of the rectangular base part 20.1 on the ski side is in this case arranged parallel to a surface 1.1 of the ski 1.

The base part 20.1 comprises an inner space 20.3, which is open in the direction of the supporting device 30 and in which a mechanism of the adjusting device 20 is accommodated. In particular, various parts of the adjusting device 20 are mounted or guided on the base part 20.1. Hereafter, a forward direction refers to a direction in the longitudinal direction A of the ski 1 that lies in the direction of the supporting device 30 with respect to the base part 20.1. Correspondingly, a rearward direction refers to a direction away from the supporting device 30.

Arranged in the inner space 20.3 is a two-armed rocker 20.4 with arms 20.5 and 20.6 of substantially the same length, which is rotatably mounted on the base part 20.1 by means of a rocking joint 20.7. In modifications, the rocker arms 20.5 and 20.6 may also have different lengths here. An axis B of the rocking joint is in this case aligned transversely to a longitudinal direction of the ski A and parallel to a surface of the ski 1.1, while the two arms 20.5 and 20.6 of the rocker 20.4 are arranged in the longitudinal direction of the ski A and largely parallel to the surface of the ski 1.1. The front arm 20.5 in this case protrudes out of the open inner space 20.3 of the base part 20.1. Also formed in the inner space 20.3 of the base part 20.1 is a stop 20.8, which limits a tilting movement of the rocker 20.4. In particular, the stop 20.8 is formed in such a way above the rear arm 20.6 of the rocker 20.4 that lowering of the front arm 20.5 toward the ski is limited. Furthermore, the rocker 20.4 is supported on the base part 20.1 by means of a compression spring 20.9 in such a way that the rear arm 20.6 of the rocker 20.4 is pressed toward the ski 1 by the spring force of the spring 20.9. The compression spring 20.9 consequently subjects the rocker 20.4 to a turning moment with respect to the axis B, which counteracts loading of the front arm 20.5 of the rocker 20.4. The spring 20.9 is in this case arranged in a receiving space in the inner space 20.3 of the base part 20.1 in such a way that the spring 20.9 can be partially or entirely received in the receiving space. It is also possible, though not represented in FIG. 1*a*, to provide a setting device for the spring 20.9, which for example allows setting of the spring force from outside the base part 20.1. Conceivable in this case for example is an externally accessible adjusting screw, with which a prestressing of the spring 20.9 can be set.

In the representation of FIG. 1*a*, the rear arm 20.6 has been lowered away from the stop 20.8 toward the ski 1. When loading is applied to the front arm 20.5 in the direction of the ski 1, the front arm 20.5 can be lowered toward the ski 1 counter to the spring force, whereby the rocker 20.4 can perform a rocking movement until the rear arm 20.6 butts against the stop 20.8. At the rear longitudinal end of the rear arm 20.6, an elongate pendulous mass 20.11 is pivotably mounted on a longitudinal end 20.12 remote from the ski by means of a joint 20.10. A pivot axis C of the joint 20.10 in this case lies transversely to a longitudinal direction A of the ski 1 and is arranged parallel to the surface of the ski 1.1.

In the representation of FIG. 1*a*, a longitudinal direction F of the pendulous mass 20.11 is aligned in the direction D of the effect of a current gravitational force and the pendulous mass 20.11 has been lowered onto a surface 40.1 of an elongate adjusting element 40 on account of the force of the spring 20.9. A longitudinal direction E of the adjusting element 40 is in this case arranged in a plane G, which comprises the longitudinal direction A and stands perpendicularly on the surface of the ski 1.1. In FIG. 1*a*, the adjusting element 40 is arranged between the ski 1 and the pendulum bearing 20.10.

The adjusting element 40 is displaceably guided on the base part 20.1, substantially in the longitudinal direction of the ski 1. Formed for this purpose on the base element 20.1 are guide grooves 20.14, which in a front region of the length run largely parallel to the surface of the ski 1.1 and in a rear region of the length are curved away from the ski 1. The adjusting element 40 is in this case guided by means of guide pins 40.3 and 40.4 formed at its longitudinal ends in the guide grooves 20.14 of the base part 20.1 in such a way that, as a result of a longitudinal displacement of the adjusting element 40 with respect to the base part 20.1, a longitudinal inclination of the adjusting element 40 with respect to the ski 1 changes. In the representation of FIG. 1*a*, the adjusting element 40 is in a frontmost position, in which a front guide pin 40.3 butts against a front end stop 20.15 of the guide grooves 20.14. The adjusting element 40 is in this case in a position largely parallel to the ski 1, i.e. the longitudinal directions A and E are largely parallel. In particular, the longitudinal direction E of the adjusting element 40 consequently reflects a neutral position of the ski 1 which is associated with the current, first supporting position and with respect to which the direction of gravitational force D stands largely perpendicularly in the current state of the adjusting device 20. The adjusting element 40 consequently forms a reference element of the adjusting device 20 that reproduces the current neutral position of the ski 1.

In this case, the adjusting element 40 has on the upper side 40.1, facing the pendulous mass 20.11, three detent notches 40.10 to 40.12, which are arranged transversely to the longitudinal direction E of the adjusting element 40 and spaced apart from one another in the longitudinal direction E thereof. The detent notches 40.10 to 40.12 are in this case formed in such a way that a longitudinal end 20.13, facing the ski 1, of the pendulous mass 20.11 can be engaged in the detent notches 40.10 to 40.12. In addition to the detent notches 40.10 to 40.12, formed on the surface 40.1 are adjusting notches 40.15 to 40.18, in which the longitudinal end of 20.13 of the pendulous mass 20.11 can temporarily engage, if appropriate, in order to displace the adjusting element 40 in the guide 20.14. The adjusting notch 40.18 is in this case arranged in front of the frontmost detent notch 40.12, while the adjusting notches 40.16 and 40.17 are arranged between the detent notches 40.11 and 40.10 and, respectively, 40.12 and 40.11. The rearmost adjusting notch 40.15 is formed behind the rearmost detent notch 40.10.

Generally, the number of detent notches corresponds to the number of support surfaces on the supporting lever, while the number of adjusting notches exceeds the number of detent notches by one. If, for example, the supporting lever comprises five support surfaces, there are five detent notches in which the pendulous mass can respectively engage when the current inclination of the ski corresponds to the current neutral position within the limits of the predetermined deviation (hysteresis). In this case, 6 adjusting notches should be provided, a frontmost adjusting notch being arranged in front of the frontmost detent notch and an adjusting notch being arranged behind each detent notch. The frontmost adjusting notch then allows adjustment of the supporting lever from a supporting position corresponding to the frontmost detent notch, while the rearmost adjusting notch allows adjustment from a supporting position corresponding to the rearmost detent notch. If $N_R$ designates the number of detent notches and Ns designates the number of adjusting notches, then $N_S=N_R+1$, where $N_R=N_A$ and $N_A$ designates the number of support surfaces.

The free longitudinal end 20.13 of the pendulous mass 20.11 may be engaged in the detent notches 40.10 to 40.12 in such a way that, when the pendulous mass 20.11 is engaged, a longitudinal displacement of the adjusting element 40 is no longer possible. In the state of the adjusting device 20 that is represented in FIG. 1*a*, the free longitudinal end 20.13 of the pendulous mass 20.11 is engaged in the rearmost detent notch 40.10. This produces an arrangement in which, in particular, the current direction of gravitational force D and the longitudinal direction F of the pendulous mass 20.11 are arranged largely perpendicularly to the longitudinal direction E of the adjusting element 40.

In the region of the front guide pin 40.3, the adjusting element 40 is connected via a joint 40.2 to a joint arm 40.14, which protrudes forward out of the open inner space 20.3. The joint arm 40.14 is in this case aligned largely parallel to the arms 20.5 and 20.6 of the rocker 20.4.

At the front longitudinal end of the front arm 20.5, a supporting lever 30.1 of the supporting device 30 is pivotably connected to the rocker 20.4 about a pivot axis H via a joint 30.2. The supporting lever 30.1 is in this case mounted on the rocker 20.4 in such a way that it has with respect to the joint 30.2 a lower portion 30.3, near the ski, and an upper portion 30.4, remote from the ski. In the portion 30.3 near the ski, the supporting lever 30.1 is connected to a front end region of the joint arm 40.14 via a joint 30.5. In the upper portion, the supporting lever 30.1 has three support elements 30.6 to 30.8 for a ski boot or for a ski boot carrier (boot or carrier are not represented). The support elements 30.6 to 30.8 are in this case formed as support surfaces on the supporting lever 30.1 at an increasing distance from the pivot axis H, so that, depending on the pivoting position, the corresponding support elements 30.6 to 30.8 support the boot at a certain distance from the surface of the ski 1.1. The support elements 30.6 to 30.8 may, however, also be differently formed, such as for example as cross braces or ties or as other suitable elements for supporting the boot or ski boot carrier. In particular, by pivoting the supporting lever 30.1 about the joint axis H, the individual support elements 30.6 to 30.8 are pivoted into a path of movement J of a heel region of the boot or of the ski boot carrier. The particular one of the support elements 30.6 to 30.8 that is acting in a pivoting position or supporting position is formed in this case by that support element that is arranged largely perpendicularly above the pivot axis H with respect to the ski 1. In the supporting position of FIG. 1*a*, this is the lowermost support element 30.6, nearest the joint. The associated first supporting position of the supporting lever 30.1 is in this case chosen such that the support elements 30.7 and 30.8 further away from the pivot axis H are pivoted rearward, so that the heel region of the boot or of the ski boot carrier can be lowered onto the support element 30.6 without coming into contact with the further support elements 30.7 to 30.8. This is the case in particular when a longitudinal axis K of the supporting element above the pivot axis H is inclined correspondingly far rearward.

As already mentioned above, the catch device mentioned at the beginning and not represented may be formed in the known way, according to the spring catch of EP 0 724 899 B1 (Fritschi A G), for example in the region of the joint 30.2 between the rocker 20.4 and the supporting lever 30.1. The supporting lever 30.1 can then be engaged by the spring catch in its various supporting positions with respect to the rocker 20.4. In this case, during an adjusting process, the adjusting device 20 overcomes the force of the spring catch and brings the supporting lever 30.1 from the current supporting position into a new supporting position, in which the supporting lever 30.1 is automatically engaged again with respect to the rocker 20.4 by the spring catch.

Figure 1B:
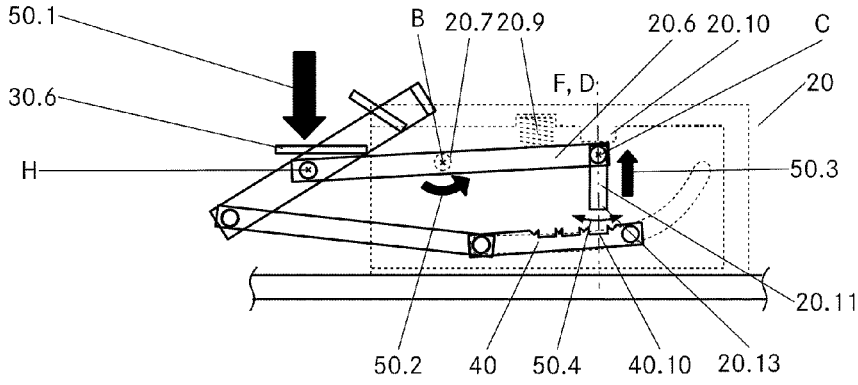
Figure 1C:
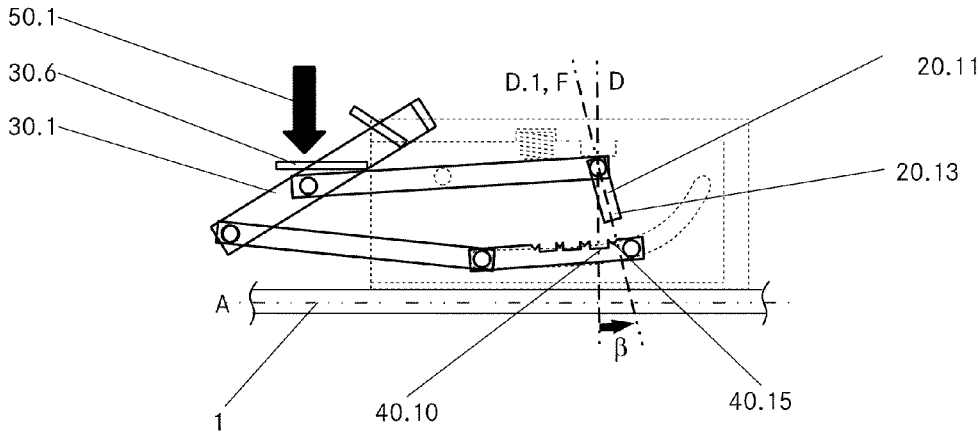
Figure 1D:
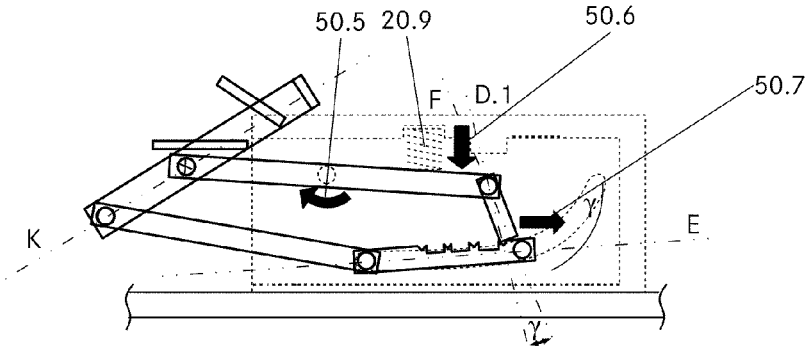
Figure 1E:
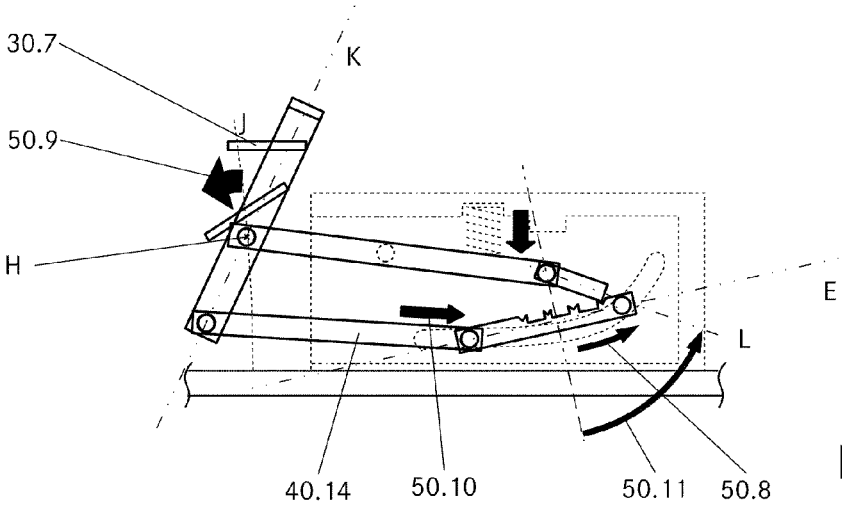
Figure 1F:
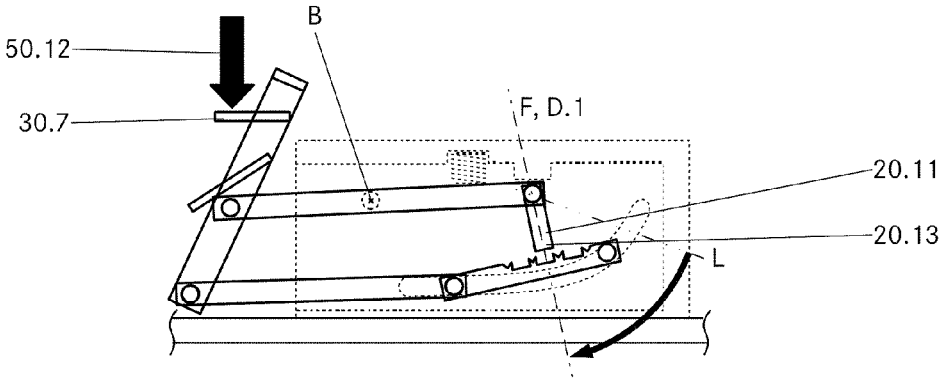
Figure 1G:
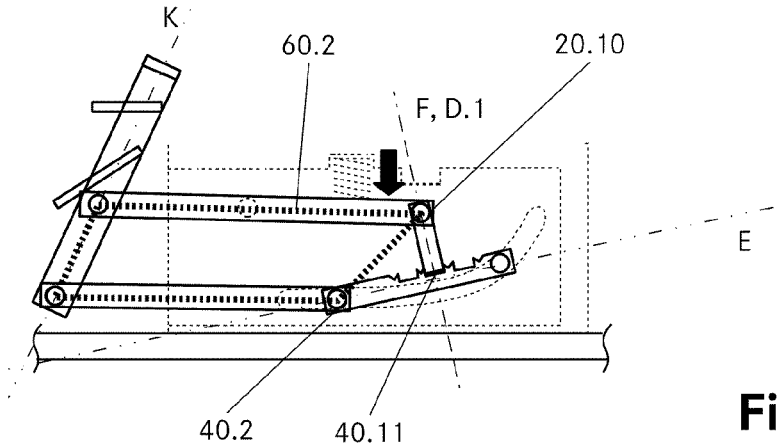
Figure 1H:
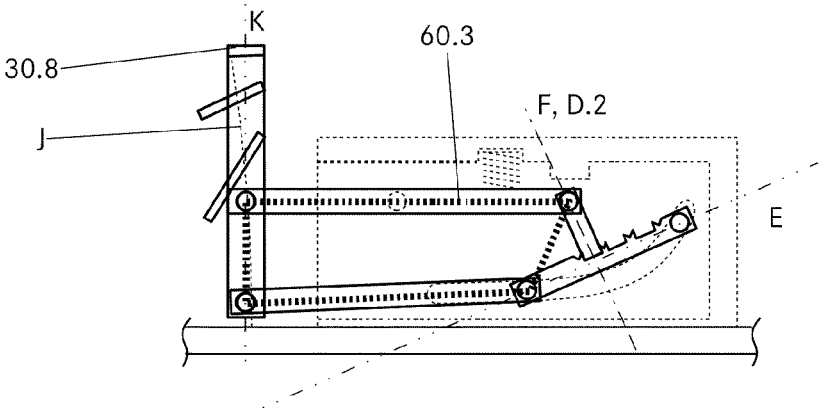

Apart from the first supporting position, in which the supporting lever 30.1 is located in the representation of FIG. 1*a*, the supporting lever 30.1 comprises a second supporting position, which corresponds to the support element 30.7 (FIG. 1*g*) and a third supporting position, which corresponds to the support element 30.8 (FIG. 1*h*). In the respective supporting position, the respective associated support element has in this case been pivoted into the path of movement J.

The detent notches 40.10 to 40.12 correspond in this case to the individual supporting positions. In particular, the rearmost detent notch 40.10, for example, corresponds to the first supporting position to the extent that, when the pendulous mass 20.11 aligned in the current direction of gravitational force D engages with its free longitudinal end 20.13 in the detent notch 40.10, the supporting lever 30.1 is in the first supporting position, in which the lowermost support elements 30.6 has been pivoted into the path of movement J. The detent notch 40.10 consequently forms a current detent notch for the first supporting position. In a corresponding way, the supporting lever 30.1 is in the second supporting position, the support element 30.7 having been pivoted into the path of movement J when the freely settled pendulous mass 20.11 engages in the detent notch 40.11 of the adjusting element 40, i.e. when the detent notch 40.11 forms the current detent notch. By analogy, the frontmost detent notch 40.12 corresponds to the current detent notch in the third supporting position of the supporting lever 30.1.

The device described comprises an active four-bar linkage 60.1 (polygon depicted by bold broken lines), which comprises the rocker 20.4, the portion 30.3 near the ski of the supporting lever 30.1, the joint arm 40.14 and also the pendulous mass 20.11 and the adjusting element 40, connected largely rigidly in the state represented in FIG. 1*a*. The pendulous mass 20.11 and the adjusting element 40 together form a largely orthogonal angled arm, which forms one of the four joint arms of the four-bar linkage 60.1. The angled arm formed in this way has in this case an effective length that is given by the distance between the joint 40.2 and the joint 20.10. In an adjusting process, the effective length of the angled arm between the joints 40.2 and 20.10, formed by the pendulous mass 20.11 and the adjusting element 40, is changed. In particular, the effective length of the angled arm is determined by the pendulous mass 20.11 being brought into engagement with various detent notches 40.10 to 40.12, whereby, depending on the detent notch, different distances between the joints 40.2 and 20.10 are obtained (see description of the following FIGS. 1*b-h*). Altogether, the active four-bar linkage 60.1 consequently comprises the joints 30.2, 30.5, 40.2 and 20.10.

FIG. 1*b* shows the climbing aid 10 when the adjusting device 20 is actuated, or in the actuated state. In the embodiment of FIGS. 1*a-h*, the adjusting device 20 can be actuated by means of the resilient rocker 20.4, in particular by a loading 50.1 of the front arm 20.5 of the rocker 20.4 in the direction of the ski 1. The supporting lever 30.1 articulated on the front arm 20.5 consequently also serves in a further function as an operating element of the adjusting device 20 that can be operated by the skier.

In the representation of FIG. 1*b*, the supporting lever 30.1 is loaded with a force 50.1 in the direction of the ski 1 by means of the support element 30.6. This loading 50.1 results in a rocking movement 50.2 of the rocker 20.4, rotating about the axis B, counter to the spring force of the spring 20.9. In this case, the supporting lever 30.1 is lowered toward the ski 1. The spring 20.9 is thereby stressed and stores the energy expended during the actuation of the adjusting device 20. The rocking movement 50.2 upon actuation is limited by the stop 20.8, against which the rear arm 20.6 lies in the actuated state of the adjusting device 20 in the representation of FIG. 1*b*, as a result of the performed rocking movement 50.2.

The pendulous mass 20.11 is in this case lifted off the adjusting element 40 (50.3) and raised in the direction away from the ski 1, in particular the free longitudinal end 20.13 of the pendulous mass 20.11 is thereby brought out of the detent notch 40.10. The pendulous mass 20.11 is then released and can swing freely in the plane G with respect to the axis C, in dependence on the current direction of gravitational force D with respect to the ski 1 and/or the adjusting device 20 (50.4).

FIG. 1*c* shows the climbing aid 10 similar to FIG. 1*b* in an actuated state, the supporting lever 30.1 still being subjected to a loading 50.1. In comparison with FIG. 1*b*, the ski 1 has been inclined with the longitudinal direction A in the plane G in such a way that a current direction of gravitational force D.1 is inclined by an angle β with respect to the current direction of gravitational force D of FIGS. 1*a* and 1*b*. The new direction of gravitational force D.1 corresponds in this case to an inclination of the ski 1 such that a front end of the ski lies higher than a rear end with respect to a horizontal. In the representation of FIG. 1*c* (and also in those of the following FIGS. 1*d-h*), the ski 1 continues to be represented horizontally, while the current direction of gravitational force changes.

Since the pendulous mass 20.11 is released in the actuated state of the adjusting device 20, the pendulous mass 20.11 can follow the change in direction of gravitational force from D to D.1, so that the longitudinal direction F of the pendulous mass 20.11 coincides with the direction of gravitational force D.1 and consequently correspondingly likewise pivots out rearward by the angle β.

In the representation of FIG. 1*c*, the pendulous mass 20.11 has in this case been deflected rearward in such a way that, with respect to the ski 1, the free longitudinal end 20.13 is positioned largely behind the current detent notch 40.10 above the adjusting notch 40.15. The four-bar linkage 60.1 described above is consequently interrupted, since the pendulous mass 20.11 and the actuating element 40 no longer together form an angled arm.

FIG. 1*d* shows a state of the climbing aid 10 following the state of FIG. 1*c*, when the supporting lever 30.1 is relieved of loading, i.e. the loading 50.1 is removed. In particular, here the climbing aid 10 is in a temporary state after discontinuation of the actuated state, an adjusting process being initiated on account of the deflection β of the pendulous mass 20.11.

As a result of the then absent loading 50.1 of the supporting lever 30.1, the spring force of the spring 20.9 can press the rear arm 20.6 of the rocker 20.4 toward the ski. The supporting lever 30.1 is in this case raised away from the ski 1 again in the course of a rocking movement 50.5 about the axis B. The pendulous mass 20.11, articulated on the rear arm 20.6 by means of the joint 20.10, is lowered toward the adjusting element 40 as a result of the rocking movement 50.5 (50.6), the free longitudinal end 20.13 of the pendulous mass 20.11 engaging in the adjusting notch 40.15 on account of the current alignment. The longitudinal direction F of the pendulous mass 20.11 is in this case no longer aligned perpendicularly to the longitudinal direction E of the adjusting element 40, but forms an angle γ smaller than 90 degrees with it. On account of the spring force of the spring 20.9, this produces a rearwardly directed force component 50.7, which is exerted by the pendulous mass 20.11 on the adjusting element 40.

FIG. 1*e* shows the climbing aid 10 in a state in which the adjusting process is being carried out or shortly after the adjusting process has been carried out.

On account of the force component 50.7, the adjusting element 40 has been displaced rearward by means of the pendulous mass 20.11, through the spring force of the spring 20.9, in the guide 20.14 (50.8). The longitudinal end 20.13 of the pendulous mass 20.11 in this case continues to engage in the adjusting notch 40.15 of the adjusting element 40. The adjusting element 40 has been rearwardly displaced to such an extent that the longitudinal direction F of the pendulous mass 20.11 has pivoted with respect to the current direction of gravitational force D.1 (50.11) and is aligned largely parallel to the rear arm 20.6 of the rocker 20.4 in a direction L. On account of the arcuate guide 20.14, the adjusting element 40 has changed its position with respect to the ski 1. In particular, a rear longitudinal end of the adjusting element 40 is arranged higher than a front longitudinal end with respect to a perpendicular to the ski 1. The adjusting element 40 is arranged with respect to the ski 1 in such a way that the longitudinal direction E is largely perpendicular to the current direction of gravitational force D.1. The adjusting element 40 consequently reflects a current horizontal position and consequently, as a reference element, reproduces a neutral position of the ski 1 associated with the current supporting position.

The adjusting element 40 acts via the joint arm 40.14 on the supporting lever 30.1 of the supporting device 30. With the displacement 50.8 of the adjusting element 40, the joint arm 40.14 is taken along by means of the joint 20.15, which in the adjusting process is drawn rearward, substantially parallel to the ski 1, as provided by the guidance by the guide pins 40.3 in the guide 20.14, 50.10. The joint arm 40.14 acts via the joint 30.5 on the supporting lever 30.1 and aligns the latter in a rotational movement 50.9 about the axis H. In particular, the supporting lever 30.1 is thereby brought into a second supporting position, in which the supporting element 30.7 is pivoted into the path of movement J. The longitudinal direction K of the supporting lever 30.1 has in this case been pivoted in comparison with its position in the first supporting position toward a perpendicular with respect to the surface of the ski 1.1.

The spring 20.9 consequently forms the energy store described above, which stores the energy expended for the actuation of the adjusting device 20 and, in the adjusting process by means of the pendulous mass 20.11, gives it off to the adjusting element 40 in such a way that the supporting lever 30.1 can be brought into a new supporting position by means of the adjusting element 40, for example overcoming the threshold force of a spring catch. It goes without saying that the represented configuration and arrangement of the spring 20.9 should only be regarded by way of example and a person skilled in the art will immediately see other possibilities that could likewise form advantageous embodiments of a mechanical energy store. As examples, mention may be made here of spiral springs, leaf springs of metals, but also components of elastic plastics or other elastic materials.

FIG. 1*f* shows the climbing aid 10 in a state after the adjusting process has been carried out when there is renewed loading 50.12 of the supporting lever in the direction of the ski 1.

In the representation of FIG. 1*f*, the supporting lever 30.1 is in the second supporting position and the loading 50.12 acts on the second support element 30.7. As a result, the supporting lever 30.1 is lowered toward the ski 1 and the rocker 20.4 again performs a rocking movement about the axis B against the spring force of the spring 20.9, until the rear arm 20.6 lies against the stop 20.8. In this situation, the pendulous mass 20.11 has again been lifted off the adjusting element 40, and in particular also brought out from the adjusting notch 40.15. Since the pendulous mass 20.11 is now released, it swings out of the position L and aligns itself again with its longitudinal axis F parallel to the current direction of gravitational force D.1. In particular, the free longitudinal end 20.13 is thereby arranged above the detent notch 40.11, which corresponds to the second supporting position.

FIG. 1*g* represents the climbing aid 10 or the adjusting device 20 in a state which follows the actuation of FIG. 1*f*, after an actuated state of the adjusting device 20 is ended. The supporting lever is in this case engaged in the second supporting position.

The spring force of the spring 20.9 presses the rear arm 20.6 in the direction of the ski 1 and consequently lowers the pendulous mass 20.11 onto the adjusting element 40, the supporting lever 30.1 being raised away from the ski 1 by the rocker 20.4. The longitudinal end 20.13 of the pendulous mass 20.11 is thereby made to enter the detent notch 40.11 and engages there.

This once again produces a four-bar linkage 60.2, which comprises the same components as the four-bar linkage 60.1, in particular the joints 30.2, 30.5, 40.2 and 20.10 (polygon depicted by bold broken lines). By contrast with the four-bar linkage 60.1 of FIG. 1*a*, the angled arm formed by the adjusting element 40 with the pendulous mass 20.11 has a shorter effective length, i.e. the distance between the joints 20.10 and 40.3 is shorter in comparison with the representation of FIG. 1*a*.

FIG. 1*h* shows the climbing aid 10 in a state in which the supporting lever 30.1 is engaged in the third supporting position.

In comparison with the situation represented in FIG. 1*g*, the ski 1 has been inclined further with respect to a horizontal. A new current direction of gravitational force is designated by D.2 and is inclined further away from a perpendicular to the surface of the ski 1.1 than the direction of gravitational force D.1 of FIG. 1*g*. In an adjusting process similar to FIGS. 1*c*-*e*, the adjusting element 40 has been brought out of the position of FIG. 1*g* into the position of FIG. 1*h*. The adjusting element 40 has in this case been displaced further rearward in such a way that, on account of the arcuate guide 20.14, a position which largely corresponds to a horizontal, and is consequently perpendicular to the direction D.2, has been reached. On account of the displacement of the adjusting element 40, the supporting lever 30.1 has been stood up in a direction perpendicular to the surface of the ski 1.1 in a rotation about the axis H by means of the joint arm 40.14, so that the support element 30.8 has been pivoted into the path of movement J. In FIG. 1*h*, the longitudinal direction K of the supporting lever 30.1 is aligned largely perpendicularly to the surface of the ski 1.1.

The spring 20.9 presses the rear arm 20.6 of the rocker 20.4 in the direction of the ski 1, and consequently the pendulous mass 20.11 onto the adjusting element 40. The longitudinal end 20.13 of the pendulous mass 20.11 is thereby engaged in the detent notch 40.10.

This once again produces a four-bar linkage 60.3, comprising the joints 30.2, 30.5, 40.2 and 20.10 (polygon depicted by bold broken lines). By contrast with the four-bar linkage 60.2 of FIG. 1*g*, the angled arm formed by the adjusting element 40 with the pendulous mass 20.11 has a further shortened effective length, i.e. the distance between the joints 20.10 and 40.3 is reduced in comparison with the representation of FIG. 1*g*.

An adjustment of the supporting device in a transition from a greater longitudinal inclination of the ski to a lesser inclination of the ski, i.e. a "switching down" from a greater current climbing angle to a smaller current climbing angle, takes place largely by analogy with the adjusting process that is described in FIGS. 1*d* and 1*e*. As a difference, when released, the pendulous mass 20.11 does not in this case swing out rearward as in FIG. 1*c*, as a result of the change in the longitudinal inclination of the ski to a smaller inclination, but forward with respect to a direction perpendicular to the adjusting element 40. The pendulous mass 20.11 therefore does not engage in an adjusting notch 40.15 lying behind the current detent notch, for example 40.10, as for example in FIG. 1*d*, but engages in an adjusting notch 40.18 lying in front of a current detent notch, for example 40.12. Consequently, on account of the spring force of the spring 20.9, lowering produces a forwardly directed force component on the adjusting element 40 via the pendulous mass, so that said adjusting element is displaced forward in the arcuate guide 20.14. By means of the joint arm 40.14, the supporting lever 30.1 is thereby inclined away rearward from a perpendicular and brought into the new supporting position with a smaller climbing angle, for example adjusted from the third supporting position into the second supporting position.

An adjusting direction in the adjusting process is consequently obtained on the basis of a position of the pendulous mass 20.11 with respect to a direction perpendicular to the longitudinal direction E of the adjusting element 40: if the pendulous mass 20.11 swings out rearward with respect to this direction, the supporting device 30 is adjusted to a supporting position with a greater climbing angle; if the pendulous mass 20.11 swings forward, the supporting device 30 is adjusted to a supporting position with a smaller climbing angle.

The spacing of the adjusting notches 40.15 to 40.18 from the respectively adjacent detent notches 40.10 to 40.12 or a configuration of the transition from a detent notch 40.10 to 40.12 into an adjusting notch and a configuration of the engaging end 20.13 of the pendulous mass 20.11 provide the criterion according to which a deviation of the longitudinal direction F of the pendulous mass 20.11 from the perpendicular to the longitudinal direction E of the adjusting element 40 is sufficiently great to initiate an adjusting process or not.

Figure 1J:
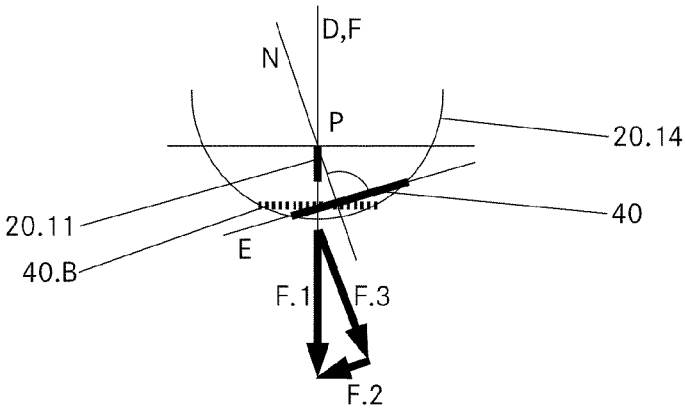
FIG. 1*j* a basic diagram for resetting in the case of a device according to FIGS. 1*a-h;*

FIG. 1*j* schematically shows the functioning mode during resetting. The adjusting element 40 is displaceably guided on an arcuate guide 20.14. A current direction of gravitational force points in direction D. The pendulous mass 20.11 is pivotably mounted at the point P and settles in the direction of gravitational force D, whereby the longitudinal direction F of the pendulous mass 20.11 consequently coincides with the direction D. A spring force F.1, which is exerted on the pendulous mass 20.11 in direction F of the current alignment of the pendulum by a spring not represented in FIG. 1*j*, has a resolution of forces F.2 and F.3 with respect to the longitudinal direction E of the adjusting element 40 and a direction N perpendicular thereto. In particular, the force component F.2 points in direction E and consequently brings about a displacement of the adjusting element 40 in the arcuate guide 20.14 in the direction of the force component F.2. In particular, the displacement takes place until no force component is acting any longer in the direction of the longitudinal direction E, i.e. in the direction of a possible displacement. The adjusting element 40 is then in a new, set state (40.B).

In other words, the adjusting device 20 according to the invention of FIGS. 1*a*-1*h* can be summarized as comprising an adjusting element 40 which can be brought into various positions with respect to the adjusting device 20. The adjusting element 40 in this case acts as a reference element for a neutral position of the ski 1 that is associated with the current supporting position. If the adjusting element 40 is in a largely horizontal position, no adjusting process is initiated after an actuation of the adjusting device 20, i.e. the skier 1 is in the current neutral position. If the position of the adjusting element 40 deviates from a horizontal position beyond a predetermined value, an adjusting process in which the adjusting element 40 is displaced in a direction which brings it closer to a current horizontal position is initiated if the deviation is sufficiently great. The predetermined deviation is given here by a width of the detent notches 40.10 to 40.12 in the direction of the pendulum movement or by the effective width in which it is possible for the pendulous mass 20.11 to engage in a detent notch 40.10 to 40.12 without engaging in an adjacent adjusting notch 40.15 to 40.18. If the pendulous mass 20.11 goes into an adjusting notch 40.15 to 40.18 adjacent the detent notches 40.10 to 40.12, the adjusting element 40 is displaced in its guide 20.14 in an adjusting process. If, on the other hand, the pendulous mass 20.11 goes into a detent notch 40.10 to 40.12, no adjusting process takes place.

When the adjusting element 40 is displaced, the supporting lever 30.1 is adjusted by means of the joint arm 40.14 from a current, for example first, supporting position into a new, for example second, supporting position. If, after the adjusting process, the adjusting element 40 is in a horizontal position, the next time the adjusting device 20 is actuated no adjusting process takes place and the pendulous mass 20.11 engages in a detent notch 40.10 to 40.12 corresponding to the new supporting position. The ski 1 is in this case in the current neutral position.

Figure 2A:
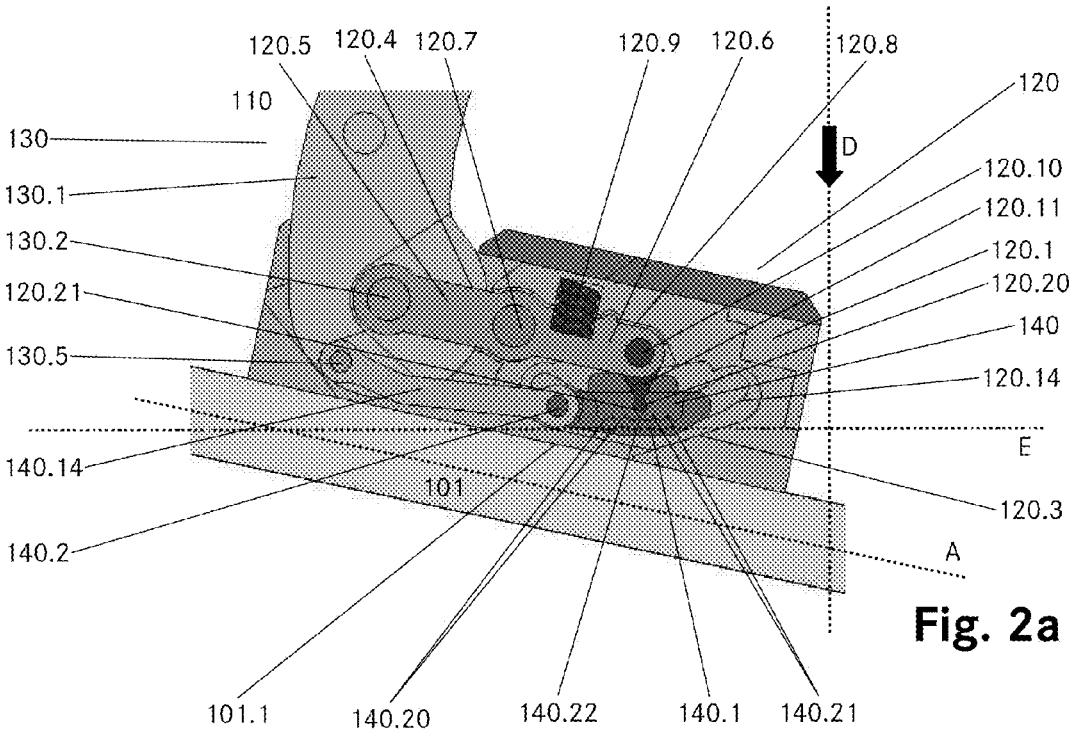
FIG. 2*a-c* a sectional drawing of a further embodiment of the device according to the invention for use as a climbing aid with a mechanical adjusting device in three different states.

FIG. 2*a* shows a sectional view of an actual embodiment of a climbing aid 110 according to the invention, which is fastened on a ski 101. The sectional view in this case lies in the plane G, which comprises the longitudinal axis A of the ski 101 and stands perpendicularly on a surface 101.1 of the ski 101. Parts of the climbing aid 110 that largely correspond to the parts of FIGS. 1*a*-1*h* are provided with designations which are greater by 100 than in FIGS. 1*a*-1*h*. As in FIGS. 1*a*-*h*, "front/forward" and "rear/rearward" respectively refer to directions with respect to the ski 101, front/forward referring to an intended direction of travel.

The climbing aid 110 comprises an adjusting device 120, and also a supporting device 130 formed as a supporting lever 130.1. The adjusting device 120 has in this case a base part 120.1 with an inner space 120.3, in which a mechanism of the adjusting device 120 is accommodated. The supporting lever 130.1 is in this case pivotably connected via a joint 130.2 to a front arm 120.5 and to a rocker 120.4 and protrudes out of the inner space 120.3 of the base part 120.1 away from the ski 101 in such a way that it is pivotable about the joint 130.2 in a region intended for this. The rocker 120.4 is mounted on the base part 120.1 by means of a bearing 120.7 in such a way that the supporting lever 130.1 can be lowered with the front arm 120.5 toward the ski 101 and a rear arm 120.6 of the rocker 120.4 is thereby raised away from the ski 101. The rear arm 120.6 is subjected to a spring force, which presses it in the direction of the ski 101, by a spring 120.9, which is supported on the base part 120.1.

In the representation of FIG. 2*a*, the supporting lever 130.1 is subjected to pressure in the direction of the ski 101 by the weight of a skier, for example via a ski boot carrier that is not represented, for which reason the rear arm 120.6 is pressed away from the ski 101, counter to the spring force of the spring 120.9, on account of the rocker 120.4, and lies against a stop 120.8 in the inner space 120.3 that limits the rotation of the rocker 120.4. The adjusting device 120 is consequently in an actuated state.

Pivotably mounted at a joint 120.10 on the rear arm 120.6 is an elongate pendulum 120.11, which can swing largely freely in the longitudinal direction A of the ski 101 about a transverse pin. The pendulum 120.11 has a largely round pendulum head 120.20, which is formed on the longitudinal end of the pendulum 120.11 that is facing away from the pivot joint 120.10. The pendulum head 120.20 has in this case a notch 120.21 at the end in a longitudinal direction F of the pendulum 120.11.

Furthermore, the supporting lever 130.1 is connected via a further joint 130.5, which is at a distance from the joint 130.2 toward the ski 101, to a rearwardly protruding joint arm 140.14, which in turn is jointedly connected at a joint 140.2 to an elongate adjusting element 140 in the form of a small boat. The adjusting element 140 is arranged with its longitudinal axis E in the plane G. The adjusting element 140 is displaceably guided with its longitudinal axis E in the plane G in an arcuate guide 120.14 on the base part 120.1. The arcuate guide 120.14 is curved away from the ski 101 in a rear region. The adjusting element 40 is arranged under the pendulum 120.11 with respect to a direction of gravitational force. In the representation of FIG. 2*a*, the adjusting element 140 is arranged largely horizontally, while the ski 101 has a longitudinal inclination, i.e. is raised at the front.

On a surface 140.1 facing the pendulum 120.11, the adjusting element 140 has a row of adjusting notches 140.20, which have a semicircular cross section and are aligned transversely to a longitudinal direction of the ski 101 and are arranged one behind the other in the longitudinal direction E. The adjusting notches 140.20 in this case abutt one another in the longitudinal direction E and consequently form detent cams 140.21, arranged between the notches 140.20. The detent cams 140.21 correspond in this case to the various supporting positions of the supporting lever 130.1.

If the supporting lever 130.1 is in the current supporting position provided for the current inclination of the ski, a corresponding current detent cam 140.22 is located under the notch 120.21 of the pendulum head 120.20 with respect to the direction of gravitational force. Moreover, the adjusting element 140 is in this case in a horizontal position, so that the freely swinging pendulum 120.11 is perpendicular to the adjusting element 140. If, as a result of relieving the supporting element 130.1 of loading, the pendulum 120.11 is lowered onto the adjusting element 140 on account of the spring force of the spring 120.9, the current detent cam 140.22 goes into the notch 120.21 and no force component of the spring force acts on the adjusting element 140 in the direction of a displacement direction that is predetermined by the arcuate guide 120.14. Consequently, no adjusting process takes place, the adjusting element 140 is not displaced and therefore the supporting lever 130 is also not adjusted by means of the joint arm 140.14, and so the current supporting position is maintained.

Figure 2B:
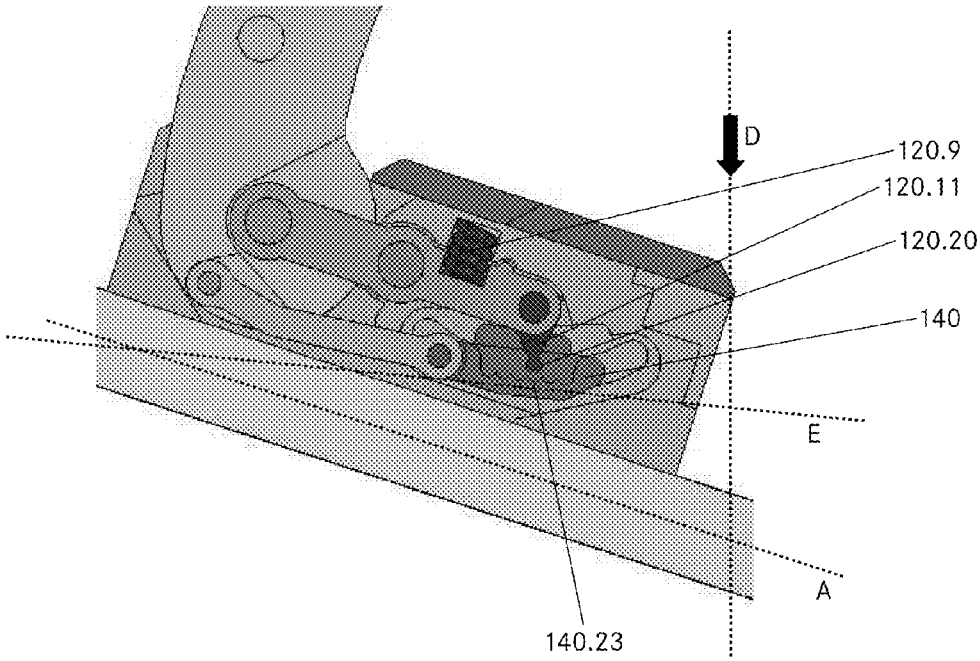

FIG. 2*b* shows a sectional view corresponding to FIG. 2*a*, the ski 101 being more inclined. In the representation of FIG. 2*b*, the supporting lever 130.1 is once again subjected to pressure in the direction of the ski 101, for which reason the rear arm 120.6 is pressed away from the ski 101, counter to the spring force of the spring 120.9, on account of the rocker 120.4, and lies against a stop 120.8 limiting the rotation of the rocker 120.4. The adjusting device 120 is consequently in an actuated state and the pendulum 120.11 is released.

With the change in the inclination of the ski 101, the adjusting element 140 has also changed its position with respect to the direction D of gravitational force. In particular, its longitudinal direction E is now no longer arranged perpendicularly to the direction of gravitational force. The free pendulum 120.11 aligns itself in the direction D of gravitational force. The pendulum head 120.20 is therefore no longer arranged over the detent cam 140.22, as in FIG. 2*a*, but is now arranged over a current adjusting notch 140.22, which is adjacent the detent cam 140.23 in the rearward direction.

If, as a result of relieving the supporting element 130.1 of loading, the pendulum 120.11 is lowered onto the adjusting element 140 on account of the spring force of the spring 120.9, the pendulum head 120.20 goes into the adjusting notch 140.22. The spring force acting on the adjusting element 140 via the pendulum 120.11 has a rearward force component, i.e. in the direction of a displacement direction allowed by the arcuate guide 120.14, on account of the non-orthogonal alignment of the pendulum 120.11 with respect to the longitudinal direction E of the adjusting element 140. On account of this force component, the adjusting element 140 is rearwardly displaced in the arcuate guide during further lowering in an adjusting process of the pendulum 120.11, whereby, by means of the joint arm 140.14, the supporting lever pivots with respect to the joint 130.2, i.e. is set into a new supporting position (see FIG. 2*c*).

Figure 2C:
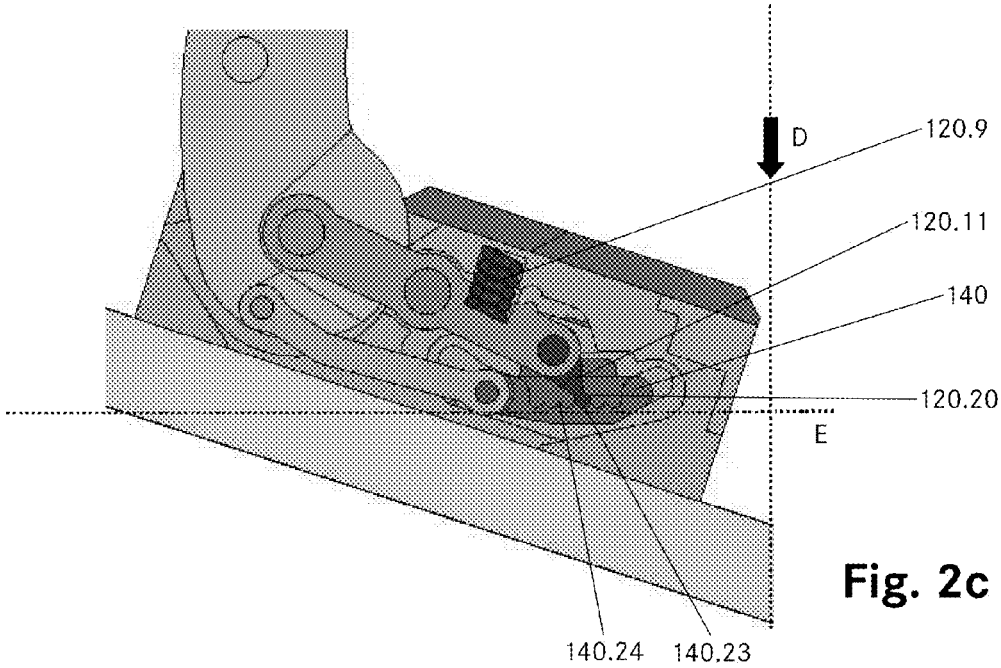

In particular, the adjusting element 140 in the representation of FIG. 2*c* is brought into a new position, in which its longitudinal direction E is aligned largely horizontally, so that, the next time the adjusting device 120 is actuated, the pendulum 120.11 when it settles is again perpendicular to E and is arranged with its notch 120.21 over a new detent cam 140.24, which is adjacent the detent cam 140.23 in the forward direction. The climbing angle of the new supporting position corresponds in this case to the desired climbing angle.

As a difference from the embodiments of FIGS. 1*a*-*h*, the adjusting element 140 of FIGS. 2*a* and 2*b* has no alternately arranged detent notches and adjusting notches in which the pendulum 120.11 engages. By contrast, the adjusting element 140 has adjusting notches 140.20 and detent cams 140.21 arranged between the adjusting notches 140.20, a single detent notch 120.21 into which the detent cams 140.21 can be moved being formed on the pendulum 120.11. The detent cams 140.21 consequently correspond to neutral positions of the adjusting device 120 that correspond to the supporting positions, and a spacing between the adjusting notches 140.20 represents a predetermined deviation that has to be reached by the pendulum 120.11 from the neutral position, or from a perpendicular to the neutral position, in order to initiate an adjusting process when the adjusting device is actuated.

Figure 3:
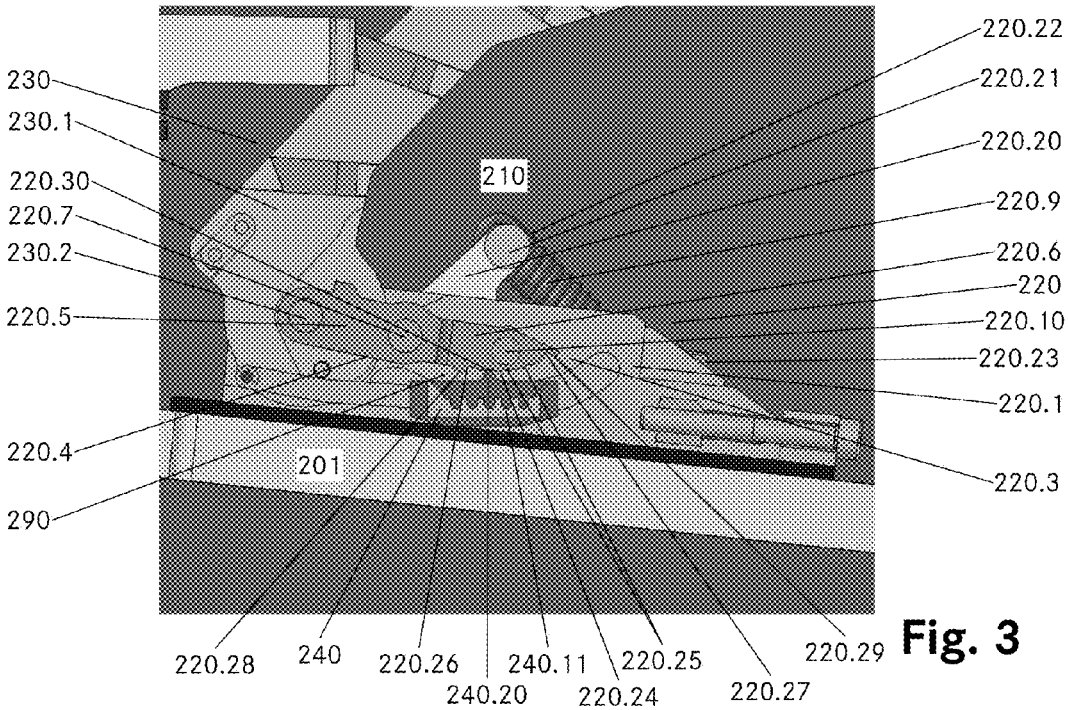
FIG. 3 a sectional drawing of a further embodiment of the climbing aid according to the invention with a mechanical adjusting device with a catch device.

FIG. 3 shows a further embodiment of a climbing aid 210 according to the invention that is mounted on a ski 201 and comprises an adjusting device 220 adjusting a supporting device 230 formed as a supporting lever 230.1.

The supporting device of FIG. 3 corresponds in its configuration largely to the embodiment of FIGS. 1*a*-1*h* or FIGS. 2*a*-2*c*. By contrast with the foregoing representations, in the representation of FIG. 3 the pendulous mass is not shown, to allow a view of components lying under it, in particular an additional catch device 290.

The adjusting device 220 comprises a base part 220.1, which includes a mechanism of the adjusting device 220 in an inner space 220.3. The adjusting device 220 has in this case a rocker 220.4, which is rotatably mounted on the base part 220.1 about a transverse pin 220.7. On a front arm 220.5, the supporting lever 230.1 is attached to the rocker 220.4 by means of a joint 230.2. On a rear arm 220.6 of the rocker 220.4, a pendulum (not represented) is pivotably articulated on the rocker 220.4 by means of a joint 220.10. The rocker 220.4 is forcibly coupled with the pin 220.7 in such a way that, when there is a rocking movement of the rocker 220.4, the pin 220.7 rotates with it, and vice versa. The pin 220.7 in this case protrudes out of the base part 220 on an outer side and has there a lever arm 220.20, which is fixedly connected at its longitudinal end to the pin 220.7. At the end 220.21 of the lever arm 220.20 that is remote from the pin, a helical spring 220.9 that can be subjected to tensile loading is anchored with one of its longitudinal ends 272.1. With its other longitudinal end, the helical spring 220.9 is fastened to the base part 220.1. The spring 220.9 largely corresponds in its function to the compression spring 20.9 in FIGS. 1*a*-1*h* or the compression spring 120.9 of FIGS. 2*a*-2*c*: it subjects the rocker 220.4 to a turning moment counteracting loading applied to the supporting lever 230.1, so that the rear arm 220.6 of the rocker 220.4 is pressed toward the ski 201. The external spring 220.9 makes it possible, for example, for simplified manipulations of the spring 220.9 to be performed.

For example, an easily accessible adjusting device 220.23 is provided, for example in the form of an adjusting screw, which allows the skier to set or adapt the tension of the spring.

The additional catch device 290 of the embodiment of FIG. 3 engages the supporting device 230 in the respective supporting position. Formed for this on a side 220.24 of the rear arm 220.6 of the rocker 220.4 that is facing an adjusting element 240 are notches 220.25, which correspond to the various supporting positions of the supporting lever 230.1. Formed on the adjusting element 240 is a lug 240.20, which is facing the side 220.24 and is configured in such a way that engagement of the lug 240.20 in the notches 220.25 is possible. In particular, a frontmost notch 220.26 of the notches 220.25 corresponds to a supporting position with the smallest climbing angle, while a rearmost notch 220.27 of the notches 220.25 corresponds to a supporting position with the greatest climbing angle. The frontmost notch 220.26 is limited in the forward direction by a stop 220.28 for the lug 240.20, while the rearmost notch 220.27 is limited in the rearward direction by a stop 220.29 for the lug 240.20.

The lug 240.20 and the notches 220.25 interact in such a way that, during the lowering of the pendulum (not represented) onto the adjusting element 240, when the pendulum engages in one of the detent notches 240.11 of the adjusting element the notch 240.20 engages in a notch 220.30 corresponding to the detent notch 240.11. Lowering of the rear arm 220.6 in the direction of the adjusting element 240 is specifically limited individually for each supporting position by a height of the lug 240.20 and or a depth of the respective notches 220.25. With the engagement of the lug 240.20 in the corresponding notch 220.30, the current supporting position is engaged. The stops 220.28 and 220.29 thereby prevent settings above a supporting position with the greatest climbing angle or below a supporting position with the smallest climbing angle being made in an adjusting process.

The interengaging notches 220.25 and lug 240.20 consequently form parts of the additional catch device 290, which engages the supporting lever 230.1 in a current supporting position and relieves the engagement of the pendulum (not represented) in the detent notches 240.11 of the adjusting element 240.

Figure 4A:
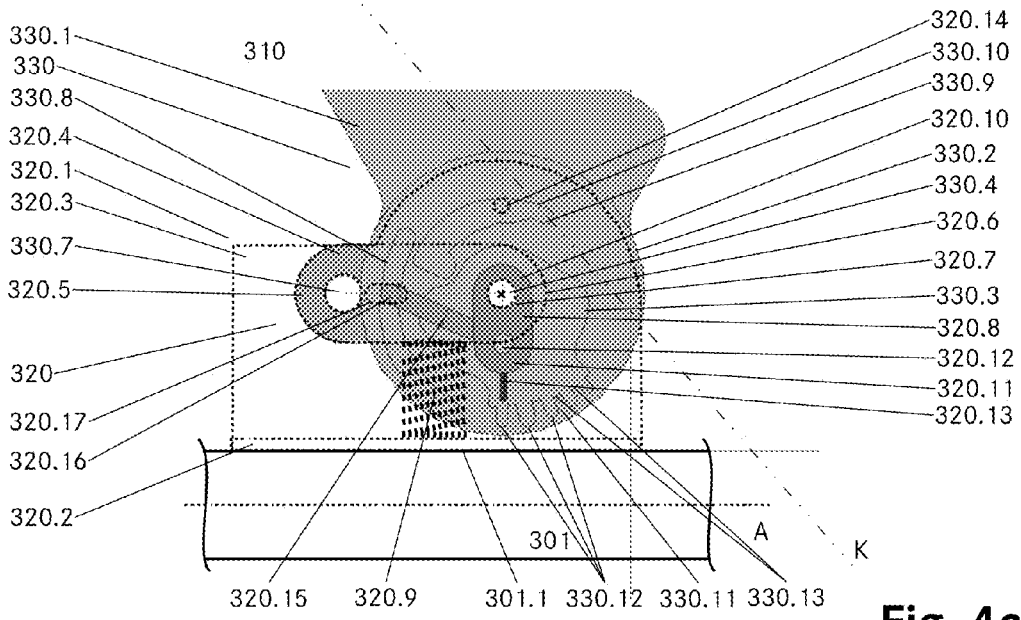
FIGS. 4*a-c* a sectional drawing of an embodiment of the device according to the invention for use as a climbing aid with an adjusting device integrated in the supporting device.
Figure 4B:
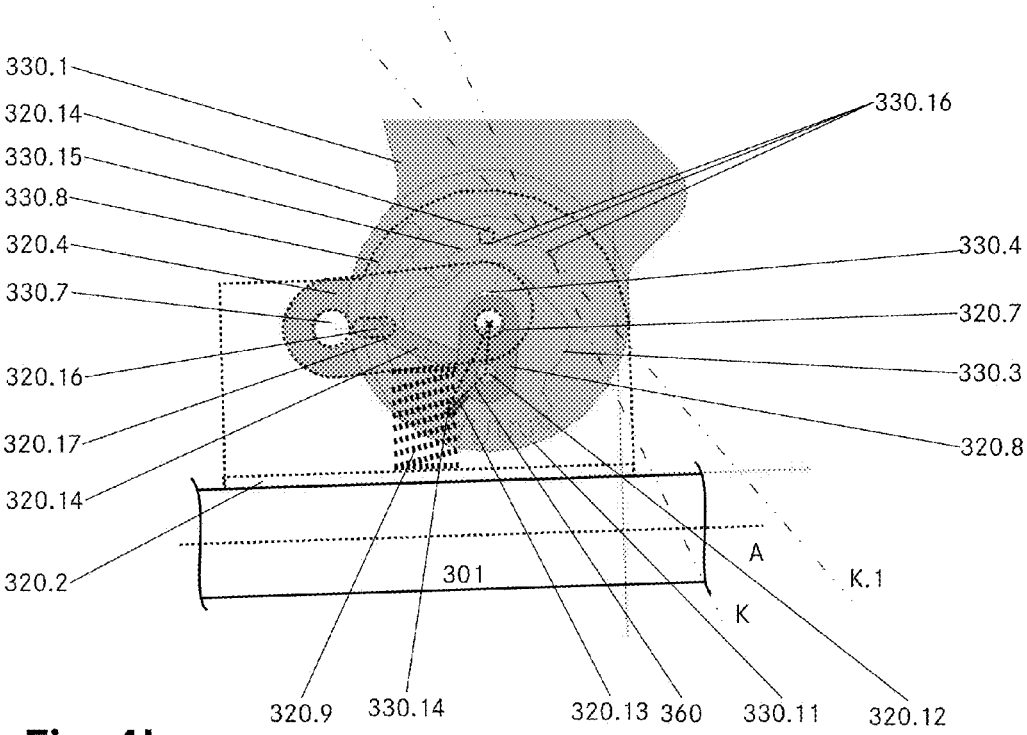
Figure 4C:
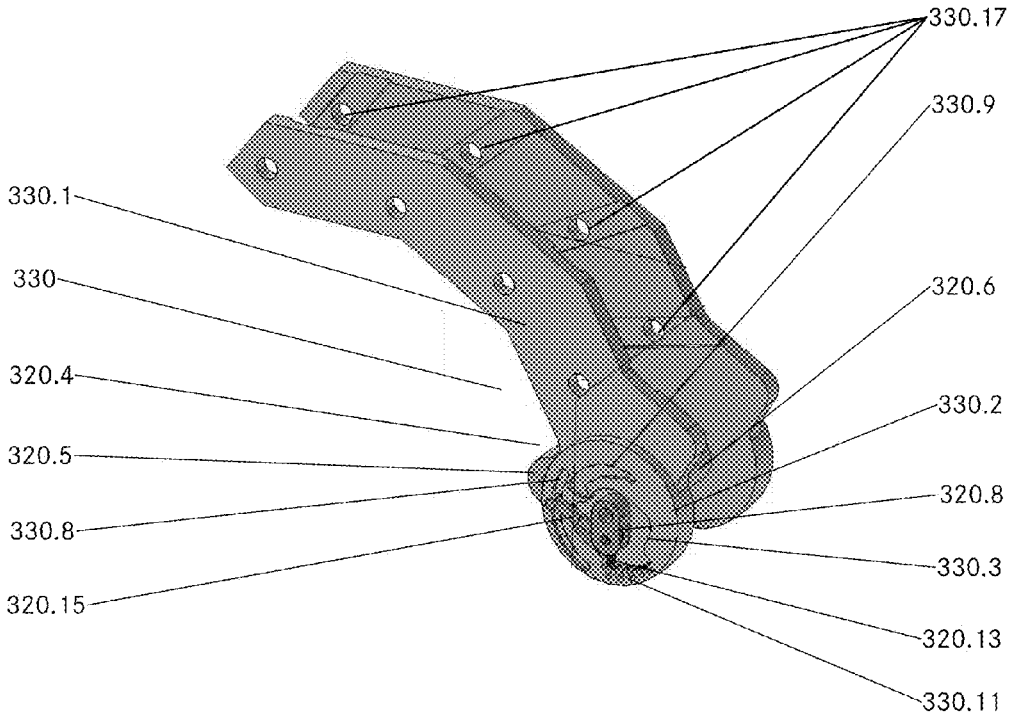

FIGS. 4*a* to 4*c* show a further embodiment of a climbing aid 310 according to the invention, which is mounted on a ski 301 and in the case of which an adjusting device 320 is accommodated in a supporting device 330 formed as a supporting lever 330.1.

The supporting lever 330.1 is in this case pivotably mounted about a stub 330.4 at a front longitudinal end 320.6 of a lever arm 320.4 arranged substantially in a longitudinal direction A of the ski 301. At an opposite longitudinal end 320.5, the lever arm 320.4 is pivotably articulated on a base part 320.1 of the climbing aid 310 by means of a stub 330.7. The stub 330.7 is in this case arranged behind a base 330.2 of the supporting lever 330.1 that is near the ski and the lever arm 320.4 is aligned largely parallel to a surface 301.1 of the ski 301. In the representation of FIG. 4*a*, a longitudinal axis K of the supporting lever 330.1 is inclined rearward from a perpendicular to the surface of the ski 301.1.

The climbing aid 310 as a whole is attached to a surface 301.1 of a ski 301 by means of the base part 320.1. The base part 320.1 is formed largely in a U-shaped manner in a cross section transverse to the longitudinal direction A of the ski 301, a base 320.2 of the base part 320.1 being arranged on the surface of the ski 301.1 and the base 330.2 of the supporting lever 330.1 being arranged between a side wall 320.3 and a further, not visible, side wall of the base part 320.1. The stub 330.7 is in this case mounted in both side walls 320.3, while the stub 330.4 extends only over a width of the supporting lever 330.1 and is not mounted on the side walls 320.3. The supporting lever 330.1 consequently forms with the lever arm 320.4 that is mounted on the base part 320.1 a linkage in the form of a double joint.

A change in the pivoting position of the supporting lever 330.1 takes place by rotation about the pin 330.4, while the supporting lever 330.1 can be lowered with respect to the ski 301 about the stub 330.7. The lever arm 320.4 is in this case supported on the base 320.2 of the base part 320.1 by means of a compressively acting spring mechanism 320.9 in such a way that the supporting lever 330.1 is pressed away from the ski 301 or from the base 320.3. The supporting lever 330.1 is consequently resiliently mounted with respect to the base part 320.1 and, under loading applied by a skier, can be lowered toward the ski 301, rotating about the stub 330.4, against the force of the spring mechanism 320.9.

In order to limit lowering, a stop 320.14 is provided, projecting on the inside beyond the side wall 320.3 and engaging in a corresponding clearance 330.9 on the base 330.2 of the supporting lever 330.1. The clearance 330.9 is in this case formed in such a way that, in every pivoting position, the stop 320.14 butts against an upper inner wall 330.10 of the clearance 330.9 during the lowering of the supporting lever 330.1, and consequently limits further lowering of the supporting lever 330.1 toward the ski 301.

The supporting lever 330.1 comprises on the base 330.2 a laterally arranged open inner space 330.3 for receiving a mechanism of the adjusting device 320. The base 330.2 is in this case arranged in the U-shaped base part 320.1 in such a way that the inner space 330.3 of the supporting lever 330.1 is largely covered, in particular closed, by the side walls 320.3 of the base part 320.1.

Mounted on the base part 320.1 is a stub 320.7, which projects out of the side wall 320.3 into the inner space 330.3. In the inner space 330.3, a lever arm 320.8 is pivotably mounted on the stub 320.7 at a longitudinal end 320.10 remote from the ski. The lever arm 320.8 is in this case aligned largely perpendicularly to the surface of the ski 301.1 and has at a longitudinal end 320.11 near the ski a further joint 320.12, at which on the one hand a pendulous mass 320.13 and on the other hand a guide arm 320.15 are mounted. The guide arm 320.15 in this case extends in the direction of the stub 330.7 and is displaceably guided there in the longitudinal direction A of the ski 301 with a rear longitudinal end 320.16 in a slot 320.17 on the base part 320.1. A displacement of the longitudinal end 320.16 of the guide arm 320.15 in the slot 320.17 consequently results in pivoting of the lever arm 320.8 about the pin 320.7. Moreover, the longitudinal end 320.16 is also guided in an arcuate guide 330.8 on the base 330.2 of the supporting lever 330.1, which guide displaces the longitudinal end 320.16 in the slot 320.17 in dependence on a pivoting position of the supporting lever 330.1. The arcuate guide 330.8 is in this case largely circular and eccentric with respect to the stub 330.4, so that a displacement of the longitudinal end 320.16 in the slot 320.17 is obtained on account of a change in the pivoting position of the supporting lever 330.1.

Alternately formed on an inner wall 330.11 of the inner space 330.3 that is arranged near the ski and is largely circular with respect to the stub 320.7 are detent notches 330.12 and adjusting notches 330.13, in which the pendulous mass 320.13 either engages (detent notches 330.12) or is made to enter to adjust the supporting lever 330.1 (adjusting notches 330.13) when the supporting lever 330.1 is raised.

Since the lever arm 320.8 is mounted on the base part 320.1 by means of the stub 320.7, this lever arm is not moved along with the supporting lever 330.1 when the latter is lowered.

The representation of FIG. 4*a* shows the climbing aid 310 in a state in which loading has been applied to the supporting lever 330.1 and it has therefore been lowered completely in the direction of the ski 301, so that the stop 320.14 lies against the upper inner wall 330.10 of the clearance 330.9. The pendulous mass 320.13 has therefore been brought out of the detent notches 330.12 and the adjusting notches 330.13 and released. In accordance with a current effect of a gravitational force, the pendulous mass 320.13 has settled largely perpendicularly to a surface of the ski 301.1.

FIG. 4*b* shows the climbing aid 310 of FIG. 4*a* during an adjusting process, with the supporting lever 330.1 raised. During the transition from FIG. 4*a* to FIG. 4*b*, a longitudinal inclination of the ski 301 has been changed before the adjusting process, so that the ski 301 is then raised at the front. On account of the guiding of the longitudinal end 320.16 of the guide arm 320.15 in the slot 320.17 and the arcuate guide 330.8, the longitudinal end 320.16 of the guide arm 320.15 is undisplaceable for a given pivoting position. Consequently, the lever arm 320.8 is coupled with a longitudinal inclination of the base part 320.1 or of the ski 301 via the guide arm 320.15. Therefore, when there is a change in position of the ski 301, the lever arm 320.8 has therefore been pivoted from a vertical position in such a way that it continues to be perpendicular to the surface of the ski 301.1 and has now been pivoted forward out of a direction of gravitational force. The pendulous mass 320.13 released during the transition has settled rearward, and is aligned in the direction of the current effect of a gravitational force, on account of the changed inclination of the ski 301. As a result, the pendulous mass 320.13 is arranged above a rearmost adjusting notch 330.14, before the state described hereafter of FIG. 4*b* is established.

In FIG. 4*b*, the supporting lever 330.1 is no longer loaded and is pivoted about the stub 330.7 by the force of the spring element 320.9 on the lever arm 320.4, connected to the latter via the stub 330.4. In this case, the supporting lever 330.1 jointedly connected to the lever arm 320.4 via the stub 330.4 is also pivoted about the stub 330.7 and consequently raised away from the base 320.2 of the base part 320.1 in a largely perpendicular direction. Raising is in this case limited by the stop 320.14, which from then on lies against a lower inner wall 330.15. The lower inner wall 330.15 also has notches 330.16 for the stop 320.14 that correspond to the various pivoting positions of the supporting lever 330.1, and consequently also correspond to the detent notches 330.12. The notches 330.16 consequently form together with the stop 320.14 a catch device for engaging the supporting lever 330.1 in a position corresponding to the pivoting position. The supporting lever 330.1, and consequently the inner space 330.3, has consequently been displaced away from the base 320.2 with respect to the lever arm 320.8, which is only rotatable with respect to the base part 320.1. As a result, the pendulous mass 320.13 articulated on the lever arm 320.8 by means of the joint 320.12 has been lowered onto the inner wall 330.11 and thereby made to enter the rearmost adjusting notch 330.14.

On account of the pendulous mass 320.13 that has settled rearward with respect to a perpendicular to the surface of the ski 301.1 and also the lever arm 320.8 that has pivoted forward, a triangle of forces is consequently obtained between the stub 320.7, the joint 320.12 and the adjusting notch 330.14 with a non-vanishing area. It follows from this that the force of the spring mechanism 320.9 is eccentrically supported by means of the adjusting notch 330.14 of the supporting lever 330.1 on the pendulous mass 320.13 in such a way as to result in a turning moment on the supporting lever 330.1 with respect to the stub 330.4, with the effect of aligning the supporting lever 330.1 with respect to a perpendicular to the surface of the ski 301.1. In the course of the adjusting process, the area of the triangle of forces acting increases until the triangle of forces 360 according to the representation of FIG. 4*b* is reached. On account of the arcuate guide 330.8, when the supporting lever 330.1 is pivoted about the stub 330.4, the longitudinal end 320.16 of the guide arm 320.14 is displaced rearward, for which reason the lever arm 320.8 is likewise pivoted rearward by the guide arm 320.14. The arcuate guide 330.8 is in this case formed in such a way that the lever arm 320.8 is in a vertical position, i.e. parallel to a direction of gravitational force, when the climbing angle of the current supporting position corresponds to the desired climbing angle. The lever arm 320.8 consequently represents a reference element of the adjusting device 320, which in a given supporting position of the supporting device reproduces an associated neutral position of the ski 301.

A comparison of the current inclination of the ski 301 with the neutral position is obtained in the present embodiment by the pendulum joint 320.12 being located in a corresponding position in dependence on a pivoting position of the lever element 320.8. On the basis of the position of the point of suspension of the pendulous mass 320.13, dependent on the pivoting position of the lever element 320.8, a detent notch or adjusting notch that can be reached on account of the pendulous mass 320.13 settling into the perpendicular position depends both on the neutral position and on an alignment of the pendulous mass 320.13. A spacing of the adjusting notches and detent notches then provides the criterion by which an adjusting process is initiated.

In the representation of FIG. 4*b*, the supporting lever 330.1 has therefore been adjusted into a new supporting position in comparison with the representation of FIG. 4*a*. In particular, the longitudinal axis K has been stood up from the position K.1 of FIG. 4*a* to a perpendicular to the surface of the ski 301.1.

FIG. 4*c* shows a perspective exterior view of the supporting lever 330.1 with parts of the adjusting device 320 without base part 320.1. In particular, receptacles 330.17 formed on the supporting lever 330.1 are provided for 4 support elements (not represented) for a ski boot carrier (for example cross bars or cross plates). A fifth support element with the smallest climbing angle is formed here by the stub 330.4 or the lever arm 320.4.

Figure 5A:
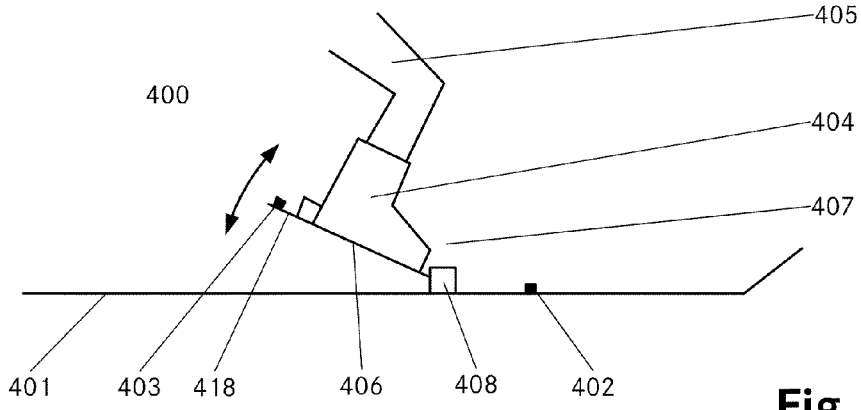
FIG. 5*a* a test setup for determining the accelerations occurring during a climbing-walking movement.
Figure 5B:
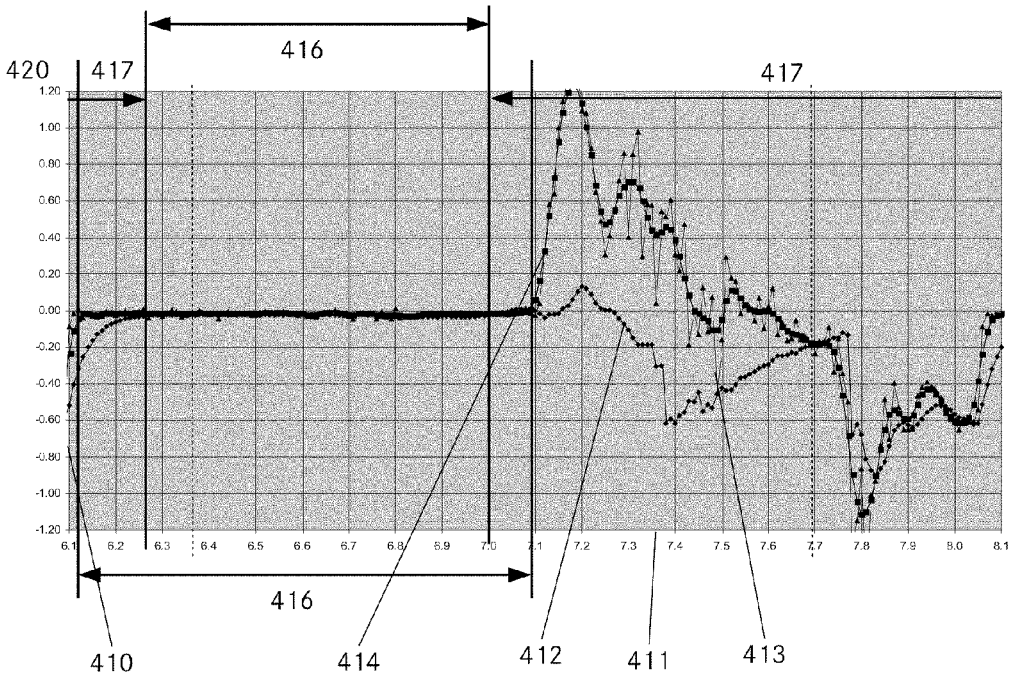
FIG. 5*b* acceleration-time diagrams of the sequence of movements when carrying out the climbing-walking movement.

FIG. 5*a* shows a test setup 400 for determining the movements of a ski 401 or a ski boot carrier 406 of a conventional cross-country ski binding 407 mounted on the ski 401. FIG. 5*b* shows a movement diagram of a walking test conducted by the applicant with the cross-country ski binding 407 using the arrangement 400. Respectively attached to the ski 401 and in the heel region 418 of a ski boot carrier 406 holding a boot 404 of the ski 405 is an acceleration or movement sensor 402 and 403.

The diagram 420 of FIG. 5*b* in this case shows the signals of the movement sensors 402 and 403 as a function of time when carrying out a walking movement during climbing as in cross-country skiing. In the course of the climbing movement, the ski boot carrier 406 is periodically lowered onto the ski 401 and raised again about a transverse pin on a front base part 408 of the binding 407 in the heel region 418.

The X axis 410 shows a time period of approximately 2 seconds, beginning at a value of 6.1 seconds. The initial value has in this case been chosen largely arbitrarily with respect to a beginning of the test and the time period of 2 seconds substantially comprises a complete step when the climbing movement is carried out. Plotted on the Y axis 411 is the measured acceleration in units of gravitational acceleration g, a value range of −1.2 g to +1.2 g being represented.

The sensor 403 on the ski boot carrier 406 is damped as from a frequency of 6 Hz and consequently produces a comparatively smooth signal (graph 412 with rhombic dots). The sensor 402 on the ski 401 is only damped as from a frequency of 50 Hz, for which reason a comparatively noisy signal 413 is obtained (graph 413 with triangles). The signal 413 of the sensor 402 has therefore been computationally damped and represented as graph 414 (graph 414 with squares).

As can be seen from the graph 414 of the diagram 420, the ski 401 is largely at rest or unaccelerated in the time period 415 from approximately 6.12 to 7.1 seconds, that is for approximately 1 second. Any offsets from a neutral position are caused here by the test setup. The heel region 418 of the ski boot carrier 406 is in this case unaccelerated or at rest in the time period 416 from approximately 6.27 to 7.00 seconds, that is for approximately 0.7 of a second. Consequently, on the one hand the ski 401 is at rest for longer than the boot 404 and on the other hand the time period 416 in which the boot 404 is at rest comprises the time period 415 in which the ski 401 is at rest. In the time period 417 between 6.1 and 6.27 seconds and a 7.0 and 8.1 seconds, the walking step takes place, in which step the boot 404 or the ski boot carrier 406 is lifted off away from the ski 401 and lowered again in the direction of the ski 401.

If an adjusting device according to the invention is formed in such a way that it is kept in an actuated state during the lowered state of the boot 404, it is consequently ensured that the ski 401 is at rest during the actuated time period 416. A measuring process possibly carried out in this time period 416 consequently allows an exact determination of the current inclination on the basis of a measurement of the direction of gravitational acceleration, without disturbing influences of accelerations occurring as a result of the climbing movement.

Figure 6A:
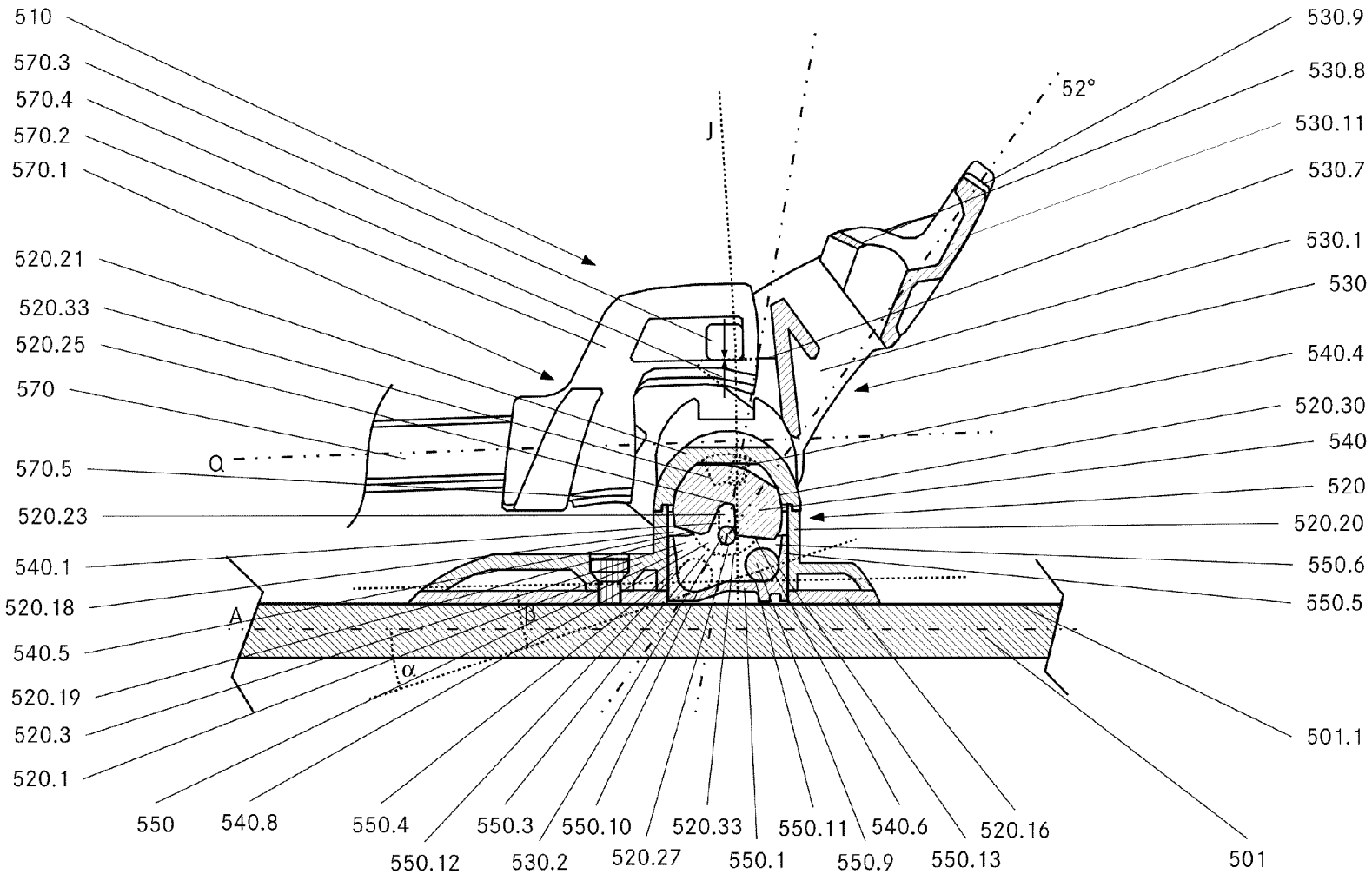
FIG. 6*a* a further exemplary embodiment of a climbing aid device according to the invention in the actuated state.

FIG. 6*a* shows a further exemplary embodiment of a climbing aid device 510 according to the invention, which is mounted on a ski 501. The representation shows a schematic cross-sectional view in the longitudinal center plane G of the ski 501 perpendicular to the ski. The climbing aid 510 comprises an adjusting device 520 and a supporting device 530 coupled to the latter. The adjusting device 520 or the climbing aid 510 in this case comprises a base part 520.1 with a base plate 520.16, with which the base part 520.1 is fastened to the ski 501. The base plate 520.16 is in this case arranged parallel to a surface 501.1 of the ski 501. The supporting device 530 is formed as a supporting lever 530.1, which is pivotably articulated on the base part 520.1 in the longitudinal direction of the ski A. For this purpose, the supporting lever 530.1 is mounted on the base part 520.1 by means of a pin 530.2.

With increasing distance from the pivot pin 530.2, the supporting lever 530.1 has a number of support surfaces 530.6 to 530.9 for supporting a ski boot carrier 570 or a ski boot. The climbing aid 510 is arranged on the ski 501 in such a way that, depending on the pivoting position of the supporting lever 530.1, one of the support surfaces 530.6 to 530.9 can be pivoted into the pivoting path J of an end region 570.1 of the ski boot carrier 570. In this case it is not necessary for a ski boot carrier 570 to be provided. The climbing aid 510 can also be positioned in such a way that the support surfaces 530.6 to 530.9 can be pivoted directly into the path of movement of a heel region of a ski boot, for example in the case of a Telemark binding or cross-country bindings, which do not have a ski boot carrier.

The supporting device 530 of the present embodiment has 4 supporting positions 530.10 to 530.13 (see FIG. 6*b*), of which 2 supporting positions 530.11 and 530.12 can be operated by the adjusting device 520. In the 4 supporting positions 530.10 to 530.13, a longitudinal direction U of the supporting lever 530.1 forms the following angles with the base plate 520.16 in the plane G: 0° (530.10), 52° (530.11), 78° (530.12) and 104° (530.13). A further position 530.14 of the supporting device 530 corresponds to a release position, in which the ski boot carrier 570 is completely pivotable in a lowerable manner. In the position 530.14, the longitudinal direction U of the supporting lever 530.10 forms an angle of 26° with the base plate 520.16. The supporting position 530.10 has a dual function: on the one hand, it serves as a supporting position for supporting the ski boot carrier 570 with a support surface 530.6. On the other hand, it is also a locking position for locking the ski boot carrier 570 in the completely lowered state, for example for downhill skiing. Projections 530.18 and 530.19, on which the support surface 530.6 is formed, engage over a support element 570.3 of the ski boot carrier 570 in the locked position and consequently fix said element in the lowered position (see FIG. 7*c*).

The climbing aid 510 here comprises a catch device 590, which makes it possible for the supporting lever 530.1 to engage in the various positions 530.10-530.14. This catch device 590 is explained in more detail on the basis of FIGS. 8 and 9*a*.

The representation of FIG. 6*a* shows the climbing aid 510 in a state in which the supporting device 530 is in the first supporting position 530.11 that can be adjusted by the adjusting device 520, while FIG. 6*b*, described further below, shows the supporting device 530 in the second supporting position 530.12 that is operated by the adjusting device 520.

In the position of FIG. 6*a*, the support surface 530.7 has been pivoted into the path of movement of the end region 570.1 of the ski boot carrier 570. In the end region 570.1, the ski boot carrier 570 has an end piece 570.2, which has the support element 570.3, which is displaceably mounted in the longitudinal direction Q of the ski boot carrier 570 on the latter, against a spring force. Moreover, the end piece 570.2 has a support surface 570.4, which is fixed to the ski boot carrier and is formed on the ski side, and also a further support surface 570.5, which is fixed to the ski boot carrier and arranged such that it is offset forward and is lower with respect to a longitudinal axis Q of the ski boot carrier. The support surfaces 570.3 to 570.5 are explained in more detail further below in conjunction with the supporting lever 630.1 represented in FIG. 9.

The base part 520.1 comprises two side plates 520.17 and 520.18, which extend upward away from the ski 501 in a perpendicular direction from the base plate 520.16 and are arranged laterally parallel to the longitudinal center plane G of the ski 501. An upper end remote from the ski of the respective side plate 520.17 and 520.18 has a semicircular outline, which goes over smoothly into straight portions of the outline, which reach as far as the base plate 520.16. The side plates 520.17 to 520.18 are connected by a front and a rear side wall 520.19 and 520.20 in the direction transverse to the longitudinal axis of the ski A. The inner space 520.3 formed in this way of the base part 520 is closed from above by a cover element 520.21.

The base plate 520.16 has an aperture, which corresponds to a cross section of the inner space 520.3 that is parallel to the base plate and is arranged under the inner space 520.3, so that the inner space 520.3 continues as far as the surface of the ski 501.1. The cover element 520.21 comprises a largely semicircular round profile, which is arranged transversely to the longitudinal direction of the ski A. The cover element 520.21 rests on upper sides of the front and rear side walls 520.19 and

520.20 and also on the upper sides of the side plates 520.17 to 520.18, whereby the inner space 520.3 is closed in the upward direction.

Formed in the side plates 520.17 and 520.18 are slots 520.22 and 520.23, which are aligned in a direction perpendicular to the base plate 520.16, are in line with one another and through which the pin 530.2 passes. The slots 520.22 and 520.23 have stops 520.24 and 520.25 remote from the base plate and stops 520.26 and 520.27 near the base plate. The pin 530.2 is mounted on the base plate 520.1 such that it is displaceably guided in the slots 520.22 and 520.23 in a direction perpendicular to the ski or in a direction perpendicular to the base plate 520.16, the stops 520.24 and 520.25 as well as 520.26 and 520.27 limiting the path of displacement.

The supporting lever 530.1 has in a base region 530.23 near the base part two side plates 530.28 and 530.29, with which it engages around the outside of the side plates 520.17 and 520.18 of the base part 520.1 on both sides. The supporting lever 530.1 is mounted on the pin 530.2. The supporting lever 530.1 is consequently mounted together with the pin 530.2 such that it is displaceable in a direction perpendicular to the ski on the base part 520 and pivotable about the pin 530.2. The pin 530.2 is in this case subjected to a spring force in an upward direction away from the base plate 520.16 by springs 520.36 and 520.37 arranged in receiving spaces 520.34 and 520.35 of the side plates 520.17 and 520.18 (see in this respect FIGS. 7*a*-7*c*). The springs 520.36 and 520.37 are respectively supported on the base plate 520.16 and on the pin 530.2. An amount of the spring force in this case preferably lies in a range of approximately 200 N. The spring force has the effect that, when no external forces are acting, the pin 530.2 in the slots 520.22 and 520.23 lies against the stops 520.24 and 520.25 remote from the base plate.

In the representation of FIG. 6*a*, loading is applied to the supporting lever 530.1, for example by the weight of a user, via the support surface 530.7 through the support element 570.3 of the ski boot carrier 570. The loading in this case exceeds the spring force to which the pin 530.2 is subjected, as a result of which the pin 530.2 has been displaced (together with the supporting lever 530.1) completely downward as far as the stops 520.26 and 520.27.

Arranged in the inner space 520.3 is an adjusting element 540, which comprises a switching element 540.10, which is centrally formed on the adjusting element 540 transversely to the longitudinal axis of the ski A and has in the plane G a substantially circular cross section. An outside diameter of the switching element 540.10 in the plane G largely corresponds in this case to an inner annular curvature of the cover element 520.21. The adjusting element 540 follows the contour of an inner wall 520.30 of the cover element 520.21 and is consequently supported rotatably in an upward direction on the cover element 520.21. Respectively formed on projections on the inside of the side plates 520.17 to 520.18 are upwardly open semicircular bearing surfaces 520.28 and 520.29 (represented by broken lines), in which the adjusting element 540 is supported in the direction of the base plate 520.16 by means of circular bearing disks 540.7 and 540.8. The bearing surfaces 520.28 and 520.29 form together with the inner wall 520.30 of the cover element 520.21 a rotary bearing for the adjusting element 540. A geometrical axis of rotation T of the adjusting element 540 is in this case arranged in the transverse direction in relation to the longitudinal axis of the ski A in such a way that it coincides with the pin 530.2 when the latter lies against the stops 520.24 and 520.25 remote from the base plate of the slots 520.22 and 520.23.

The switching element 540.10 of the adjusting element 540 has a clearance 540.1 for the pin 530.2. The clearance 540.1 is continuously open in the direction of the axis of rotation T and toward the base plate 520.16 and is formed as a segmental clearance 540.1 in the region of the line between the slots 520.22 and 520.23. The bearing disks 540.7 and 540.8 have corresponding clearances 540.12 and 540.13, which however are closed with respect to the base plate 520.16. The clearances 540.1, 540.12 and 540.13 are in line with one another in the direction of the axis of rotation T, so that the pin 530.2 can pass through unhindered.

The clearance 540.1 ensures that displaceability of the pin 530.2 in the slots 520.22 and 520.23 is ensured even when the adjusting element 540 is rotated. The rotatability of the adjusting element 540, in which the pin 530.2 is displaceable, is in this case predetermined by the apex angle of the segmental clearance 540.1, which in the embodiment represented is approximately 25 degrees. A radial dimension of the clearance with respect to the axis of rotation T corresponds at least to a length of the slots 520.22 and 520.23.

The side plates 520.17 and 520.18 respectively have a clearance 520.32 and 520.33 (represented by broken lines), through which a driver 540.3 and 540.4 of the adjusting element 540 respectively protrudes out of the inner space 520.3 outwardly on both sides in the direction of the axis of rotation of the adjusting element 540. The clearances 520.32 and 520.33 are configured in the form of annular segments, so that the drivers 540.3 and 540.4 can be moved along at the same time within the limits of the rotatability described above of the adjusting element 540. In actual fact this means that the angular range covered by the segmental clearances 520.32 and 520.33 with respect to the axis of rotation T of the adjusting element 540 largely corresponds to the apex angle of the segmental clearance 540.1 of the adjusting element 540. The drivers 540.3 and 540.4 are in this case arranged in a region which lies above the axis of rotation T of the adjusting element 540 with respect to the base plate 520.16. The clearances 520.32 and 520.33 are symmetrically formed at the upper longitudinal end of the side plates 520.17 and 520.18 with respect to a plane S that is arranged perpendicular to the longitudinal direction of the ski A and in which the axis of rotation T of the adjusting element 540 lies.

The drivers 540.3 and 540.4 can in this case engage in corresponding detent notches 530.15 and 530.16 of the supporting lever 530.1 (also see FIG. 9). In the supporting position 530.11 of the supporting lever 530.1 of FIG. 6*a*, the drivers 540.3 and 540.4 are in engagement with the detent notches 530.15 and 530.16. When there is rotation of the adjusting element 540, the drivers 540.3 and 540.4 take the supporting lever 530.1 along with them on account of the engagement in the detent notches 530.15 and 530.16. The supporting lever 530.1 is consequently pivoted about the pin 530.2 when there is rotation of the adjusting element 540. The detent notches 530.15 and 530.16 are configured in such a way that the drivers 540.3 and 540.4 remain in engagement with the detent notches 530.15 and 530.16 when there is a displacement of the supporting lever 530.1 in a direction perpendicular to the ski (also see in this respect FIGS. 7*a*-7*b* and 9).

On an underside of the adjusting element 540, arranged toward the base plate 520.16, a front and a rear switching surface 540.5 and 540.6 are formed in the longitudinal direction A on both sides of the segmental clearance 540.1. When a force acts on one of the switching surfaces 540.5 and 540.6 from below in the direction away from the base plate 520.16, a rotation of the adjusting element 540 in the corresponding direction can be brought about. When a force acts from below on the front switching surface 540.5, a rotation of the adjusting element 540 that moves the drivers 540.3 and 540.4 rearward in the clearances 530.32 and 530.33 takes place and, when a force acts from below on the rear switching surface 540.6, a rotation that moves the drivers 540.3 and 540.4 forward takes place.

On account of the relative arrangement of the axis of rotation T of the adjusting element 540, the drivers 540.3 and 540.4 and also the pin 530.2 of the supporting element 530.1, a forward pivoting of the supporting lever 530.1 takes place when there is a forward movement of the drivers 540.3 and 540.4 and, by analogy, a rearward pivoting takes place when there is a rearward movement of the drivers 540.3 and 540.4.

Within the inner space 520.3, a carrier element 550 is arranged under the adjusting element 540. The carrier element 550 is formed in a largely cuboidal manner and has a bottom 550.1, two lateral side walls 550.2 and 550.3 and a front and a rear side wall 550.4 and 550.5. On an upper side remote from the base plate, the carrier element 550 is open, so that an upwardly open, largely cuboidal inner space 550.6 is obtained. A longitudinal axis of the carrier element 550 is aligned in the longitudinal direction of the ski A. The carrier element 550 has on the outside a length that corresponds to an inner distance between the front side wall 520.19 and the rear side wall 520.20 of the base part 520.1. In the transverse direction, the carrier element 550 has a width that largely corresponds to an inner distance between the side plates 520.17 and 520.18. The carrier element 550 and also the inner space 520.3 of the base part 520.1 are in this case configured in such a way that the carrier element 550 is displaceable in a direction perpendicular to the ski and in a direction perpendicular to the base plate 520.16. For this purpose, guide rails 520.38 and 520.39 which are perpendicular to the base plate and in which lateral projections 550.14 and 550.15 of the carrier element 550 engage for guidance are formed on the inner side of the side plates 520.17 and 520.18.

The carrier element 550 is mounted on the pin 530.2 by means of the lateral side walls 550.2 and 550.3. When the pin 530.2 is lowered, the carrier element 550 is consequently also lowered and, conversely, it is raised along with the pin 530.2. The carrier element 550 and the supporting lever 530.1 are consequently forcibly coupled by the pin 530.2 with respect to a displacement perpendicular to the ski in relation to the base part 520.1. The carrier element 550 is represented in detail in FIGS. 10*a* to 10*c*.

As already mentioned above, in the representation of FIG. 6*a* the supporting lever 530.1 is loaded with a force toward the ski 501 via the ski boot carrier 570 and is lowered completely toward the ski 501 together with the pin 530.2 in the slots 520.22 and 520.23. The carrier element 550 has therefore likewise been lowered completely toward the base plate 520.16 or toward the ski 501, into a measuring position.

Provided in the inner space 550.6 of the carrier element 550 is a rolling body, in the representation of FIG. 6*a* a gravity element formed as a ball 550.9. A diameter of the ball 550.9 largely corresponds to a width of the inner space 550.6 of the carrier element 550, while a length of the inner space 550.6 corresponds to approximately 3 ball diameters. The ball 550.9 is consequently mounted such that it can move freely, that is to say can roll, in the inner space 550.6 of the carrier element 550. The front and rear side walls 550.4 and 550.5 of the carrier element 550 respectively form a stop for the ball 550.9 in the longitudinal direction. A position of the ball 550.9 at the front side wall 550.4 in this case corresponds to a front adjusting position 550.12 (represented by broken lines) and a position at the rear side wall 550.5 corresponds to a rear adjusting position 550.13. The adjusting positions 550.12 and 550.13 are in this case arranged in the adjusting device 520 in such a way that the ball 550.9 in the respective adjusting position 550.12 and 550.13 is arranged under the corresponding front and rear switching surface 540.5 and 540.6 of the adjusting element 540.

In the inner space 550.6, the bottom 550.1 of the carrier element 550 is made to slope in a portion 550.10 in the front half, and descends in the forward direction. The slope of the front portion 550.10 is approximately $\alpha=-16$ degrees with respect to the base plate 520.16 or a surface 501.1 of the ski 501. In a rear half, a portion 550.11 of the bottom 550.1 of the carrier element 550 is likewise inclined forward and is aligned by an angle of approximately $\epsilon=2$ degrees in relation to the base plate 520.16, whereby a differential angle between the two portions 550.11 and 550.12 of $\beta=14$ degrees is obtained.

It is ensured by the sloping portions 550.10 and 550.11 of the bottom 550.1 of the carrier element 550 that the ball 550.9 only rolls from the front adjusting position 550.12 into the rear adjusting position 550.13 when a longitudinal inclination of the ski 501 exceeds the angle of inclination of the front portion 550.10, i.e. in this case exceeds 16 degrees. Similarly, the inclination of the rear portion 550.11 ensures that the ball 550.9 rolls from the rear adjusting position into the front adjusting position 550.12 when a longitudinal inclination of the ski is less than the inclination of the rear portion 550.11, i.e. in the present case 2 degrees. The inclined portions 550.10 and 550.11 consequently correspond to current neutral positions of the ski 501 that are associated with the adjusting positions 550.12 and 550.13.

In the representation of FIG. 6*a*, the ball 550.9 is arranged in the rear adjusting position, i.e. a longitudinal inclination of the ski 501 is greater than the inclination of the front portion 550.10 of the bottom 550.1 of the carrier element 550.

Figure 6B:
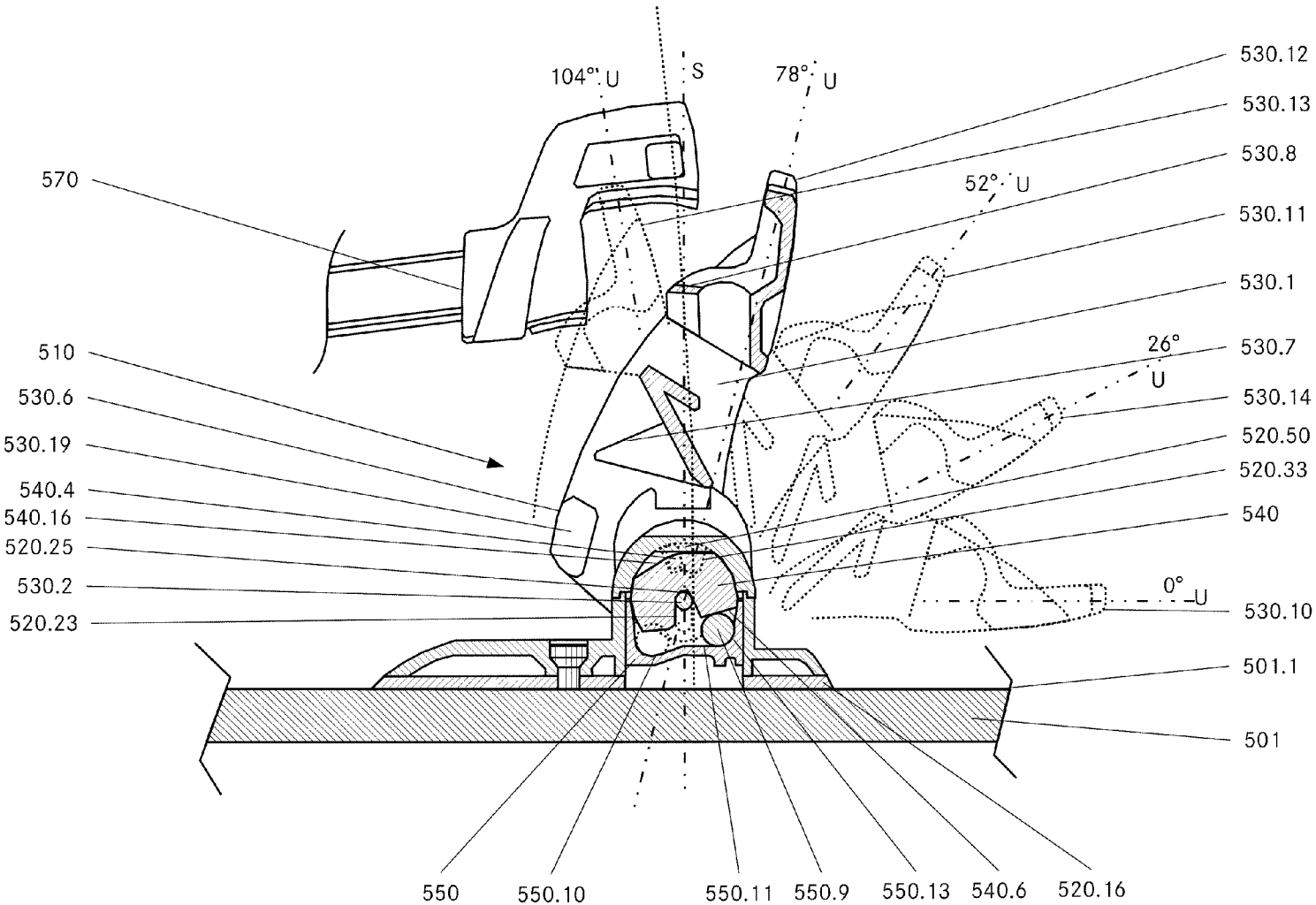
FIG. 6*b* the climbing aid device of FIG. 6*a* after an adjusting process.

FIG. 6*b* shows the climbing aid 510 in a state after an adjusting process has taken place, on the basis of the representation of FIG. 6*a*, as a result of relieving the supporting lever 530.1 of loading.

Lifting the ski boot carrier 570 off the supporting lever 530.1 has the effect that no external forces act on the climbing aid 510. On account of the spring force, the pin 530.2 is displaced in the slots 520.22 and 520.23 upward away from the base plate 520.16 against the stops 520.24 and 520.25. With the pin 530.2, the supporting lever 530.1 mounted on it and the carrier element 550 are also displaced upward from the base plate 520.16.

During the adjusting process, the carrier element 550 is raised away from the base plate 520.16 into a switching position by means of the pin 530.2 subjected to the spring force. In the switching position, the pin 530.2 lies against the stops 520.24 and 520.25 remote from the base plate of the slots 520.22 and 520.23. In the course of the adjusting process, the ball 550.9, which is mounted in the carrier element 550 and in the representation of FIG. 6*a* is in the rear adjusting position 550.13, is pressed by the spring force against the switching surface 540.6. As a result of the force therefore acting on the switching surface 540.6 from below, a rotation of the adjusting element 540 is brought about. With the adjusting element 540, the drivers 540.3 and 540.4 are rotated forward in the clearances 520.32 and 520.33 and, on account of the engagement in the detent notches 530.15 and 530.16, thereby take the supporting lever 530.1 along with them. Consequently, during the adjusting process, the supporting lever 530.1 is tilted forward about the pin 530.2 and brought into a second supporting position 530.12 that is operated by the adjusting device 520.

In the new supporting position 530.12, the support surface 530.8 has been pivoted into the path of movement J. The support surface 530.8 is in this case at a greater distance from the pin 530.2 than the support surface 530.7 of the supporting position 530.11 and limits a lowering movement of the ski boot carrier 570 higher above the surface of the ski 501.1 than the support surface 530.7. The new supporting position 530.12 therefore corresponds to a greater desired climbing angle.

In the switching position of the carrier element 550 after the adjusting process, with the supporting lever 530.1 relieved of loading, the ball 550.9 is arranged between the switching surface 540.6 and the rear portion 550.11 of the bottom 550.1 of the carrier element 550. The switching surface 540.6 blocks the ball 550.9 in the rear adjusting position 550.13, so that the ball 550.9 can no longer roll in the longitudinal direction in the inner space 550.6.

The following possible sequences are not represented in the figures and serve to explain possible adjusting processes in cases where the supporting lever 530.1 is subjected to or relieved of further loading by the user (for example when further climbing steps are carried out with a cross-country binding). If, starting from the state of the climbing aid in FIG. 6*b*, the supporting lever 530.1 is loaded once again by the ski boot carrier 570, the carrier element 550 is brought from the switching position into the measuring position. In this case, the pin 530.2 is lowered against the spring force as far as the stops 520.26 and 520.27 of the slots 520.22 and 520.23, the supporting lever 530.1 and the carrier element 550 with the ball 550.9 in it being correspondingly lowered. The ball 550.9 is lowered from the switching surface 540.6 and consequently released again, so that it can align itself in the inner space 550.6 of the carrier element 550 in accordance with the current effect of a gravitational force.

On the basis of the representation of FIG. 6*b*, the following two cases may occur when the climbing aid 510 is once again subjected to loading or relieved of loading.

1) A longitudinal inclination of the ski 501 has not changed in comparison with the situation in FIG. 6*a*. In this case, the released ball 550.9 experiences the same current effect of a gravitational force as in FIG. 6*a* and remains in the adjusting position 550.13. If the supporting lever 530.1 is again relieved of loading by the ski boot carrier 570 being lifted off, in this case no adjusting process is initiated, since the adjusting element 540 has already correspondingly rotated. After the supporting lever 530.1 is again relieved of loading, the ball 550.9 is again blocked in the adjusting position 550.13, between the switching surface 540.6 and the rear bottom portion 550.11 of the carrier element 550, and the supporting lever 530.1 remains in the supporting position 530.12.

2) A longitudinal inclination of the ski 501 is reduced in comparison with the situation in FIG. 6*a*. In this case, the released ball 550.9 experiences the effect of a gravitational force in a different direction than in FIG. 6*a*. If the change in the longitudinal inclination of the ski is sufficiently great, the ball 550.9 rolls into the front adjusting position 550.12. When the supporting lever 530.1 is again relieved of loading, in this case a further adjusting process is initiated. When the loading is relieved, the carrier element 550 is brought from the measuring position into the switching position, i.e. is raised away from the base plate 520.16, on account of the spring force. In this case, the ball 550.9, which is then in the front adjusting position 550.12, is pressed from the base plate 520.16 against the front switching surface 540.5 by the spring force via the pin 530.2 and the carrier element 550. As a result of the force acting from below on the front switching surface 540.5 in this way, the adjusting element 540 is rotated back, counter to the rotation in the previous adjusting process described above. The drivers 540.3 and 540.4 are rotated rearward in the clearances 520.32 and 520.33 and thereby take the supporting lever 530.1 with them on account of the engagement in the detent notches 530.15 and 530.16. During the adjusting process, the supporting lever 530.1 is tilted rearward about the pin 530.2 and brought into the supporting position 520.11 (FIG. 6*a*), i.e. the support surface 530.7 has been pivoted into the path of movement J. The ball 550.9, which is in the front adjusting position 550.12, is then blocked between the front portion 550.10 of the bottom 550.3 of the carrier element 550 and the switching surface 540.5. If the longitudinal inclination of the ski 501 does not change by the time the supporting lever 530.1 is next subjected to loading, the ball remains in the front adjusting position 550.12 and no adjusting process is initiated even when loading is again relieved.

The front adjusting position of the ball 550.9 consequently corresponds to the further rearwardly pivoted supporting position 530.11 of the supporting lever 530.1 and the rear adjusting position 550.13 corresponds to the further forwardly pivoted supporting position 530.12. If the ball 550.9 is in an adjusting position that does not correspond to the current supporting position, an adjusting process takes place when the supporting lever 530.1 is relieved of loading. If, on the other hand, the ball 550.9 is in the adjusting position that is assigned to the current supporting position, no adjusting process takes place. The lowering of the carrier element 550 from the switching position into the measuring position has the effect of releasing the ball 550.9 and allowing it to assume one of the adjusting positions 550.12 or 550.13 in accordance with a current direction of gravitational force. After raising of the carrier element 550 from the measuring position into the switching position, with the supporting lever 530.1 being relieved of loading, the ball 550.9 is blocked in the current adjusting position, irrespective of whether or not an adjusting process has taken place. In other words, the adjusting device 520 functions as a gravitational-force-dependent toggle switch mechanism which can switch a pivoting position of the supporting lever 530.1 back and forth between at least two supporting positions in dependence on a current direction of gravitational force.

Figure 7B:
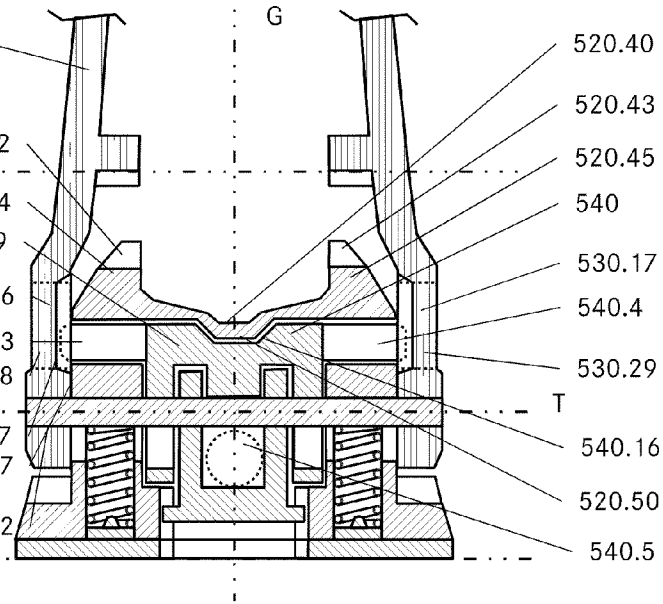
FIG. 7*b* a cross-sectional view of the climbing aid device of FIG. 6*b;*
Figure 7A:
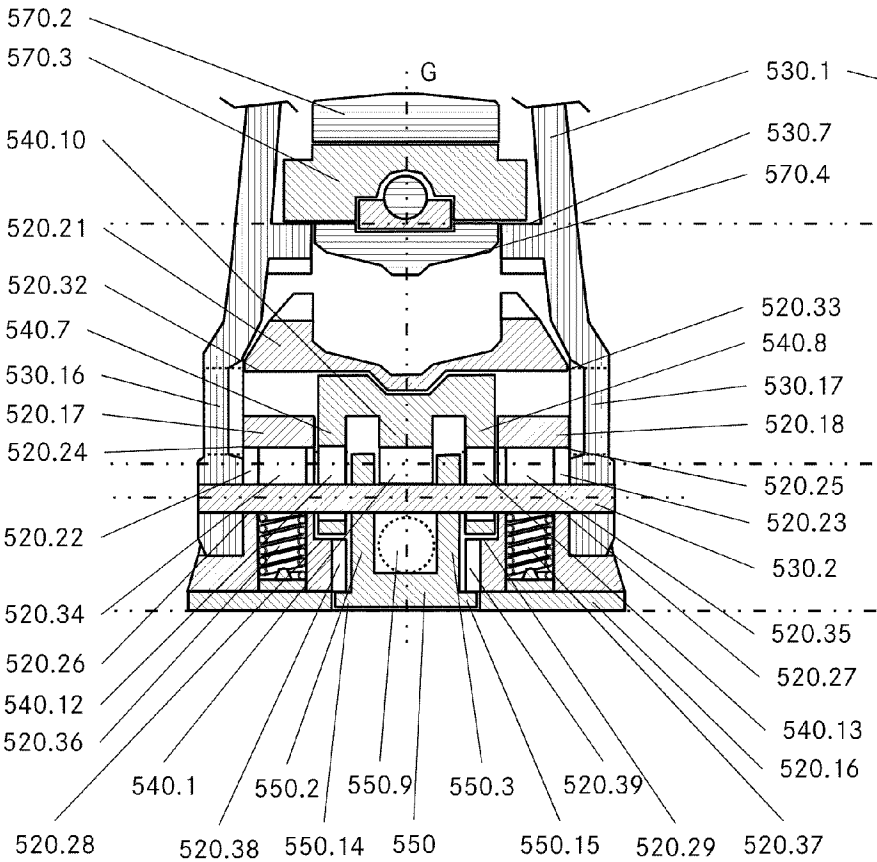
FIG. 7*a* a cross-sectional view of the climbing aid device of FIG. 6*a;*

FIG. 7*a* shows a sectional view of the climbing aid 510 in the plane S, which is perpendicular to the longitudinal direction A of the ski and in which the axis of rotation T of the adjusting element 540 and the pin 530.2 are arranged. The climbing aid 510 is in this case in a state corresponding to the representation of FIG. 6*a*. FIG. 7*b* shows a corresponding sectional view in the plane S of the representation of FIG. 6*b*. Hereafter, FIGS. 7*a* and 7*b* are described together. The supporting lever 530.1 is only schematically indicated in the views of FIGS. 7*a* and 7*b*. In particular, the support surface 530.7 is only indicated as a projection and does not correspond in detail to the representation of FIGS. 6*a* and 6*b*.

It can be seen in the cross-sectional view of FIG. 7*b* that the adjusting element 540 has an elongate, half-barreled cross member 540.9, which is arranged in the direction of the axis of rotation T and respectively goes over at the ends into the drivers 540.3 and 540.4. Formed midway along the cross member 540.9, perpendicularly to the cross member 540.9, is the switching element 540.10 in the form of a circular disk. The cross member 540.9 is arranged in an upper peripheral region of the switching element 540.1 (as can also be gathered from the arrangement of the drivers 540.3 and 540.4 in FIG. 6*a*). The drivers 540.3 and 540.4 cannot be seen in FIG. 7*a*, because they are arranged in front of the cross-sectional plane S. Formed on an upper side of the cross member 540.9 is a guide recess 540.16, which is aligned in the longitudinal direction and in which there engages a corresponding guide lug 520.50 formed on the inner wall 520.30 of the cover element 520.21. On account of the guide lug 520.50 and the guide recess 540.16, a rotation of the adjusting element 540 on the base part 520.1 is additionally stabilized and guided. The adjusting element 540 is represented in detail in FIGS. 11 *a*-11 *c*.

The switching surfaces 540.5 and 540.6 and the segmental clearance 540.1 are formed on the switching element 540.10. In the direction of T on both sides of the switching element 540.10, the bearing disks 540.7 and 540.8 are formed on the cross member 540.9 at a distance from said switching element. The cross member 540.9 in this case extends in the direction of T from the bearing disks 540.7 to the bearing disks 540.8. A center point of the bearing disks 540.7 and 540.8 lies together with a center point of the switching element 540.10 and also an axis of the barreled cross member 540.9 on the axis of rotation T of the adjusting element 540. A distance of the bearing disks 540.7 and 540.8 from the switching element 540.10 is in this case dimensioned such that the lateral side walls 550.2 and 550.3 of the carrier element 550 can be introduced into the intermediate space. The bearing disks 540.7 and 540.8 have clearances 540.12 and 540.13, through which the pin 530.2 passes. By contrast with the clearance 540.1 of the switching element 540.9, the clearances 540.12 and 540.13 are closed toward the base plate 520.16, in order that a circumferential surface of the bearing disks 540.7 and 540.8 is continuously formed for good support on the bearing surfaces 520.26 and 520.27.

The bearing disks 540.7 and 540.8 are supported in the direction of the base plate 520.16 on the bearing surfaces 520.26 and 520.27 of the side plates 520.17 and 520.18. The drivers 540.3 and 540.4 of the adjusting element 540 are arranged in the clearances 520.32 and 520.33 of the side plates 520.17 and 520.18 and protrude on the outside, in relation to the plane G, to both sides beyond the side plates 520.17 and 520.18. In the supporting position 530.11 represented, the drivers 540.3 and 540.4 in this case engage in the detent notches 530.16 and 530.17 of the supporting lever 530.1.

Figure 7C:
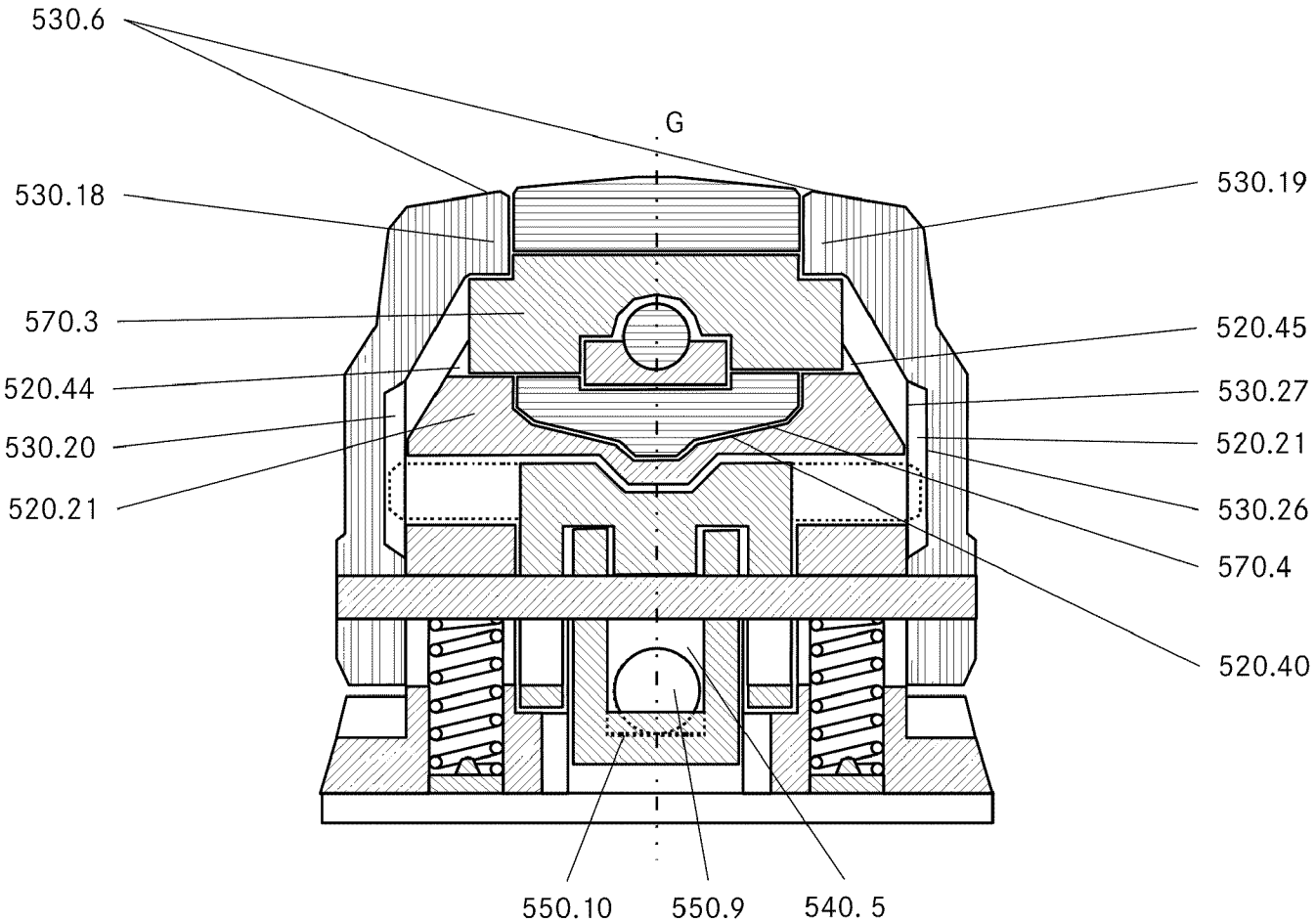
FIG. 7*c* a cross-sectional view of the climbing aid device of FIG. 6*a* in a locking position.

FIG. 7*c* shows the climbing aid 510 in the locking position, in which the ski boot carrier 570 has been completely lowered and is locked in this position by the supporting lever 530.1. The supporting lever 530.1 has in this case been pivoted into the position 530.10.

If the supporting lever 530.1 is in the position 530.14, in which the ski boot carrier 570 is released, it can be lowered completely onto the ski 501. The support surface 570.4 thereby comes to lie on a support surface 520.40 of a largely complementary form, which is formed on an upper side of the cover element 520.21 remote from the base plate. Formed on the cover element 520.21, on both sides of the plane G and largely parallel to the latter, are side plates 520.42 and 520.43, which respectively have on an upper side a detent notch 520.44 and 520.45 for the support element 570.3. With the ski boot carrier 570 completely lowered, the end piece 570.2 of the ski boot carrier 570 is partially arranged between the side plates 520.42 and 520.43 and the support element 570.3 rests in the detent notches 520.44 and 520.45. The support element 570.3 is secured against displacement in the longitudinal direction Q of the ski boot carrier 570 in the detent notches 520.44 and 520.45. The displaceable mounting of the support element 570.3 on the ski boot carrier 570 allows that the end piece 570.2 of the ski boot carrier 570 can be displaced with respect to the climbing aid 510 in the longitudinal direction of Q in spite of the engagement of the support element 570.3 in the detent notches 520.44 and 520.45. This ensures that the ski boot carrier 570 does not make the ski 501 rigid in the region of the ski binding. This ensures that the ski can bend freely, without it being possible for the support element 570.3 to slip from its support on the climbing aid 510.

With the ski boot carrier 570 completely lowered, the supporting lever 530.1 can be pivoted from the position 530.14 into the position 530.10 for locking. The projections 530.18 and 530.19 then engage over the support element 570.3 and secure it in the detent notches 520.44 and 520.45. The supporting lever 530.1 has depressions 530.20 and 530.21 on the inside, in the region of the drivers 540.3 and 540.4. The depressions 530.20 and 530.21 are dimensioned such that the drivers 540.3 and 540.4 in the position 530.10 no longer engage in the supporting lever 530.1, so that in this position there is no coupling between the adjusting device 520 and the supporting device 530. The exact way in which the detent notches 530.15 and 530.16 and also the catch device of the climbing aid 510 are formed is described on the basis of FIGS. 8 and 9*a* to 9*c*.

In the locking position, the carrier element 550 has been raised away from the ski 501 into the switching position, in the representation of 7*c* the ball 550.9 being in the front adjusting position 550.12. The ball 550.9 is consequently clamped between the front switching surface 540.5 of the adjusting element 540 and the front bottom portion 550.10, and is consequently blocked.

Figure 8:
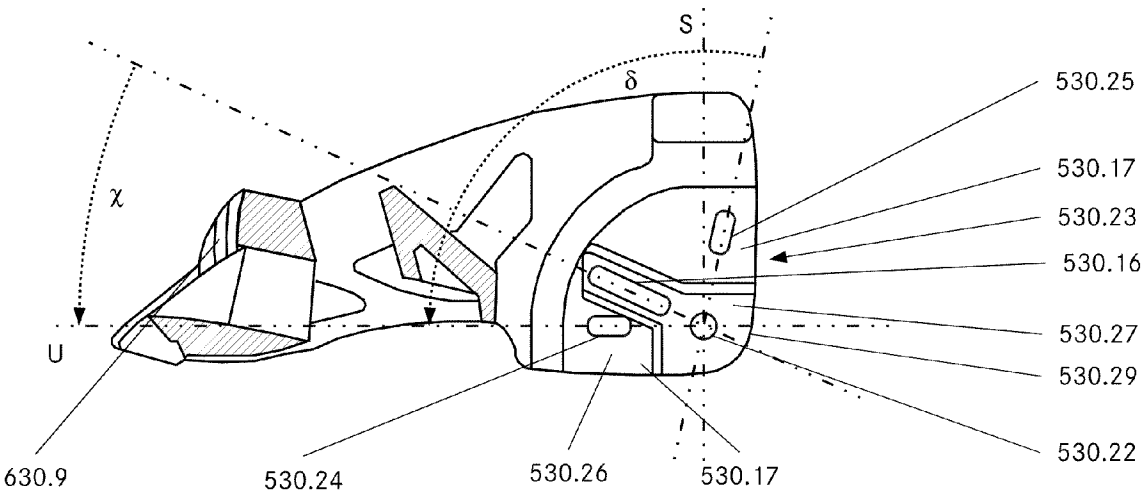
FIG. 8 a longitudinal cross section of a further embodiment of a supporting lever for a climbing aid device according to FIG. 6*a;*

FIG. 8 shows a further embodiment of a supporting lever 630.1 for a climbing aid 510 according to the invention in a longitudinal section of the plane R. The supporting lever 630.1 substantially differs from the supporting lever 530.1 described above by the arrangement of the support surfaces 530.8 and 530.9. Therefore, the same designations are used hereafter for parts which correspond to the configuration of the supporting lever 530.1.

The support surfaces 530.6 and 530.7 largely correspond to the configuration in the case of the supporting lever 530.1 of FIGS. 6*a* and 6*b*. Instead of two further support surfaces 530.8 and 530.9, however, the supporting lever 630.1 has only one further support surface 630.9. The support surface 630.9 is in this case arranged in such a way that, in a supporting position 530.12 of the supporting lever 630.1 corresponding to the supporting position 630.12, the support surface 630.9 has been pivoted into a path of movement of the support surface 570.4 of the ski boot carrier 570. In a further supporting position 630.13 of the supporting lever 630.1, corresponding to the supporting position 530.13, the same support surface 630.9 has been pivoted into the path of movement of the further support surface 570.5 of the ski boot carrier 570. Since, in the plane G, the support surface 570.4 is arranged above the longitudinal axis Q of the ski boot carrier 570 and the support surface 570.5 is arranged below the longitudinal axis Q of the ski boot carrier 570, two climbing stages with different climbing angles can consequently be provided with a support surface 630.9 on the supporting lever 630.1. In other words, in this case the support surfaces required for the desired climbing stages are no longer formed on the supporting lever alone but partly on the ski boot carrier and partly on the supporting lever. This achieves the effect that an overall total length of the supporting lever can be kept low and the climbing aid as a whole can consequently be formed more compactly.

In the base region 530.23, the supporting lever 630.1 has the side plates 530.28 and 530.29, which, in the state in which it is provided on the base part 520.1, partially engage around the side plates 520.18 and 520.19 of the base part 520.1. Formed on the side plate 530.29 is the detent notch 530.16. The detent notch 530.16 is formed as a slot which extends radially with respect to a bearing hole 530.22 for the pin 530.2. The detent notch 530.16 has a length which makes it possible for the driver 540.3 to be displaced in the detent notch 530.16 during the lowering of the supporting lever 530.1 or 630.1 on the base part 520.1. Two further detent notches 530.24 and 530.25 are formed as shorter slots, which are likewise arranged radially with respect to the bearing hole 530.22.

The detent notch 530.24 is in this case aligned with its longitudinal axis along the longitudinal axis U of the supporting lever 630.1 (or 530.1). The detent notch 530.16 is formed such that it is turned with its longitudinal axis in relation to the longitudinal axis U about the bearing hole 530.22 by an angle $\lambda$=25 degrees. A longitudinal axis of the detent notch 530.25, on the other hand, is turned in relation to the longitudinal axis U with respect to the bearing hole 530.22 by an angle $\delta$=103 degrees.

Formed on an inner surface 530.26, in the base region 530.23, is a support surface 530.27, with which the supporting lever 630.1 or 530.1 lies against an outer side of the side plates 520.18 and 520.19 in the base part 520.1 when it is in the state in which it is provided on the base part 520.1. The support surface 530.27 in this case extends in a region around the bearing hole 530.22 and the detent notch 530.16. The support surface 530.27 is aligned parallel to the plane G and is raised with respect to a remaining region 530.17 of the inner surface 530.26. A surface forming the remaining region 530.17 lies parallel to the support surface 530.27 and is offset outward in relation to the plane G with respect to the support surface 530.27. The detent notches 530.24 and 530.25 are arranged in the region 530.17 and are consequently likewise offset outward in relation to the plane G with respect to the detent notch 530.16. On account of the raised nature of the support surface 530.27, the depressions 530.20 and 530.21 described in FIG. 7*a*-7*c* are consequently obtained. It goes without saying that corresponding elements are also formed on the side plate 530.29. The detent notches 530.16 and 530.24 and 530.25 are associated with the catch device 590.

Figure 9A:
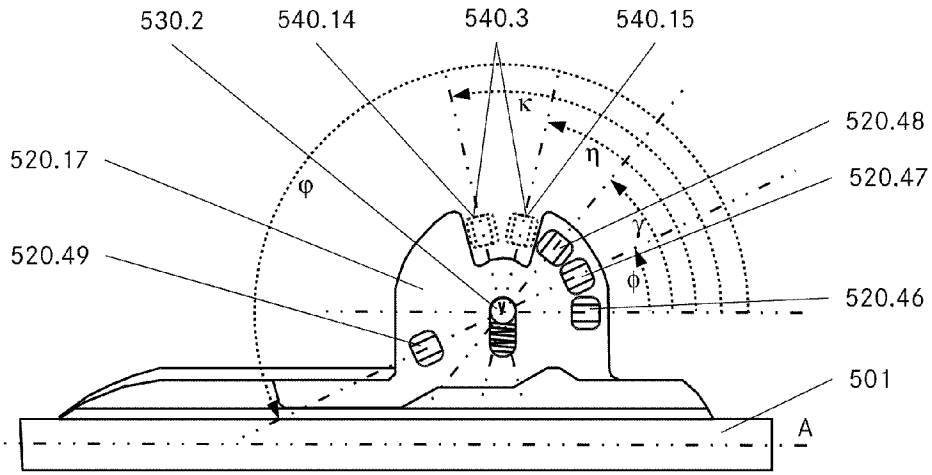
FIG. 9*a* a lateral exterior view of a base part of the climbing aid device of FIG. 6*a;*

FIG. 9*a* shows a lateral exterior view of the base part 520.1 of the adjusting device 520, in a plan view of the side plate 520.17, in the state in which it is mounted on the ski 501.

Laterally, on the outside in relation to the plane G, the side plate 520.17 has two detent lugs 520.46 and 520.49, which are associated with the catch device 590 for engaging the supporting device 530 or the supporting lever 530.1 in the various positions 530.10 to 530.14. With respect to a position of rest of the pin 530.2 against the stops 520.24 and 520.25 remote from the base plate, the detent lugs 520.46 to 520.49 are arranged at a radially largely constant distance, at different angles corresponding to the pivoting angles of the individual positions 530.10 to 530.14 of the supporting lever 530.1.

A first detent lug 520.46 is in this case arranged at the same height as the pin 530.2, and behind it in the longitudinal direction of the ski A, when said pin is lying against the stops 520.24 and 520.25 and lying coaxially with the axis of rotation T of the adjusting element 540. The detent lug 520.46 is consequently arranged on a longitudinal parallel to the base plate 520.16 (0 degrees). The second detent lug 520.47 has been turned by an angle of $\phi$=25 degrees in relation to the base plate 520.16 with respect to the pin 530.2, while the third detent lug 520.48 has been rotated by an angle of $\gamma$=51 degrees. The fourth detent lug 520.49 has been turned by an angle of $\phi$=207 degrees in relation to the base plate 520.16 with respect to the pin 530.2. The detent lugs 520.46 to 520.49 are in this case at a radial distance from the pin 530.2 that corresponds substantially to a radial distance of the driver 540.3 of the adjusting element 540 (indicated by broken lines in FIG. 9*a*).

The driver 540.3 has in the clearance 520.22 a rear position 540.15 and a front position 540.14, which corresponds to the supporting positions 530.11 and 530.12 that are operated by the adjusting device 520. In the rear position 540.15, the driver has been rotated by an angle of $\eta$=77 degrees in relation to the base plate 520.16 and, in the front position 540.14, it has been rotated by an angle of $\kappa$=103 degrees.

All the detent lugs 520.46 to 520.49 as well as the driver 540.3 (in both positions 540.14 and 540.15) are consequently arranged on an imaginary circle around the pin 530.2 or around the axis of rotation T of the adjusting element 540.

The detent lugs 520.46 and 520.49 in this case protrude further beyond the outer side of the side plate 520.17 than the further detent lugs 520.47 and 520.48. In particular, the height of the detent lugs 520.46-520.49 is made to match the detent notch 530.16 and the detent notches 530.24 and 530.25 set back from the latter in such a way that the detent notches 530.24 and 520.25 only come into engagement with the higher detent lugs 520.46 and 520.49. The driver 540.3 (or 540.4) protrudes to substantially the same extent beyond the side plate 520.17 as the less high detent lugs 520.47 and 520.48. The detent notches 530.24 and 530.25 therefore also cannot come into engagement with the driver 530.3.

If the supporting lever 530.1 or 630.1 is mounted on the base plate 520.1 and is in the position 530.10, the detent notch 530.24 is in engagement with the detent lug 520.46 and the detent notch 530.16 is in engagement with the detent lug 520.47. Since the position 530.10 is the locking position, particularly good locking of the ski boot carrier 570 during downhill skiing is ensured by the double engagement.

The supporting lever 530.1 or 630.1 can be manually adjusted from the position 530.10 into the position 530.14. In the position 530.14, the detent lug 520.46 has been brought out from the detent notch 530.24 and the detent notch 530.24 is arranged at the detent lug 520.47. As described above, on account of the smaller height and corresponding setting back of the region 530.17, the detent lug 520.47 cannot engage in the detent notch 530.24. Therefore, an engagement of the supporting lever 530.1 or 630.1 in the position 530.14 only takes place by means of the detent lug 520.48 engaging in the detent notch 530.16.

The supporting lever 530.1 or 630.1 can be manually brought out of the position 530.14 into the position 530.11, the driver 540.3 in its rear position 540.15 coming into engagement with the detent notch 530.16. The supporting lever 530.1 or 630.1 is consequently functionally coupled to the adjusting device 520. The detent notch 530.24 is arranged at the detent lug 520.48, but is not in engagement with it. On account of the engagement of the driver 540.3 with the detent notch 530.16, the supporting lever 530.1 or 630.1 can then be adjusted as described above by the adjusting device 520 from the position 530.11 into the position 530.12 and back again. The supporting lever 530.1 or 630.1 is in this case only engaged with the driver 540.3.

The supporting lever 530.1 or 630.1 can then be manually pivoted into the position 530.13. In this case, the driver 540.3 is brought out of the detent notch 530.16 and the detent notch 530.25 is brought into engagement with the detent lug 520.49. The supporting lever 530.1 or 630.1 is consequently engaged in the position 530.13. In the present embodiment, the position 530.13 represents the supporting position with the greatest climbing angle.

In other words, the climbing aid 510 according to the invention has a plurality of supporting positions, in the present case 4, of which at least 2 positions can be adjusted by the adjusting device. In this case, the other supporting positions can only be set manually, that is to say by direct or indirect adjustment (for example by hand or with a ski stick) of the supporting lever, without the adjusting device. Moreover, the climbing aid has a release position, in which free pivoting of the ski boot carrier without limitation of a lowering movement is ensured. On account of the configuration of higher and lower detent lugs on the base part and a number of detent notches which are offset with respect to one another in a direction perpendicular to the plane G, a coupling of the adjusting device with the supporting lever that is only effective in the positions operated by the adjusting device is achieved. In particular, the catch device is also configured in such a way that engagement only takes place in the purely manually operable supporting positions. In the at least two supporting positions that can be adjusted by the adjusting device, no engagement takes place.

Figure 9B:
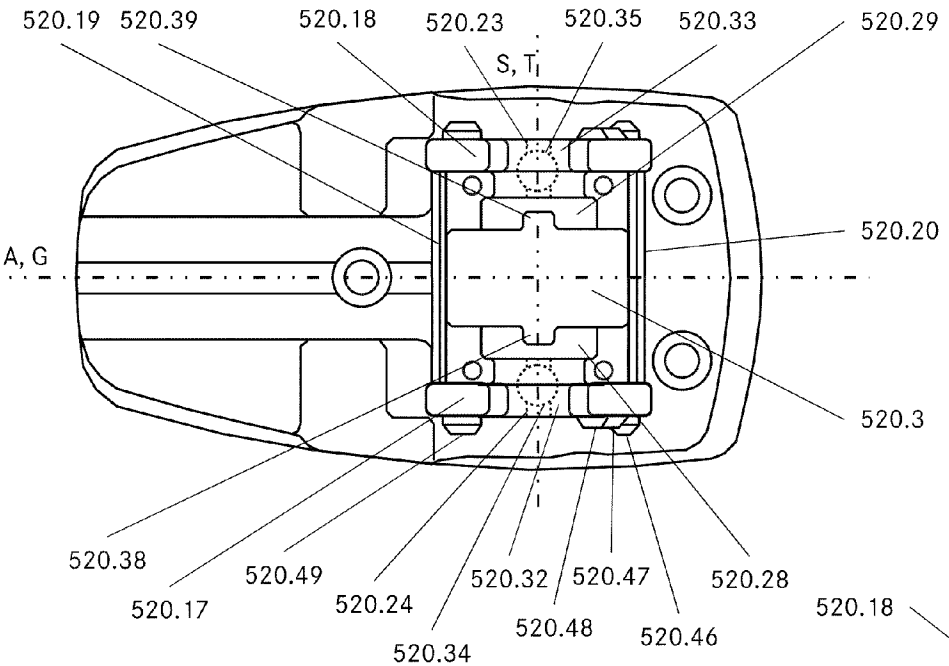
FIG. 9*b* a plan view of the base part of FIG. 9*a;*
Figure 9C:
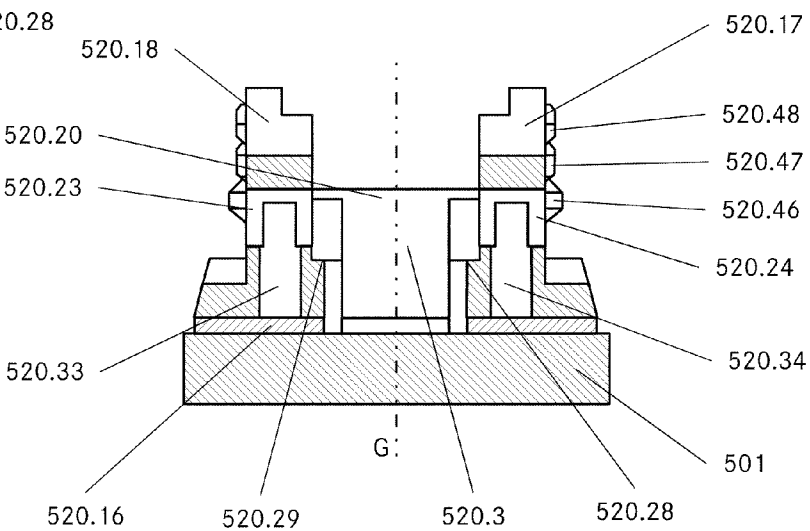
FIG. 9*c* a cross-sectional view of the base part of FIG. 9*a;*

FIG. 9*b* shows a plan view of the base part 520.1 in a direction perpendicular to the base plate 520.16. In this case there is no cover element 520.21, and so there is a clear view of the inner space 520.3 bounded by the side plates 520.17 and 520.18 and by the front and rear side walls 520.19 and 520.20. FIG. 9*c* shows a cross-sectional view of the base part 520.1 in the plane S, seen from a front longitudinal end of the ski 501.

Figure 10B:
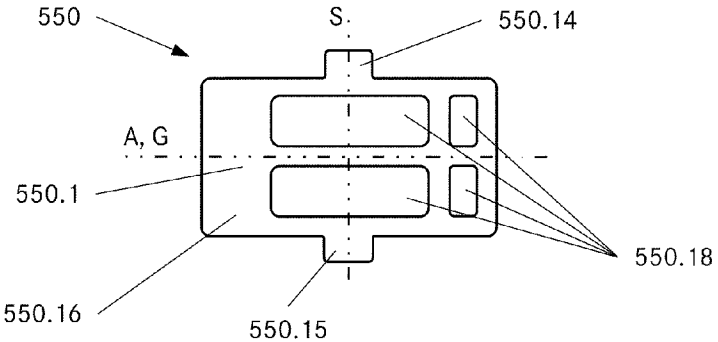
FIG. 10*b* a plan view of an underside of the carrier element of FIG. 10*a;*
Figure 10A:
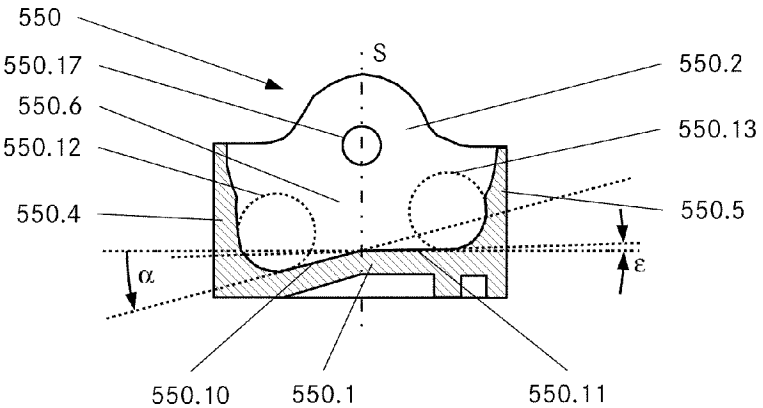
FIG. 10*a* a cross-sectional view of a carrier element of the climbing aid device of FIG. 6*a;*

FIGS. 10*a* and 10*b* show a cross section through the carrier element 550 in the plane G and a plan view of an underside 550.16 of the bottom 550.1 of the carrier element 550.

The view of FIG. 10*a* corresponds to the representation of the carrier element 550 in FIGS. 6*a* and 6*b*. The front adjusting position 550.12 and the rear adjusting position 550.13 of the ball 550.9 are in this case indicated by broken lines. Formed in the lateral side walls 550.2 and 550.3 are holes 550.17, which are in line with one another, for the pin 530.2 to pass through. A distance from the holes 550.17 to the bottom 550.1 of the carrier element 550 is in this case dimensioned such that the ball 550.9 can roll unhindered by the pin 530.2 in the longitudinal direction in the inner space 550.6 of the carrier element 550 from one of the adjusting positions 550.12 and 550.13 into the other adjusting position, respectively. The adjusting positions 550.12 and 550.13 are in this case defined by the front side wall 550.4 and the rear side wall 550.5 as stops. The other elements, not described here again, have been described in conjunction with FIGS. 6*a*-6*b* and 7*a* to 7*c*.

As can be seen from FIG. 10*b*, the carrier element 550 has on the underside 550.16 in the bottom clearances 550.18. The clearances 550.18 serve in this case for reducing the weight of the carrier element 550. In addition, apertures (not represented) may be provided, for example in the bottom 550.1 or in the side walls 550.2 to 550.5, in order to prevent an accumulation of water in the carrier element 550.

Figure 11C:
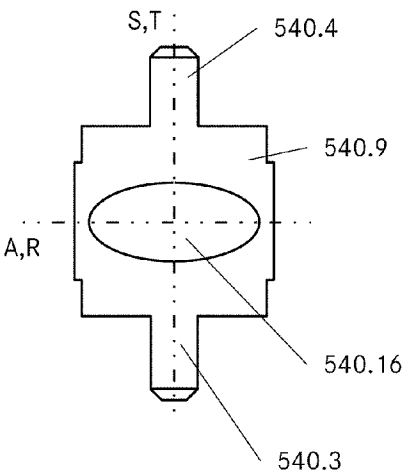
FIG. 11*c* a plan view from above of the adjusting element of FIG. 11*a;*
Figure 11B:
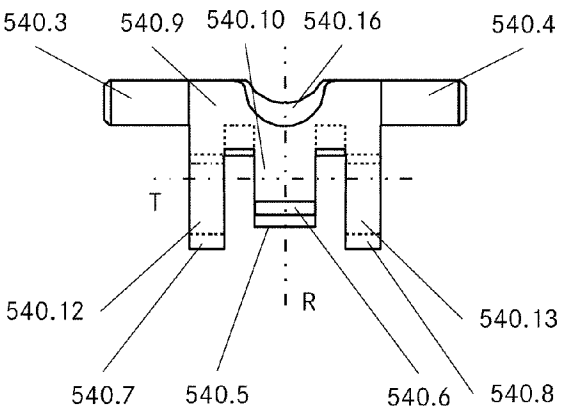
FIG. 11*b* an exterior view of the adjusting element of FIG. 11*a* from the rear.
Figure 11A:
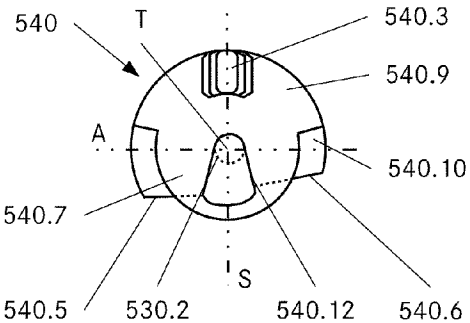
FIG. 11*a* adjusting elements of the climbing aid device of FIG. 6*a* in a lateral exterior view.

FIGS. 11*a* to 11*c* show the adjusting element 540 in an exterior view from the side (FIG. 11*a*) from the rear (FIG. 11*b*) and from above (FIG. 11*c*).

The parts of FIGS. 11*a* to 11*c* have been described in conjunction with FIGS. 6*a*-6*b* and 7-7*c*.

The embodiment described above of a climbing aid according to the invention may also be extended, so that more than just two supporting positions can be adjusted by the adjusting device. In particular, this can be achieved by a parallel arrangement of two or more gravity elements that are guided in the longitudinal direction in the carrier element. The following illustrations show an embodiment with an adjusting device which can adjust a supporting device between three supporting positions.

Figure 12A:
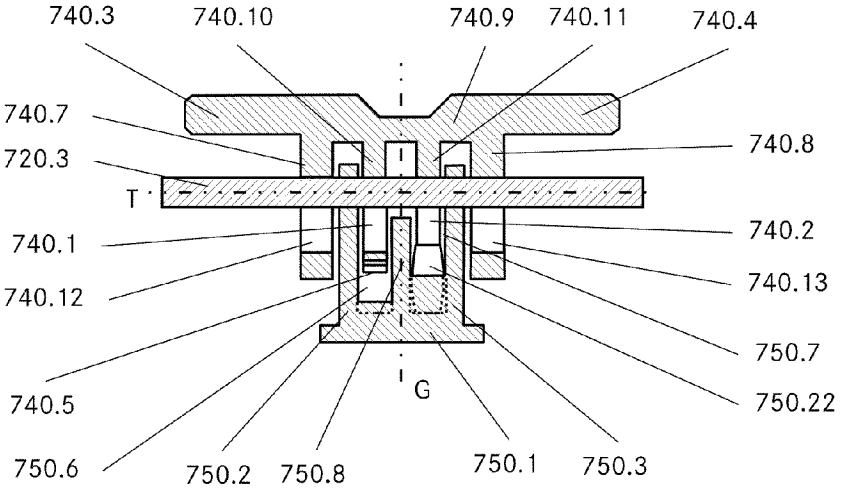
FIG. 12*a* a cross-sectional view of an arrangement of an adjusting element and a carrier element of an adjusting device of a climbing aid device according to the invention for adjusting 3 supporting positions with two gravity elements.

FIG. 12*a* shows a cross section in the plane S of an arrangement of an adjusting element 740, a pivot pin 730.2 of a supporting lever and a carrier element 750 of a further embodiment of a climbing aid according to the invention which can operate or adjust three supporting positions of a supporting device that can be adjusted by an adjusting device.

Figure 12B:
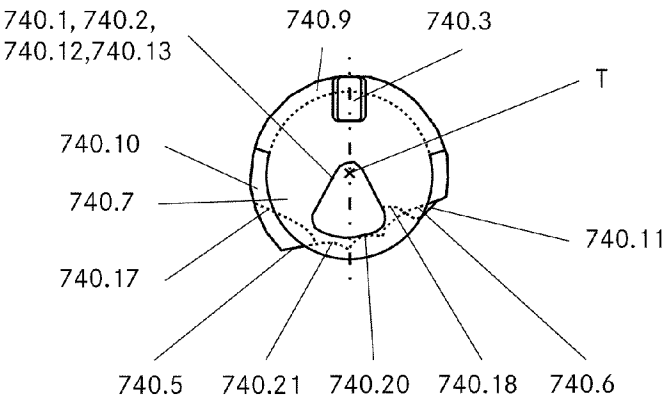
FIG. 12*b* a lateral exterior view of the adjusting element of the arrangement of FIG. 12*a;*
Figure 12C:
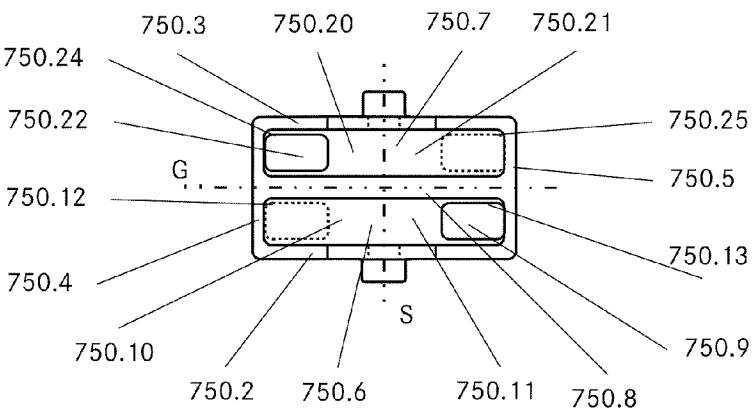
FIG. 12*c* a plan view from above of the carrier element of FIG. 12*a;*
Figure 12D:
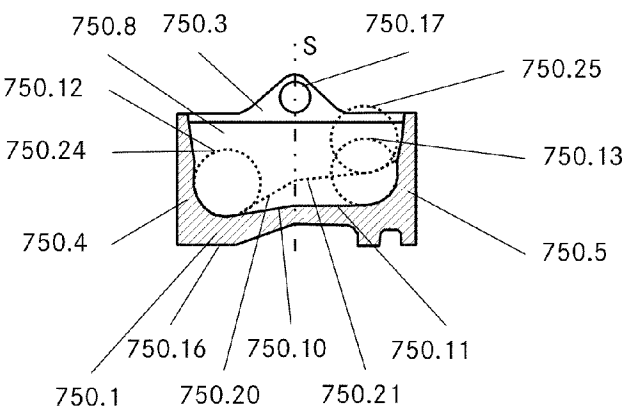
FIG. 12*d* a longitudinal cross-sectional view of the carrier element of FIG. 12*a;*

The illustration of FIG. 12*a* and FIGS. 13*a*-*d*, described further below, do not show a base part and a supporting device of the climbing aid. The base part and the supporting device in the case of the climbing aid of FIG. 12*a* may be formed in such a way that they are largely identical to the embodiments of the climbing aid 510 that are represented in the previous figures. Any modifications (in particular with regard to forming of the catch device) are described further below. FIG. 12*a* shows the adjusting element 740, the pin 730.2 and the carrier element 750 in an arrangement in relation to one another that corresponds to FIG. 13*c* described further below. FIG. 12*b* shows a lateral exterior view along the axis of rotation T of the adjusting element 740. FIG. 12*c* shows a plan view from above of the carrier element 750, while FIG. 12*d* shows a longitudinal cross section of the carrier element 750 in the longitudinal center plane G. Hereafter, FIGS. 12*a* to 12*d* are described together.

FIG. 12*a* has the adjusting element 740, which is rotatably mounted on the base part (not represented) in a way analogous to the adjusting element 540 and has bearing disks 740.7 and 740.8, which are provided by analogy with the bearing disks 540.7 and 540.8 on a cross member 740.9, which corresponds to the cross member 540.9. Formed on the cross member 740.9 are drivers 740.3 and 740.4, which likewise correspond to the drivers 540.3 and 540.4. The bearing disks 740.7 and 740.8 have clearances 740.12 and 740.13, which correspond in their function to the clearances 740.12 and 740.13 and allow a pin 730.2 of a supporting lever (not represented) to be displaceable in relation to the adjusting element 740. However, the clearances 740.12 and 740.13 have a greater surface area than the clearances 540.12 and 540.13, since the adjusting element 740 must be able to be pivoted into three rotational positions with respect to the axis of rotation T of the adjusting element 740. The pin 730.2 passes through the clearances 740.12 and 740.13 in the direction of the axis of rotation T of the adjusting element 740 and corresponds to the pin 530.2 of the embodiment of the climbing aid 510.

By contrast with the adjusting element 540, two switching elements 740.10 and 740.11 are formed on the cross member 740.9. The switching elements 740.10 and 740.11 are arranged on both sides of the plane G and at a distance from it. The same distance is provided between the switching element 740.10 and the bearing disk 740.7 as between the switching element 540 and the bearing disk 540.7—by analogy with switching element 740.11 and bearing disk 740.8. It is consequently ensured, by analogy with the climbing aid 510, that lateral side walls 750.2 and 750.3 of the carrier element 750 can be received in the intermediate spaces of the switching elements 740.10 and 740.11 as well as the bearing disks 740.7 and 740.8. The switching elements 740.10 and 740.11 respectively have clearances 740.1 and 740.2, which functionally correspond to the clearance 540.1. The clearances 740.12 and 740.13 and also the clearances 740.1 and 740.2 are in line with one another and are arranged in the region of the slots for guiding the pin 730.2 on the base part. The clearances have in this case a largely triangular cross section with a curved base and rounded corners, a corner that lies opposite the base being arranged at the top. By contrast with the adjusting element 540, the clearances 740.1 and 740.2 are consequently formed such that they are closed in the downward direction, as described in more detail further below.

The carrier element 750 is suspended on the pin 730.2 by means of pin holes 750.17 in the lateral side walls 750.2 and 750.3 in the region of the intermediate spaces between the switching element 740.10 and the bearing disk 740.7 as well as the switching element 740.11 and the bearing disk 740.8. The outer dimensions of the carrier element 750 correspond to those of the carrier element 550 of the climbing aid 510, whereby the carrier element 750 can be accommodated displaceably in a direction perpendicular to the ski in an inner space of a base part that is formed analogously to the inner space 520.3.

However, by contrast with the carrier element 550, the carrier element 750 has two elongate inner spaces 750.6 and 750.7, which are arranged parallel in the longitudinal direction and are separated from one another by a separating wall 750.8 arranged in the plane G. The switching elements 740.10 and 740.11 of the adjusting element 740 are in this case arranged in such a way that, with the carrier element 750 raised, i.e. in the switching position of the adjusting device, one of the switching elements 740.10 or 740.11 respectively has been introduced at least partially into an inner space 750.6 or 750.7 assigned to the respective switching element.

In the inner space 750.6, a bottom 750.1 of the carrier element 750 has in a front half a front portion 750.10 and in a rear half a rear portion 750.11, with different longitudinal inclinations. The inner space 750.7 likewise has in a front half a front portion 750.20 and in a rear half a rear portion 750.21, with different inclinations (also see FIG. 12*d*).

With respect to a longitudinal direction of the ski A or an alignment of a base plate of a base part of the climbing aid that is provided with the carrier element 750, the bottom portions 750.10, 750.11, 750.20 and 750.21 are inclined forward. The rear portion 750.11 has in this case a smallest inclination, while the front portion 750.20 has a greatest inclination. The front portion 750.10 and the rear portion 750.21 have inclinations that lie between the greatest and smallest inclination, the inclination of the rear portion 750.21 being greater than the inclination of the front portion 750.10. Consequently, the following order is obtained from smaller angles of inclination to greater angles of inclination: rear portion 750.11, front portion 750.10, rear portion 750.21, front portion 750.20.

In the inner spaces 750.6 and 750.7, a gravity element is in each case provided, respectively formed as a pellet-shaped rolling body 750.9 and 750.22. End faces of the rolling bodies 750.9 and 750.22 are in this case convexly configured, in order to reduce friction with inner sides of the inner spaces 750.6 and 750.7 and ensure free rolling. The rolling bodies 750.9 and 750.22 are in this case arranged with an axis of rotation perpendicular to the plane G and formed in such a way that they can roll in the longitudinal direction A of the ski in the inner spaces 750.6 and 750.7. The climbing aid of FIGS. 12*a* to 12*d* consequently comprises two gravity elements 750.9 and 750.22, which are movably mounted, guided in the longitudinal direction parallel to one another in two inner spaces 750.6 and 750.7 of the carrier element 750. The inner spaces 750.6 and 750.7 consequently respectively form a longitudinal guide for the gravity elements 750.9 and 750.22.

A front and a rear side wall 750.4 and 750.5 of the carrier element 750 in this case form a front and a rear stop for the rolling bodies 750.9 and 750.22 in each of the inner spaces 750.6 and 750.7. This has the effect of forming in each of the inner spaces 750.6 and 750.7 a front adjusting position (750.12 in the inner space 750.6 and 750.24 in the inner space 750.7) and a rear adjusting position (750.13 in the inner space 750.6 and 750.25 in the inner space 750.7) of the rolling bodies 750.9 and 750.22. In the representations of FIGS. 12*a*-12*d*, the front adjusting positions 750.12 and 750.24 are arranged at the same height above an underside 750.16 of the bottom 750.1 of the carrier element. On account of the different inclinations of the bottom portions 750.10, 750.11, 750.20 and 750.21, the rear adjusting position 750.25 is therefore arranged higher above the underside 750.16 than the adjusting position 750.13.

On account of the parallel arrangement of the carrier element 750 in relation to a base plate of the base part fixed to the ski, a horizontal position of the carrier element 750 corresponds to a horizontal position of a ski that is provided with the climbing aid. Similarly, any desired longitudinal inclination of the ski corresponds to a longitudinal inclination of the carrier element 750. Here and hereafter, a longitudinal inclination of the ski always refers to an inclination in the case of which a front end of the ski lies higher than a rear end.

Consequently, it is possible to distinguish between the following states of the carrier element 750 with rolling bodies 750.9 and 750.22, in dependence on a longitudinal inclination of the ski in the measuring position of the adjusting device.

A) If the carrier element 750 is in a horizontal position, both rolling bodies 750.9 and 750.22 are in the front adjusting position 750.12 and 750.24, on account of the inclinations of the bottom portions 750.10, 750.11, 750.20 and 750.21.

B) If the ski is brought from a horizontal position into an inclined position and this inclination exceeds the inclination of the front portion 750.10, but is less than the inclination of the front portion 750.20, in the measuring position of the adjusting device the rolling body 750.9 rolls from the front adjusting position 750.12 into the rear adjusting position 750.13. The rolling body 750.22 remains in the front adjusting position 750.24.

C) If the longitudinal inclination of the ski is increased further, until it exceeds the inclination of the front portion 750.20, the rolling body 750.22 also rolls into its rear adjusting position 750.25.

Both rolling bodies 750.9 and 750.22 are in this case in the rear adjusting position 750.13 and 750.25.

D) If the longitudinal inclination of the ski is reduced again, the rolling body 750.22 rolls into the front adjusting position 750.20 as soon as the longitudinal inclination of the ski is less than the inclination of the rear portion 750.21. If the longitudinal inclination of the ski is in this case greater than the inclination of the rear portion 750.11, the rolling body 750.9 remains in the rear adjusting position 750.13. This state corresponds to the state B) described above.

E) If the longitudinal inclination of the ski is reduced further and is less than the inclination of the rear portion 750.11, the rolling body 750.9 also rolls into the front adjusting position 750.12. This state corresponds to the state A) described above.

On account of the order of the inclinations of the bottom portions 750.10, 750.11, 750.20 and 750.21, three distinguishable states can therefore be assumed by the two rolling bodies 750.9 and 750.22, in dependence on the longitudinal inclination of the ski. The adjusting element 740 is formed such that each of these three states of the carrier element 750 is assigned an angle of rotation of the adjusting element 740 about the axis of rotation T. By analogy with the case of the climbing aid 510, a supporting lever can consequently be adjusted into supporting positions by means of the drivers 740.3 and 740.4 of the adjusting element 740. In the present case, however, it can be adjusted into three different positions (instead of two).

The adjusting element 740 has on each of the switching elements 740.10 and 740.11 in each case two switching surfaces 740.5 and 740.6 and respectively 740.17 and 740.18, assigned to the adjusting positions 750.12 and 750.13 and respectively 750.24 and 750.25 (see FIG. 12*b*). The switching surfaces 740.5 and 740.6 are arranged with respect to the carrier element 750 in such a way that the rolling body 750.9 in the front adjusting position 750.12 interacts with the switching surface 740.5 when the adjusting device is in the switching position, i.e. when the carrier element 750 has been raised toward the adjusting element 740 with respect to its position in the measuring position. By analogy, the rolling body 740.22 in the front adjusting position 750.24 interacts with the switching surface 740.17. In the rear adjusting positions 750.13 and 750.25, the rolling bodies 740.9 and 740.22 interact with the switching surfaces 740.6 and 740.18. The switching surfaces 740.5 and 740.6 and respectively 740.17 and 740.18 are formed in the present embodiment in a curved recessed manner, so that in the switching position the rolling bodies 740.9 and 740.22 are better blocked in the recesses.

Between the switching surfaces 740.5 and 740.6, a detent recess 740.20 is formed adjoining the switching surface 740.5 on the switching element 740.10. This detent recess is arranged under the clearance 740.1. The detent recess 740.20 serves for blocking the rolling body 740.9 in the state C) described above of the adjusting device. On account of the higher position of the rear adjusting position 750.25 in comparison with the adjusting position 750.13, the rolling body 740.9 cannot in this case be blocked by the adjusting surface 740.6, for which reason a separate detent recess 740.20 is provided. The detent recess 740.20 is therefore arranged with respect to the adjusting surface 740.18 in such a way that, in the state C), in the switching position of the adjusting device the rolling body 740.9 is blocked in the rear adjusting position 750.13 in the detent recess 740.20 and the rolling body 740.22 is blocked in the adjusting position by the adjusting surface 740.18.

By analogy, the switching element 740.11 has a detent recess 740.21, which is arranged between the switching surfaces 740.17 and 740.18 and adjoins the switching surface 740.17. The detent recess 740.21 is formed under the clearance 740.2. In the state A) described above, the rolling body 740.22 is blocked in the switching position of the adjusting device in the detent recess 740.21, while at the same time the rolling body 740.9 is blocked in the adjusting position 750.12 by the switching surface 740.5.

FIGS. 13*a* to 13*d* show various switching states of an arrangement of the adjusting element 740 and the carrier element 750. The carrier element 750 is in this case represented in a longitudinal cross section in the plane G, while the adjusting element 740 is shown in an exterior view. To provide a better overview, bearing disks corresponding to the bearing disks 540.7 and 540.8 are not represented in this case. As already in FIG. 12*a*, a base part and a supporting device of the climbing aid are not shown.

Figure 13B:
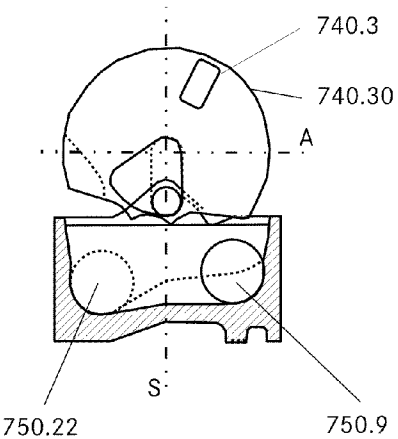
FIG. 13*b* the arrangement of FIG. 12*a* in the measuring position.
Figure 13D:
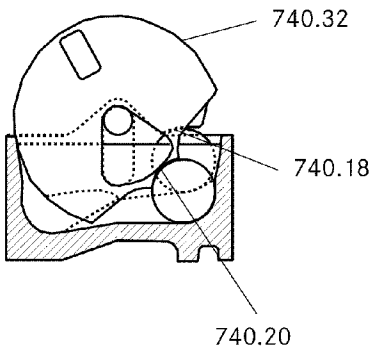
FIG. 13*d* the arrangement of FIG. 12*a* in the switching position in a state which corresponds to a highest of the supporting positions that can be adjusted by the adjusting device.
Figure 13A:
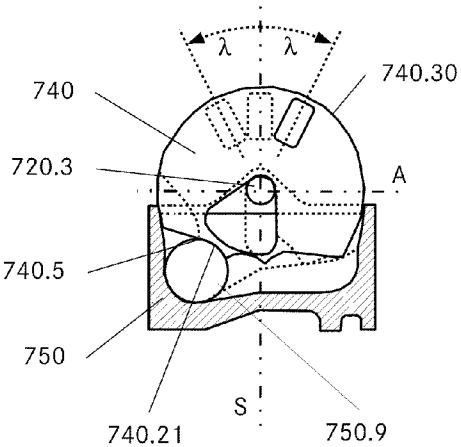
FIG. 13*a* the arrangement of FIG. 12*a* in the switching position in a state which corresponds to a lowest of the supporting positions that can be adjusted by the adjusting device.

FIG. 13*a* shows a state that is reached from the state A) after a transition into the switching position of the adjusting device. Both rolling bodies are arranged in the respectively associated front adjusting position 750.12 and 750.24. The carrier element 750 has been raised toward the adjusting element 740, so that the rolling body 750.9 interacts with the switching area 740.6 and the rolling body 750.22 is blocked by the detent recess 740.21. The adjusting element 740 is consequently in a position 740.30 in which the drivers 740.3 and 740.4 arranged on top of the cross member 740.9 have been rotated rearward toward the end of the ski. When there is direct engagement with a supporting lever mounted on the end 720.3, by analogy with the embodiment of FIG. 6*b*, this position of the adjusting element corresponds to a lowest supporting position of the three supporting positions of the supporting device that can be adjusted by the adjusting device. The rolling body 750.22 is in this case blocked by the detent recess 740.21 in the carrier element 750 and the rolling body 750.9 is blocked by the switching surface 740.5.

FIG. 13*b* shows the state B) already described above, in which the carrier element 750 has been lowered and the adjusting device is consequently in the measuring position. The adjusting element is in this case in the position 740.30.

Figure 13C:
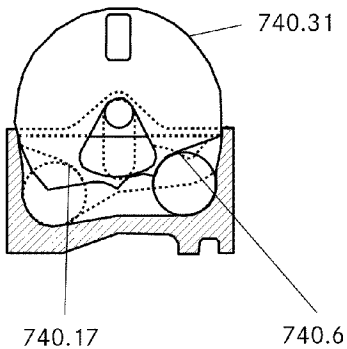
FIG. 13*c* the arrangement of FIG. 12*a* in the switching position in a state which corresponds to a middle supporting position.

FIG. 13*c* shows the arrangement of the adjusting element 740 and the carrier element 750 in the switching position of the adjusting device from the state B) (see FIG. 13*b*) after an adjusting process. When the carrier element 750 is raised toward the adjusting element 740, the rolling body 750.9 interacts with the switching surface 740.6 of the switching element 740.10. The switching surface 740.6 is arranged on the adjusting element 740 in such a way that, when the carrier element 750 has been completely raised in the switching position of the adjusting device, the adjusting element 740 has been adjusted or rotated into a new position 740.31. The drivers 740.3 and 740.4 have in this case been rotated forward, whereby a directly coupled supporting lever has likewise been rotated forward. The position 740.31 consequently corresponds to a middle supporting position of the three supporting positions of the supporting device that can be adjusted by the adjusting device. The rolling body 750.22 is in this case blocked by the switching surface 740.17 in the carrier element 750 and the rolling body 750.9 is blocked by the switching surface 740.6.

FIG. 13*d* shows the arrangement of the adjusting element 740 and the carrier element 750 in the switching position of the adjusting device from the position of FIG. 13*c* after the adjusting device has been brought into the measuring position, the state C) has been established in this position (i.e. both rolling bodies 750.9 and 750.22 are in the associated rear adjusting positions 750.13 and 750.25) and the adjusting device has been brought into the switching position again. When the carrier element 750 is raised toward the adjusting element 740, i.e. during the transition into the switching position, the rolling body 750.22 interacts with the switching surface 740.18 of the switching element 740.11. The switching surface 740.18 is in this case arranged on the adjusting element 740 in such a way that, when the carrier element 750 has been raised completely in the switching position of the adjusting device, the adjusting element 740 has been adjusted or rotated into a new position 740.32. The drivers 740.3 and 740.4 have in this case been rotated further forward with respect to the position 740.31, whereby a supporting lever coupled via the drivers 740.3 and 740.4 has been pivoted forward. The position 740.32 consequently corresponds to a highest supporting position of the three supporting positions of the supporting device that can be adjusted by the adjusting device. The rolling body 750.22 is in this case blocked by the switching surface 740.18 in the carrier element 750 and the rolling body 750.9 is blocked by the detent recess 740.20.

In other words, the states A)-C) described above are respectively assigned a rotational position of the adjusting element 740.30 to 740.32. If the adjusting element 740 in the measuring position is in the position which corresponds to the current state A)-C), no adjusting process takes place during the transition into the switching state. If the adjusting element is in another position 740.30 to 740.32 assigned to the current state A)-C), an adjusting process into the corresponding position 740.30 to 740.32 takes place.

In the present configuration of the adjusting device for adjusting three supporting positions, the drivers 740.3 and 740.4 in the middle position 740.31 with respect to the ski are arranged perpendicularly over the axis of rotation T. In the position 740.30, the drivers 740.3 and 740.4 have been rotated rearward by an angle λ and in the positions 740.32 rotated forward by the angle λ (also see FIG. 13*a*).

On account of the configuration of the climbing aid 710 with three adjustable supporting positions, it may be necessary, as already mentioned above, to modify the catch device described in FIGS. 8 and 9*a*. For example, the detent lug 520.48 formed on the base part 520.1 could be omitted and the clearances 520.32 and 520.33 on the base part 520.1 extended rearward, so that the positions 740.30 to 740.32 of the adjusting element can be assumed unhindered by associated drivers 740.3 and 740.4. However, in this case the drivers 740.3 and 740.4 would have to be positioned on the cross member 740.9 offset in comparison with the representation of FIG. 12*b*, for example, in order to achieve the desired adjusting angles of the supporting lever. Similarly, the detent notch 530.16 on the supporting lever may also be provided at a different angle. The possibly required modifications of the catch device are consequently obvious and are within the scope of modifications carried out by a person skilled in the art.

In the embodiment represented, it is assumed that an adjustment from the position 740.30 into the position 740.32 always takes place via the position 740.31. In other words, it is assumed that a transition from the state A) to the state C) always takes place via the state B). It goes without saying, however, that, given a suitable form of the switching surfaces, a direct adjustment between the positions 740.30 and 740.32 can also take place. Similarly, the adjusting positions may be arranged such that they are shifted in the longitudinal direction, for example toward the plane G, or both adjusting positions of one rolling body are arranged offset in the longitudinal direction with respect to the adjusting positions of the other rolling body. In the embodiment of FIGS. 12*a*-12*d* and 13*a*-13*d*, for example, the rear adjusting positions 750.25 of the rolling body 750.22 could be offset forward, and the front adjusting position 750.12 of the rolling body 750.9 offset rearward, toward the plane G. This ensures that the rolling bodies can interact in the way desired with the corresponding switching surfaces even in the case of a direct transition from the state A) into the state C). To simplify the representation, however, the aforementioned assumption of a step-by-step transition between the states A) and C) has been made, it being possible with the switching surfaces 740.5, 740.6, 740.17 and 740.18 formed in the way represented for the rear adjusting positions 750.13 and 750.25 as well as the front adjusting positions 750.12 and 750.24 to be respectively arranged at the same distance from the plane G.

It similarly goes without saying that the present embodiment can be extended to more than three adjustable climbing stages, by analogously providing further gravity elements which are arranged in further intermediate spaces of the carrier element with correspondingly formed bottom inclinations. In other words, by parallel arrangement of a number of gravity elements and corresponding configuration of the carrier element and the adjusting element, the adjusting device can be extended to almost any desired number of supporting positions that can be adjusted by the adjusting device.

Figure 14B:
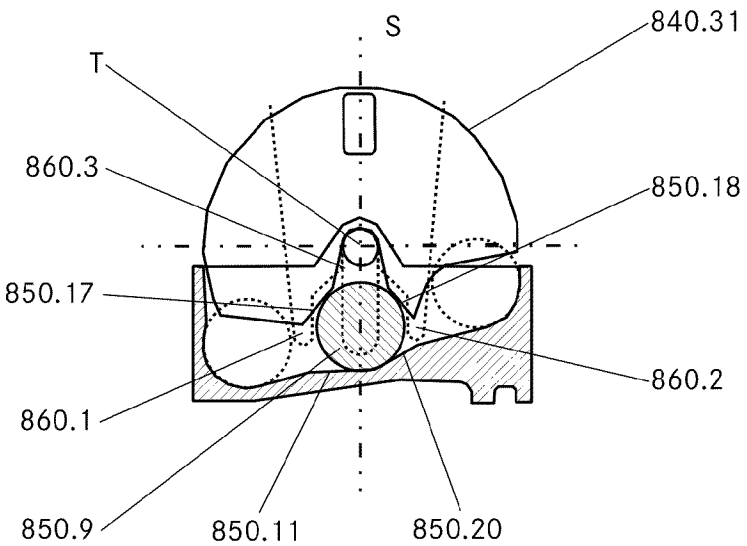
FIG. 14*b* the arrangement of FIG. 14*a* in the switching position.
Figure 14A:
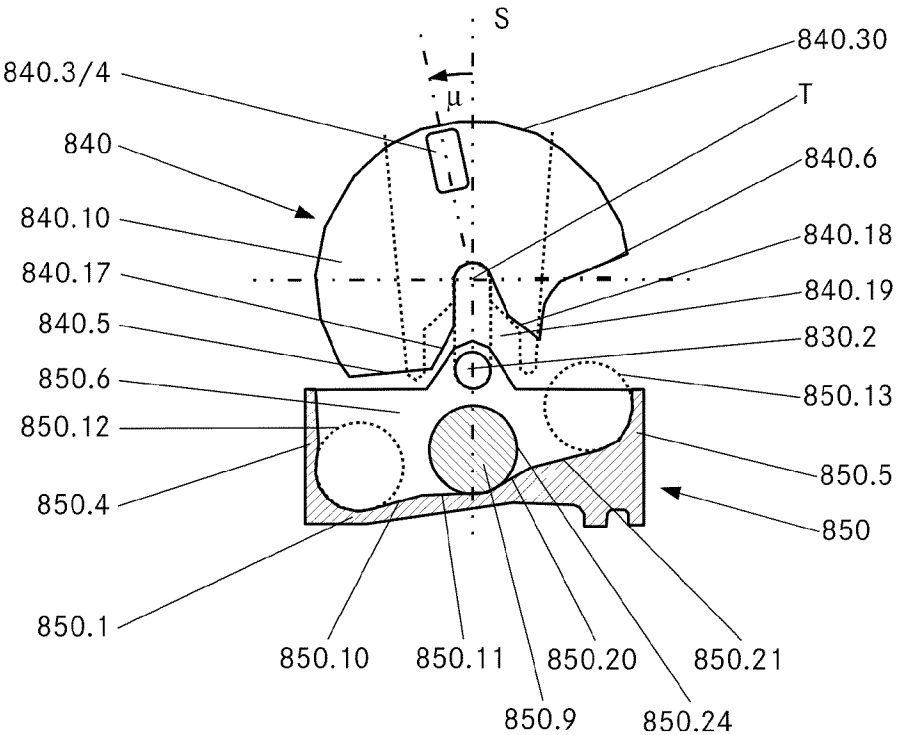
FIG. 14*a* an arrangement of an adjusting element and a carrier element of an adjusting device of a climbing aid device according to the invention for adjusting 3 supporting positions with a gravity element in the measuring position.

FIGS. 14*a* and 14*b* show an arrangement of an adjusting element 840, a pivot pin 830.2 of a supporting lever and a carrier element 850 of a further embodiment of a climbing aid according to the invention, which can operate or adjust three supporting positions of a supporting device that can be adjusted by an adjusting device. The arrangement of FIGS. 14*a* and 14*b* has in this case only one gravity element 850.9.

FIG. 14*a* shows the arrangement in the measuring position of the associated adjusting device and FIG. 14*b* shows a switching position. The carrier element 850 is in this case represented in a longitudinal cross section in the plane G, while the adjusting element 840 is shown in an exterior view. To provide a better overview, bearing disks corresponding to the bearing disks 540.7 and 540.8 are not represented in this case. As already in FIG. 12*a*, a base part and a supporting device of the climbing aid are not shown. The base part and the supporting device in the case of the climbing aid of FIG. 12*a* may be formed in such a way that they are largely identical to the embodiments of the climbing aid 510 that are represented in the previous FIGS. 6*a* to 11*c* with appropriate adaptations, for example of a catch device, that arise directly from the foregoing description.

By analogy with the adjusting element 540, the adjusting element 840 is rotatably mounted on the base part (not represented) about the axis of rotation T and has a switching element 840.10, which is arranged centrally in the plane G. Formed on the switching element 840.10 are a front and a rear switching surface 840.5 and 840.6, which largely correspond to the switching surfaces 540.5 and 540.6 of the adjusting element 540. Formed between the switching surfaces 840.5 and 840.6 are two further switching surfaces 840.17 and 840.18, which go over into a clearance 840.1, which largely corresponds to the clearance 540.1 of the adjusting element 540. The switching surface 840.17 is in this case arranged in front of the clearance 840.1 and the switching surface 840.18 is arranged behind the clearance 840.1. The switching surfaces 840.17 and 840.18 are arranged at an angle in relation to one another in such a way that a receiving space 850.19 converging in a wedge-shaped manner toward the axis of rotation T of the adjusting element 840 and bounded by the switching surfaces 840.17 and 840.18 is obtained for the rolling body 850.9. A distance between the switching surfaces 840.17 and 840.18 is in this case dimensioned such that a maximum distance is greater and a minimum distance is less than the diameter of the rolling body 850.9. By analogy with the adjusting element 540, formed on an upper periphery are drivers 840.3 and 840.4, which are provided for coupling the adjusting element 840 with a supporting lever (not represented).

The carrier element 850 corresponds largely to the carrier element 550 and has in the longitudinal direction an inner space 850.6, in which a rolling body 850.9 is mounted in a movably guided manner. The inner space 850.6 has in this case a length which is greater than three times the diameter of the rolling body 850.9. By analogy with the carrier element 550, a front and a rear side wall 850.4 and 850.5 form a stop of the longitudinal guide for the rolling body 850.9 that is provided by the inner space 850.6. A position of the rolling body 850.9 at the front side wall 850.4 consequently corresponds to a front adjusting position 850.12 and a position at the rear side wall 850.5 corresponds to a rear adjusting position 850.13. By contrast with the carrier element 550, a further, middle adjusting position 850.24 of the rolling body 850.9 is provided, arranged largely midway along the inner space 850.6 in the longitudinal direction thereof. The adjusting positions 850.4, 850.5 and 850.24 are spaced apart in such a way that the rolling body 850.9 in one adjusting position is at a distance from the adjacent adjusting position or adjusting positions that is greater than a diameter of the rolling body 850.9. This produces an intermediate space between the intended positions assumed by the rolling body 850.9 in adjacent adjusting positions.

By contrast with the carrier element 550, four portions 850.10, 850.11, 850.20 and 850.21 of substantially the same length are formed with different inclinations on a bottom 850.1 of the carrier element 850. The portions 850.10, 850.11,

850.20 and 850.21 are in this case arranged one behind the other from front to rear in the longitudinal direction.

With respect to a longitudinal direction of the ski A or an alignment of a base plate of a base part of the climbing aid which is provided with the carrier element 850, the bottom portions 850.10, 850.11, 850.20 and 850.21 are inclined forward. The second-frontmost portion 850.11 has in this case a smallest inclination, while the second-rearmost portion 850.20 has a greatest inclination. The frontmost portion 850.10 and the rearmost portion 850.21 have inclinations which lie between the greatest and the smallest inclination, the inclination of the rearmost portion 850.21 being greater than the inclination of the frontmost portion 850.10. Consequently, the following order is obtained from smaller to greater angles of inclination: second-frontmost portion 850.11, frontmost portion 850.10, rearmost portion 850.21, second-rearmost portion 850.20.

A transition from the second-frontmost portion 850.11 to the second-rearmost portion 850.20 in this case defines the middle adjusting position 850.24 and is arranged largely midway along the inner space 850.6 of the carrier element 850 in the longitudinal direction in such a way that the adjusting position 850.24 with respect to the ski is arranged perpendicularly under the axis of rotation T of the adjusting element 840. By analogy with the carrier element 550, the carrier element 850 is suspended from the pivot pin 830.2 and in the same sense is forcibly coupled with a supporting lever (not represented) with respect to a displacement perpendicular to the ski.

The front and rear switching surfaces 840.5 and 840.6 of the adjusting element 840 are in this case arranged analogously to the arrangement of the adjusting element 540 above the assigned adjusting positions 850.12 and 850.13. The additional switching surfaces 850.17 and 850.18 are arranged above the adjusting position 850.24, so that the rolling body 850.9 can interact with the switching surfaces 850.17 and 850.18 when the carrier element 850 has been raised upward, i.e. the adjusting device provided with the carrier element and the adjusting element is in the switching position.

On account of the order of the inclinations of the inclined portions 850.11, 850.10, 850.21 and 850.20, in the measuring position the rolling body 850.9 can assume the adjusting positions 850.12, 850.13 and 850.24, in dependence on a longitudinal inclination of the ski. Consequently, it is possible to distinguish between the following states:

a) If the carrier element 850 or the ski that is provided with the climbing aid with the carrier element 850 is in a horizontal position, the rolling body 850.9 is in the front adjusting position 850.12, on account of the forward inclinations of the bottom portions 850.10, 850.11, 850.20 and 850.21.

b) If the ski is brought from a horizontal position into an inclined position and the longitudinal inclination of the ski exceeds the inclination of the frontmost portion 850.10, but is less than the inclination of the second-rearmost portion 850.20, in the measuring position of the adjusting device the rolling body 850.9 rolls from the frontmost adjusting position 850.12 into the middle adjusting position 850.24.

c) If the longitudinal inclination of the ski is increased further, until it exceeds the inclination of the second-rearmost portion 850.20, the rolling body 850.9 rolls into the rear adjusting position 850.13.

d) If the longitudinal inclination of the ski is reduced again, the rolling body 850.9 rolls into the middle adjusting position 850.24 as soon as the longitudinal inclination of the ski is less than the inclination of the rearmost portion 850.21. If the longitudinal inclination of the ski is in this case greater than the inclination of the second-frontmost portion 850.11, the rolling body 850.9 remains in the middle adjusting position 850.24. This state corresponds to the state b) described above.

e) If the longitudinal inclination of the ski is reduced further and is less than the inclination of the second-frontmost portion 850.11, the rolling body 850.9 rolls into the front adjusting position 850.12. This state corresponds to the state a) described above.

On account of the inclinations and the arrangement of the inclined bottom portions 850.10, 850.11, 850.20 and 850.21 in the inner space 850.6 of the carrier element 850, it is consequently possible to distinguish between three longitudinal inclinations of the ski by the fact that three different adjusting positions 850.12, 850.13 and 850.24 can be assumed by the rolling body 850.9, in dependence on the longitudinal inclination of the ski in the longitudinal direction. The actual intervals between the angles of inclination of the bottom portions 850.10, 850.11, 850.20 and 850.21 thereby ensure that the longitudinal inclination of the ski with respect to a current adjusting position of the rolling body 850.9 must be above or below threshold values before the rolling body 850.9 assumes a new adjusting position. In this case too, the adjusting device consequently has a hysteresis, which prevents an adjusting process being initiated with every minor change in position of the ski or the climbing aid.

On account of the arrangement of the switching surfaces 840.5, 840.6, 840.17, 840.18 on the adjusting element 840, the latter can, depending on the adjusting position of the rolling body 850.9 in the transition from the measuring position into the switching position in adjusting process, be rotated into three different rotational positions 840.30 (drivers 850.3/4 rotated rearward in relation to cross-sectional plane S by angle μ), 840.31 (centered position; drivers 850.3/4 in cross-sectional plane) and 840.32 (drivers 850.3/4 rotated forward; not represented). The rotational position 840.30 is in this case assigned to the rear adjusting position 850.13, the rotational position 840.32 is assigned to the front adjusting position 850.12 and the rotational position 840.31 is assigned to the middle adjusting position 850.24.

If the rolling body 850.9 is in the front or rear adjusting position 850.12 or 850.13, an adjusting process takes place by analogy with the embodiment of the climbing aid 510 and is therefore not represented in the illustrations relating to the present embodiment but instead is only described rudimentarily. During the transition from the measuring position into the switching position, the rolling body 850.9 is pressed from below by the resetting force against the switching surface, which corresponds to the current adjusting position. This brings about a rotation of the adjusting element if it is not in that rotational position that corresponds to the current adjusting position (adjusting process). Otherwise, the rolling body is simply pressed against the switching surface and is blocked there.

FIG. 14*a* shows the carrier element 850 lowered, in the measuring position of the associated adjusting device. The rolling body 850.9 is in this case in the middle adjusting position 850.24. The adjusting element 840 is in the rotational position 840.32. The rotational position 840.32 of the adjusting element 840 does not correspond to the middle adjusting position 850.24, for which reason an adjusting process takes place during the transition to the switching position of FIG. 14*b*.

During the transition from the measuring position into the switching position, the rolling body 850.9 is pressed from below into the wedge-shaped receiving space 840.19 of the switching element 840.10, it coming into contact first with the switching surface 840.17 arranged in front of the clearance 840.1 on account of the rotational position 840.32 of the adjusting element 840. This produces a turning moment on the adjusting element 840, so that the drivers 840.3 and 840.4 are pivoted rearward and the adjusting element 840 is brought into the centered position 840.31. In this position, the rolling body 850.9 comes into contact with the switching surface 850.18 arranged behind the clearance 840.1. The rolling body 850.9 consequently no longer exerts any moment on the adjusting element 840 and is blocked in the wedge-shaped receiving space 840.19, between the switching surfaces 840.17 and 840.18 against which it is lying.

In other words, the middle adjusting position 850.24 is assigned to switching surfaces 850.17 and 850.18, in order to be able to adjust the adjusting element 840 from the two adjacent rotational positions 840.30 and 840.32 into the centered position 840.31: the switching surface 850.17 serves the purpose of adjusting the adjusting element 840 from the rotational position 840.32 into the centered position 840.31 and the switching surface 840.18 serves the purpose of adjusting the adjusting element 840 from the rotational position 840.30 into the centered position 840.31.

The middle adjusting position 850.24 is defined by the abutting inclined portions 850.11 and 850.20. On account of the different inclinations of the two bottom portions 850.11 and 850.20, in particular since the second-frontmost portion 850.11 has a smaller inclination than the second-rearmost portion 850.20, a recess is obtained, defining the adjusting position 850.24 of the rolling body 850.9. Depending on the difference between the angles of inclination, the bottom portions 850.11 and 850.20 consequently offer support of the rolling body 850.9 also for forces in the longitudinal direction, as may occur during the interaction with the switching surfaces 840.17 or 840.18. However, the differences in inclination of the portions 850.11 and 850.20 are comparatively moderate (for example in a range from 2-8 degrees), so that the support in the longitudinal direction is weak in comparison with the adjusting positions 850.12 and 850.13, in which support of the rolling body 850.9 takes place by means of the front and rear side walls 850.4 and 850.5 of the carrier element 850, and is possibly not adequate for an adjusting process.

In order to prevent the rolling body 850.9 escaping from the adjusting position 850.24 during the adjusting process on account of the interaction with one of the switching surfaces 840.17 or 840.18, an additional displacing guide for the rolling body 850.9 may be provided on the base part and guide the rolling body 850.9 in a direction perpendicular to the ski in the switching position or during the transition from the measuring position into the switching position. In this case, it must be ensured on the one hand that the displacing guide 860 takes up the rolling body 850.9 during the raising from the measuring position and guides it in a direction perpendicular to the ski before it comes into contact with one of the switching surfaces 840.17 or 840.18 and undergoes a force in the longitudinal direction. To be able to take up the rolling body 850.9 already during the raising, in the switching position the displacing guide 860 extends into the inner space 850.6 of the carrier element 850. On the other hand, in the measuring position the displacing guide 860 should not hinder freedom of movement of the rolling body 850.9 in the inner space 850.6, for which reason the engagement into the inner space 850.6 in the measuring position must not reach into the path of movement of the rolling body 850.9.

In the representation of FIGS. 14*a* and 14*b* (represented by broken lines), the displacing guide 860 has two guide tongues 860.1 and 860.2, which are arranged in a direction largely perpendicular to the ski and in the switching position extend from above into the inner space 850.6. The guide tongues 860.1 and 860.2 are in this case fastened to an inner side of a cover element (not represented) that is formed largely by analogy with the cover element 520.21. Within the limits of a guiding tolerance, a distance between the guide tongues 860.1 and 860.2 in the longitudinal direction corresponds in this case to a diameter of the rolling body 850.9, so that the latter can be displaced between the guide tongues 860.1 and 860.2 in a direction perpendicular to the ski.

In the switching position, the guide tongues 860.1 and 860.2 are arranged in front of and behind the rolling body 850.9 in the adjusting position 850.24, respectively between two adjacent adjusting positions 850.12 and 850.24 or 850.24 and 850.13. The rolling body 850.9 is consequently fixed in the longitudinal direction and can escape. Here, the guide tongues 86.1 and 860.2 have a dimension in the longitudinal direction that is less than the aforementioned distance between the adjusting positions 850.12, 850.24 and 850.13, so that the rolling body 850.9 can occupy each adjusting position unhindered, even in the adjusting position when the guide tongues 860.1 and 860.2 are reaching to the maximum extent into the interior space 850.6. The displacing guide 860 has clearances 860.3, which for example allow displacement of the pin 830.2. Further structural design measures that are not represented make it possible for the adjusting element 840 to rotate.

However, the guide tongues 860.1 and 860.2 only extend downward to the extent that, with the carrier element 850 completely lowered, i.e. in the measuring position of the associated adjusting device, a minimum distance of the guide tongues 860.1 and 860.2 from the bottom portions 850.10, 850.11, 850.20 and 850.21 is not less than the diameter of the rolling body 850.9. This ensures that, in the measuring position, the rolling body 850.9 is freely movable in the longitudinal direction in the inner space 850.6, i.e. can roll unhindered under the guide tongues 860.1 and 860.2.

MODIFICATIONS OF THE EXEMPLARY EMBODIMENTS

It goes without saying that, in the case of all the embodiments, the drivers of the adjusting element may be provided offset with respect to the arrangements represented, so as to meet the requirements, i.e. in particular to correspond to the desired pivoting angle of the supporting lever. Similarly, the detent notches on the supporting lever may be arranged such that they are offset or rotated with respect to the positions represented, in order to achieve a desired pivoting angle. The clearances for the drivers in the side plates of the base part should in this case be appropriately adapted in a way corresponding to the path of rotation of the drivers. Similarly, the catch device should be adapted to the number of supporting positions that can be adjusted purely manually and supporting positions that can be adjusted by the adjusting device.

To sum up, it can be stated that the climbing aid according to the invention makes particularly convenient operation possible. In particular, the advantages come into effect in various configurations, such as for example a climbing aid that can be operated purely manually or with a ski stick, which can for example be set to greater and lower climbing angles in a step-by-step switching process. A semiautomatic climbing aid is also conceivable according to the invention, for example only allowing a switching up of the climbing aid to be automated. Another possibility for a semiautomatic configuration is obtained if the device according to the invention is formed in such a way that, when it is actuated, the adjusting device automatically determines in which direction a switching step should take place. In particular, a "one-button-forall" solution is conceivable here, with the skier only having to actuate a single operating unit of the climbing aid to initiate a self-running adjusting process, which changes the current supporting position to a desired climbing angle without any further intervention by the skier.

However, a fully automatic device is found to be particularly convenient, with the actuation of the adjusting device taking place by heel steps when carrying out a walking movement during climbing, in particular for example via the supporting element. In this case, with every step there is renewed automatic determination, without any special measure being taken by the skier, of whether a supporting position of the climbing aid should be adapted and, if appropriate, initiation of an adjusting process, which adjusts a supporting position of the supporting device in such a way that the device is brought closer to a desired climbing angle.

It goes without saying that the features described above can be freely combined within the scope of the invention and, moreover, further features that are familiar to a person skilled in the art can modify the invention in a way not explicitly described here without departing from the scope of the basic concept of the invention. In particular, for example, there are conceivable configurations of the device according to the invention which comprise a combination of detent cams and detent notches and/or adjusting notches and adjusting cams on one adjusting element. In particular, in the case of all conceivable embodiments, spring elements of the climbing aid device may be provided freely accessibly outside a housing to allow better operation or, in the case of all conceivable embodiments, the springs may lie on the inside. Similarly, the configurations of a supporting device that are represented here should not in any way be understood as restrictive. Rather, it is indeed possible on the basis of the adjusting device provided according to the invention to utilize far wider-ranging possibilities for forming a supporting device than has been the case with existing climbing aids, which are greatly restricted on account of the actuation having to take place directly on the supporting device.

The invention claimed is:

1. A device for a cross-country ski binding which connects a boot pivotably to a ski for walking, the device comprising:

a) a supporting device as climbing aid for the ski, the supporting device being moveable between a first and a second supporting position for supporting the boot or a ski boot carrier at a first and second distance from the ski respectively, b) an adjusting device, having an actuated state and a deactivated state, c) wherein the adjusting device includes an operating element for putting the adjusting device directly or indirectly by a user into the actuated state and d) wherein the adjusting device includes an intermediate store for storing the actuated state of the adjusting device during a time delay, e) the adjusting device being engaged with the supporting device for moving the supporting device from said first supporting position into said second supporting position after the time delay.

2. The device as claimed in claim 1, characterized in that, following actuation of the adjusting device by operation of the operating element, the actuated state of the adjusting device is storable by the intermediate store during a time interval that is determinable by the user and that an adjusting process is initiatable when or after the actuated state is discontinued.

3. The device as claimed in claim 2, characterized in that a catch device for engaging the supporting device in a supporting position is provided, which catch device disengages the current supporting position when the adjusting device is actuated and engages the supporting device in the new supporting position at the end of the adjusting process.

4. The device as claimed in claim 1, characterized in that a supporting position of the supporting device that is associated with a desired climbing angle between the ski and the boot is setable by single or multiple actuation of the adjusting device step by step.

5. The device as claimed in claim 1, characterized in that the adjusting device is actuated by the supporting device.

6. The device as claimed in claim 1, characterized in that the intermediate store is an energy store, which intermediately stores energy expended for the actuation of the adjusting device.

7. The device as claimed in claim 1, characterized in that the supporting device comprises a supporting lever that can be pivoted with respect to the ski into various pivoting positions.

8. The device as claimed in claim 1, characterized in that the adjusting device has a rocker, the adjusting device being actuable by means of a first arm of the rocker.

9. The device as claimed in claim 1, characterized in that the adjusting device has an adjusting element that is guided displaceably in an arcuate guide, is coupled to the supporting device via a joint arm and forms a reference element of the adjusting device which reflects the current neutral position of the ski.

10. The device as claimed in claim 1, characterized in that the active connection of the adjusting device to the supporting device takes place by means of an adjusting element which can be coupled to the supporting device and in that the adjusting device has a bearing for the mounting of a gravity element wherein, in the actuated state, the adjusting device is in a measuring position, in which a gravity element mounted on the bearing is released, so that that it can assume different adjusting positions in the longitudinal direction, respectively assigned to one of the at least two supporting positions, in dependence on a current direction of gravitational force, and the adjusting device has a switching position, in which the gravity element is blocked in one of the adjusting positions by the adjusting element.

11. The device as claimed in claim 10, characterized in that the bearing of the gravity element is formed on a carrier element and the base part is provided with a displacing guide, on which the carrier element is mounted displaceably on the base part in a direction that is largely perpendicular to the ski.

12. The device as claimed in claim 11, characterized in that, in the measuring position of the adjusting device, the carrier element is lowered together with the gravity element toward the ski, in comparison with the switching position, in the displacing guide.

13. The device as claimed in claim 11, characterized in that an elastic element is provided, subjecting the carrier element to a resetting force away from the ski in the displacing guide.

14. The device as claimed in claim 11, characterized in that a displacing guide is provided, on which the supporting device is mounted displaceably on the base part in a direction that is largely perpendicular to the ski and the supporting device is forcibly coupled with the carrier element with respect to the displacement perpendicular to the ski.

15. The device as claimed in claim 11, characterized in that the bearing in the carrier element is configured as a longitudinal guide in the longitudinal direction of the ski, in which the gravity element is mounted such that, in the measuring position, it is guided freely movably in the longitudinal direction of the ski.

16. The device as claimed in claim 15, characterized in that the gravity element is a rolling body.

17. A ski comprising:

a) a binding for a boot, the binding connecting the boot pivotably to the ski for walking, b) a supporting device as climbing aid for the ski, the supporting device being moveable between a first and a second supporting position, wherein in the first and second supporting position the supporting device supports the boot or a ski boot carrier at a first and second distance from the ski respectively, thereby defining a first and second climbing angle between the boot or ski boot carrier and the ski, c) an adjusting device, having an actuated state and a deactivated state, d) wherein the adjusting device includes an operating element for putting the adjusting device directly or indirectly by a user into the actuated state and e) wherein the adjusting device includes an intermediate store for storing the actuated state of the adjusting device during a time delay, f) the adjusting device being engaged with the supporting device for moving the supporting device from said first supporting position into said second supporting position after the time delay.

18. The device as claimed in claim 17, characterized in that the adjusting device comprises a measuring device for determining a longitudinal inclination of the ski in a measuring process and which allows for comparing the determined longitudinal inclination of the ski in the adjusting device with a current neutral position of the ski associated with the current supporting position.

19. The device as claimed in claim 18, characterized in that an adjusting process is only initiatable when a predetermined deviation between the longitudinal inclination is determined by the measuring device in the measuring process and the current neutral position of the ski is exceeded.

20. The device as claimed in claim 18, characterized in that the supporting device is formed and interacts with the adjusting device that, in the case where the longitudinal inclination determined is greater than the current neutral position, the new supporting position has an associated new climbing angle, which is greater than the current climbing angle associated with the current supporting position, and in the case where the longitudinal inclination determined is less than the current neutral position, the new climbing angle is smaller than the current climbing angle.

21. The device as claimed in claim 18, characterized in that the measuring process is initiatable by the measuring device when the adjusting device is actuated.

22. The device as claimed in claim 18, characterized in that the measuring device comprises a reference element, which represents the current neutral position of the ski, and a measuring element, which reproduces the actual inclination of the ski.

23. The device as claimed in claim 22, characterized in that the measuring element comprises a pendulous mass pivotably mounted transversely to the longitudinal axis of the ski.

24. The device as claimed in claim 17, characterized in that the active connection of the adjusting device to the supporting device takes place by means of an adjusting element which can be coupled to the supporting device and in that the adjusting device has a bearing for the mounting of a gravity element wherein, in the actuated state, the adjusting device is in a measuring position, in which a gravity element mounted on the bearing is released, so that that it can assume different adjusting positions in the longitudinal direction, respectively assigned to one of the at least two supporting positions, in dependence on a current direction of gravitational force, and the adjusting device has a switching position, in which the gravity element is blocked in one of the adjusting positions by the adjusting element.

25. The device as claimed in claim 24, characterized in that the adjusting element is mounted on the base part rotatably about a transverse pin with respect to the longitudinal direction of the ski.

26. The device as claimed in claim 17, characterized in that the adjusting device has an adjusting element that is guided displaceably in an arcuate guide, is coupled to the supporting device via a joint arm and forms a reference element of the adjusting device which reflects the current neutral position of the ski.

27. The device as claimed in claim 26, characterized in that a current position of the adjusting element corresponds to the current neutral position of the ski, the adjusting element being displaced in the arcuate guide from a current position into a new position after initiation of an adjusting process and thereby changing said first supporting position of the supporting device into said second supporting position by means of the joint arm.

28. The device as claimed in claim 17, characterized in that a coupling device is provided, by means of which the adjusting device can be functionally coupled to the supporting device to establish an active connection.

29. The device has claimed in claim 17, characterized in that the supporting device has at least one further supporting position, in which the adjusting device is functionally decoupled from the supporting device.

30. An adjusting device for a device as claimed in claim 17, having an actuated state and a deactivated state, the adjusting device including an operating element for putting the adjusting device directly or indirectly by a user into the actuated state and including an intermediate store for storing the actuated state of the adjusting device during a time delay.

* * * * *